US012509956B2

(12) United States Patent
Lo et al.

(10) Patent No.: US 12,509,956 B2
(45) Date of Patent: Dec. 30, 2025

(54) METHODS AND SYSTEMS FOR SELECTIVE DOWNHOLE ISOLATION

(71) Applicant: Vertice Oil Tools Inc., Missouri City, TX (US)

(72) Inventors: Michael Lo, Missouri City, TX (US); Mohamed Ibrahim Saraya, Sugar Land, TX (US)

(73) Assignee: Vertice Oil Tools, INC., Missouri City, TX (US)

( * ) Notice: Subject to any disclaimer, the term of this patent is extended or adjusted under 35 U.S.C. 154(b) by 0 days.

(21) Appl. No.: 19/088,273

(22) Filed: Mar. 24, 2025

(65) Prior Publication Data

US 2025/0215762 A1 Jul. 3, 2025

Related U.S. Application Data

(63) Continuation of application No. PCT/US2023/034088, filed on Sep. 29, 2023.

(60) Provisional application No. 63/415,856, filed on Oct. 13, 2022.

(51) Int. Cl.
*E21B 33/12* (2006.01)

(52) U.S. Cl.
CPC ..... *E21B 33/1208* (2013.01); *E21B 2200/08* (2020.05)

(58) Field of Classification Search
CPC ..... E21B 33/1208; E21B 2200/08; E21B 34/063; E21B 34/142; E21B 2200/05
See application file for complete search history.

(56) References Cited

U.S. PATENT DOCUMENTS

| | | | | |
|---|---|---|---|---|
| 11,555,377 | B2 * | 1/2023 | Lo | E21B 33/12 |
| 2019/0040709 | A1 * | 2/2019 | Garner | E21B 33/167 |
| 2020/0232301 | A1 * | 7/2020 | Andersson | F04B 53/12 |
| 2022/0259943 | A1 * | 8/2022 | Lo | E21B 34/142 |
| 2022/0259962 | A1 * | 8/2022 | Lo | E21B 34/08 |
| 2025/0215762 | A1 * | 7/2025 | Lo | E21B 33/1208 |

OTHER PUBLICATIONS

PCT_WO (Year: 2024).*

* cited by examiner

*Primary Examiner* — Steven A Macdonald
(74) *Attorney, Agent, or Firm* — Pierson IP, PLLC

(57) ABSTRACT

A downhole tool configured for selective fluid communication and isolation within a wellbore. The tool includes a mandrel, housing, plug. In a first mode, the tool functions as a resettable check valve to isolate a first area from a second area. In a second mode, the tool permits bidirectional flow while maintaining a one-way seal during transition. The plug and plunger are temporarily coupled by a shearable mechanism to allow repeated isolation and communication cycles, and subsequently, permanent communication between the areas. The system provides immediate casing-testing capability and eliminates reliance on dissolvable balls, allowing instant re-establishment of communication with the toe sleeve following pressure testing.

19 Claims, 38 Drawing Sheets

METHODS AND SYSTEMS FOR SELECTIVE DOWNHOLE ISOLATION

BACKGROUND INFORMATION

Field of the Disclosure

Examples of the present disclosure relate to a downhole tool with a plunger positioned within a plug. More specifically, embodiments are directed towards a housing configured to selectively control the plug within the housing utilizing the plunger and shear pins, wherein the plug is configured to form a resettable seal across the housing until a shear pin shears.

Background

Conventionally, after casing and cementing a well and to achieve Frac/zonal isolation in a Frac operation, a frac plug and perforations on a wireline are pushed/pumped downhole to a desired depth. Then, a frac plug is set and perforation guns are fired above to create conduit to frac fluid. This enables the fracing fluid to be pumped to the newly created conduit while isolating it from zones below using the frac plug. Typically, to aid in allowing the assembly of perforation and frac plug to reach the desired depth, specifically in horizontal or deviated laterals, pumping operations can be used. During a pumping operation, the wireline is pumped down the hole with the aid of flowing fluid.

Conventional flac plugs utilize a ball that is dropped from the surface and isolate the frac plug, this ensures a contingency of pumping another plug or downhole tools is available in case the gun misfire, this requires pumping the ball from the surface which consumes time and fluid, if the ball is run on the seat with the frac plug then it requires the well to flow back in case of gun misfire, this can be somewhat challenging if the well doesn't possess enough energy to flow. Having a ball trap in the running tool is a solution, yet it still requires a certain flow rate to allow the ball to flow back. Further, some other plugs utilize rupture discs that rupture based on a pressure differential between the zones above and below the frac plug to establish communication across the rupture disc. However, this creates scalable problems, where each stage of a wellbore requires rupture discs of different values. This can also cause situations where rupture discs may prematurely break.

Accordingly, needs exist for systems and methods utilizing a downhole tool with a plug and plunger that are configured to form a resettable tool across the housing, wherein the plunger is configured to be separated from the plunger after activating a shear pin and flowing back through the downhole tool.

SUMMARY

Embodiments disclosed herein describe systems and methods for a downhole tool. The downhole tool may include a mandrel, housing, plug, and plunger. In embodiments, the downhole tool may be utilized as a resettable check valve in a first mode of operation, allow bi-directional fluid flow in a second mode of operation, and retain a one-way seal when transitioning between the first mode of operation and the second mode of operation. In embodiments, the downhole tool may selectively isolate a first area from a second area utilizing a plug initially positioned across the housing, move away from the housing, be repositioned across the housing, and subsequently permanently move away from the housing. This may allow for repeated sequences of isolating the first area from the second area and allowing communication between the first area and the second area followed by permanent communication between the first area and the second area.

In other embodiments, the mandrel may be a hollow shaft, cylindrical rod, cartridge, etc. that is configured to form a body or the whole tool of a downhole tool, such as a frac plug, sliding sleeve, or cartridge. The mandrel may include a profile that reduces the inner diameter of the mandrel and limits the movement of the housing in the first direction. The profile may be a ledge that is perpendicular to a central axis of the downhole tool or may be a tapered sidewall that gradually and incrementally decreases the inner diameter of the mandrel.

The housing may be a cartridge, casing, container, etc. that is configured to selectively secure the plug and plunger within the housing. The housing may be mounted on an inner diameter of the mandrel, such that the housing along with the plug and the plunger are moved downhole with the mandrel. Alternatively, the housing be configured to be pumped downhole along with the plug and the plunger after the mandrel is positioned downhole. When pumped downhole, the housing may be configured to land on the profile on the inner diameter of the housing. The housing may include a passageway that extends from an upper surface of the housing to a lower surface of the housing, wherein communication across the passageway is configured to be selectively restricted via the plug and the plunger. In embodiments, the housing may include a first seat, a second seat, a pair of stoppers, and communication channels.

The first seat may be a ledge, shelf, sloped sidewall, etc. positioned on a proximal end of the housing configured to gradually decrease the inner diameter of the housing. The first seat may be configured to receive a proximal end of the plug to limit the downward movement of the plug.

The second seat may be a ledge, shelf, sloped sidewall, etc. positioned on a distal end of the housing configured to gradually decrease the inner diameter of the housing. The second seat may be configured to receive a distal end of the plug to limit the downward movement of the plunger. In embodiments, the plunger may be configured to selectively form a seal, restrict communication, etc. across the second seat.

The pair of stoppers may be located on an inner diameter of a distal end of the housing, and project across the inner diameter of the distal end of the housing. The pair of stoppers may be configured to be aligned with the body of the plunger, and positioned above a distal end of the plunger. The length between the pair of stoppers may be longer than the diameter across the body of the plunger and shorter than the diameter across the distal end of the plunger. This may allow the body of the plunger to slide between the pair of stoppers while restricting the upward movement of the distal end of the plunger.

The communication channels may be configured to allow communication around the plug when the distal end of the plug is positioned away from the first seat, and the communication channels may be blocked by an outer diameter of the plug when the plug is positioned on the first seat. Specifically, the communication channels may include an upper end and a lower end. When the plug is shifted downward due to fluid flowing in a downhole direction, the plug may be positioned on or below the lower ends of the communication channels, which may block or restrict communication through the lower end of the communication channels. However, due to flow back below the plug, the plug may be positioned away from or above the lower ends of the communication channels, which may allow the reverse flow of fluid into the lower ends of the communication channels, around the outer diameter of the plug, and up hole out of the upper ends of the communication channels.

The plug may be an object, disk, etc. that is configured to selectively form a seal or restrict communication across an inner diameter of the housing. When the housing is run in a hole, the plug may be configured to be positioned across the first seat of the housing. When the plug is positioned across the first seat of the housing, fluid flowing in a first, downhole, direction may not be communicated between the first area above the plug to a second area below the plug. Specifically, a proximal end of the plug may be selectively positioned against or on an inner diameter of the housing to restrict communication through the passageway through the housing, wherein the proximal end of the plug may have a larger outer diameter than a distal end of the plug. For example, when fluid is flowing in the first direction, the corresponding forces may move the plug to be positioned across the passageway of the housing, wherein the downhole movement of the plug may be restricted by the first seat. When the plug is positioned on the first seat, the distal ends of the communication channels may be covered by the plug. Responsive to flowing fluid in the second direction, the plug may move in a second, up-hole, direction, away from the first seat, wherein the up-hole movement of the plug may be restricted by the plunger. When the plug is positioned uphole from the first seat, the plug may not cover the distal ends of the communication channels. In embodiments, the plug may include a conduit and slot. The conduit may be a passageway extending from the upper surface of the plug to the slot, and the conduit be configured to allow pressure to be applied against a proximal end of the plunger. The slot may extend from the conduit to a distal end of the plug, wherein the slot is configured to receive a proximal end of the plunger.

In embodiments, the plug may be selectively coupled to the plunger via a temporary coupling mechanism, such as a shear screw, pin, breakable threads, etc. The temporary coupling mechanism may have a first end configured to be inserted into a first opening in the inner diameter of the plunger, and a second end configured to be inserted into a second opening in the inner diameter of the housing. When the temporary coupling mechanism, is intact, the plug and the plunger may be locked together, such that the plunger and the plug axially move together. This may enable the plug to be positioned across the first seat, move away from the first seat, and be repositioned on the first seat. Responsive to activating the temporary coupling mechanism, the axial movement of the plug may be independent of the axial movement of the plunger. In embodiments, the temporary coupling mechanism may be activated based on applying a pressure differential across the temporary coupling mechanism that is greater than a pressure threshold, which may cause the temporary coupling mechanism to shear, break, etc. to separate the first end of the temporary coupling mechanism from the second end of the temporary coupling mechanism.

The plunger may be a device that is configured to selectively retain the plug in place before the temporary coupling mechanism is activated, and the plunger is configured to allow the relative uphole movement of the plug after the temporary coupling mechanism is activated. The plunger may include a shaft and a distal end.

The shaft of the plunger may be configured to be inserted into the slot of the plug, and temporarily coupled to the plug via the temporary coupling mechanism. When the shaft and plug are coupled together, the axial movement of the plug may be dependent on the axial movement of the plunger. After the activation of the temporary coupling mechanism, the plug may independently move uphole, and the plunger may independently move downhole. The shaft of the plunger may be configured to extend from the cavity to the distal end of the plunger. The shaft may have a smaller outer diameter than the outer diameter of the distal end of the plunger. In embodiments, a distance across the outer diameter of the shaft may be smaller than the distance between the pair of stoppers. This may allow the shaft to slide axially between the pair of stoppers.

The distal end of the plunger may be positioned downhole from the pair of stoppers, wherein a distance across an outer diameter of the distal end of the plunger may be larger than the pair of stoppers. This relative geometry may limit the up-hole movement of the plug and plunger. Specifically, when there is a reverse flow of fluid, the plunger and the plug may move uphole until an upper surface of the distal end of the plunger contacts the pair of stoppers. This may allow for a repeatable up-hole movement of the plug and the plunger. The distal end of the plunger may also be configured to be positioned on the second seat across the housing to restrict communication through the housing. In specific embodiments, the distal end of the plunger may be configured to be positioned across the second seat of the housing only after activating the temporary coupling mechanisms and flowing fluid in the first direction, which may cause the plunger to move downhole while the plug remains on the first seat. Furthermore, after activating the housing and having fluid flow in the second direction, the plug may move uphole away from the outside of the housing to no longer be able to sit across the housing while the plunger remains within the housing due to the distal end of the plunger being larger than the distance between the pair of stoppers. This allows downhole fluid flow to position the distal end of the plunger across the second seat while the plug is permanently disengaged from the housing and the plunger.

Further, in other applications needs exist to test the casing to maximum operating pressure before starting the standard operation of perforating and pumping stimulation fluid. Currently, to test a maximum operation pressure a dissolvable ball is pumped downhole, and the ball lands on a ball seat located just above the toe sleeve. Then, the casing is tested and the ball is allowed to dissolve, this may take a few days, or weeks before it dissolves. If the ball doesn't dissolve, communication with the toe sleeve is lost, and intervention with coiled tubing, stick pipe, or any other conveying method to re-open or perforate the casing above the ball is necessary. Hence, needs exists to have a downhole tool that can be equipped with the resettable plug that allows the casing to be tested instantly while establishing communication with the toe sleeve instantly by flowing back through down hole tool.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention, and the invention includes all such substitutions, modifications, additions, or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
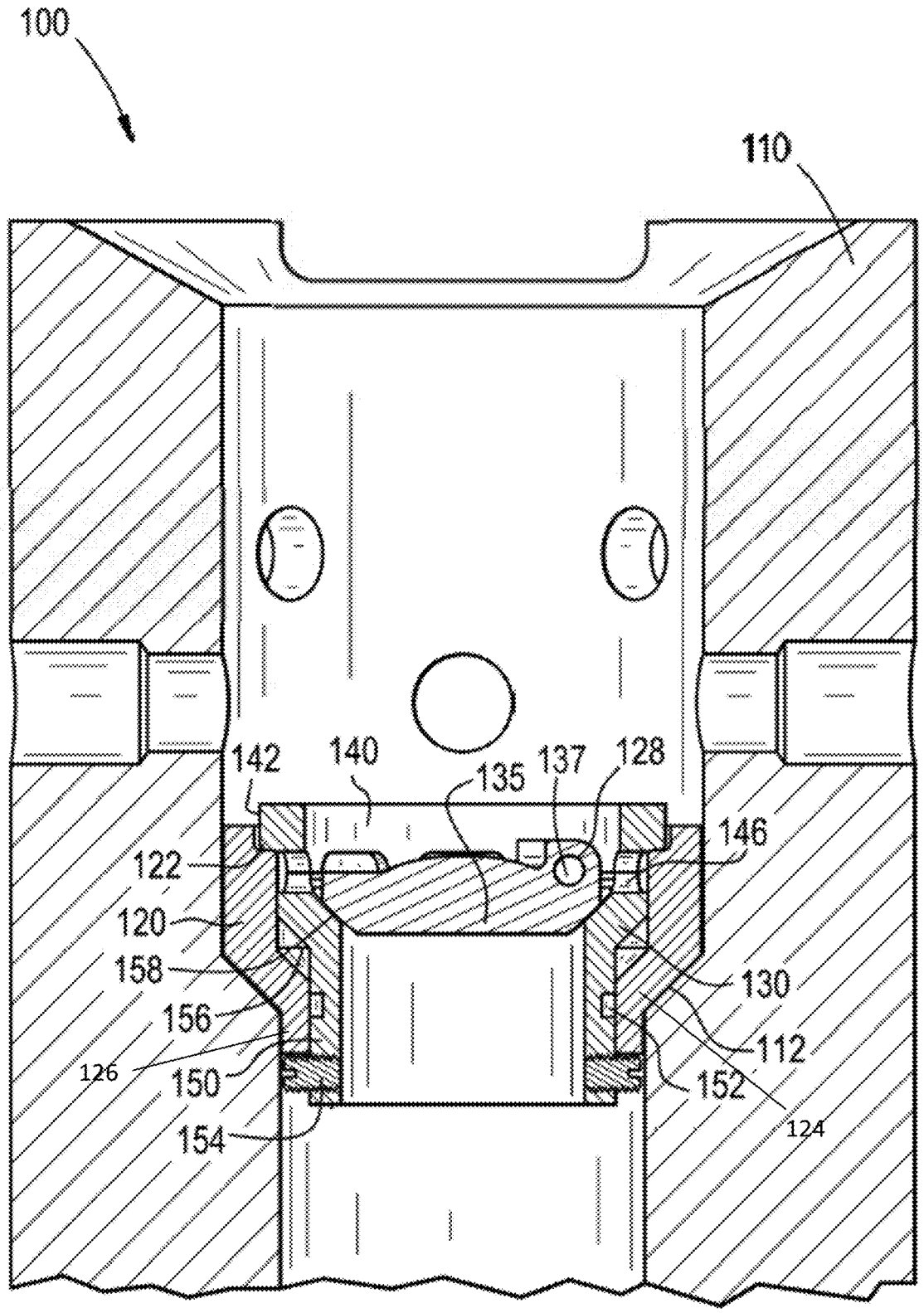
FIG. 1 depicts a downhole tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted to facilitate a less obstructed view of these various embodiments of the present disclosure.

DETAILED DESCRIPTION

In the following description, numerous specific details are outlined to provide a thorough understanding of the present invention. It will be apparent, however, to one having ordinary skill in the art that the specific detail need not be employed to practice the present invention. In other instances, well-known materials or methods have not been described in detail to avoid obscuring the present invention.

FIG. 1 depicts a downhole tool 100, according to an embodiment. Downhole tool 100 may be a downhole tool that is configured to isolate areas of a geological formation or within a mandrel. For example, downhole tool 100 may be a toe sleeve, lower sub, frac plug, sliding sleeve, cartridge, hollow tubing, etc. Downhole tool 100 may enable an object to be positioned within the housing and positioned in the closed position before the housing is positioned downhole. This may allow the object to be pumped downhole along with the housing in the closed position, eliminating the need to drop balls downhole to isolate the wellbore or require shifting tools to set a flapper downhole. Further, by positioning the object in the closed position within the housing before positioning the housing within the hole or down well, there is no need to drop and pump a dissolvable ball downhole. Accordingly, there will be no need for a waiting period for the ball to dissolve to allow for pumping. Furthermore, embodiments may allow the object to form a resettable plug that allows isolation of two zones while allowing communication between the two zones instantly, and repeatable, by flowing back through the downhole tool.

Downhole tool 100 may include a mandrel 110, insert 120, and housing 130.

Mandrel 110 may be a hollow shaft, sliding sleeve, cartridge, cylindrical, rod, etc. that is configured to form a body of downhole tool 100. Mandrel 110 may include a profile 112 that reduces the inner diameter of mandrel 110 and limits the movement of insert 120 in the first direction. Profile 112 may be keys or a ledge that decreases the inner diameter of mandrel 110. In embodiments, profile 112 may be perpendicular to a central axis of downhole tool 100 or be a tapered ledge that gradually and continuously decreases the inner diameter across mandrel 110.

Insert 120 may be a tool formed of composite material, or any desired material, such as a dissolvable material, which may be a more brittle material than mandrel 110. Insert 120 may be configured to be mounted on an inner diameter of mandrel 110. In other embodiments, insert 120 may be a dart, wiper, cartridge, or sliding sleeve that is configured to encompass housing 130, and be pumped downhole after mandrel 110 or casing is positioned at a desired location. In specific embodiments, insert 120 may be a cartridge with external keys that are configured to land on a desired location within mandrel 110. Insert 120 may include ledge 122, sloped sidewall 124, distal end 126, and pin slots 128.

Ledge 122 may decrease an inner diameter across insert 120, which may be configured to act as a stopper, no-go, etc. to restrict the movement of an upper portion of housing 130 in a first direction, wherein the first direction may be downhole. In other embodiments, ledge 122 may be keys or profiles that are configured to latch, mate, etc. with corresponding keys on upper portion 140. More specifically, ledge 122 may be configured to receive a projection 142 of upper portion 140 of the housing 130. Responsive to positioning projection 142 of upper portion 140 on ledge 122, movement of housing 130 in the first direction may be restricted when upper portion 140 and lower portion 150 are coupled together. However, when upper portion 140 and lower portion 150 are decoupled, ledge 122 may not restrict the movement of lower portion 150 in the first direction.

Sloped sidewall 124 may be configured to gradually decrease the inner diameter of the insert 120. Sloped sidewall 124 may be a second ledge configured to receive lower portion 150 of housing 130 to restrict the movement of lower portion 150 in the first direction after decoupling upper portion 140 and lower portion 150. In embodiments, an angle of the sloped sidewall may correspond to the tapered sidewall of mandrel 110. Furthermore, a seal or other restriction of communication may be formed between an outer diameter of lower portion 150 and an inner diameter of insert 120 when lower portion 150 and upper portion 140 are de-coupled.

The distal end 126 of insert 120 may decrease a distance across an inner diameter of insert 120 to create a lower shelf. Distal end 126 may be configured to interface with elements locking outcrops 154 of lower portion 150 to limit the movement of lower portion 150 in a second direction. In certain embodiments, tool 100 may not include an insert 120 and housing 130 may be directly mounted on mandrel 110, wherein mandrel 110 may have a similar inner profile as that described above.

Pin slots 128 may be holes, slots, indentations, etc. positioned through inserts that are configured to selectively receive flapper pin 137. Specifically, pin slots 128 may have a first end that is positioned on the proximal end of insert 120 and extends towards a distal end of insert 120. Pin slots 128 may extend in a linear path with a larger length than that of flapper pin 137, which may allow flapper pin 137 to be free-floating within pin slots 128. The proximal end of pin slots 128 may be configured to be contained between the upper portion 140 and lower portion 150 of housing 130 when upper portion 140 and lower portion 150 are coupled together. After flapper pin 137 is disengaged from pin slots 128 it may be unlikely that flapper pin 137 can reengage with pin slots 128 downhole.

Housing 130 may be formed of brass, composite, aluminum, cast iron, or any other material that can dissolve over time due well fluid, temperature, and/or chemical reactions. Housing 130 may be a unified component that is configured to be positioned within a cartridge, insert 120, or mandrel 110. Housing 130 may be configured to be positioned within insert 120 when run in a hole. Accordingly, flapper 135 or another object may be positioned within housing 130 before housing 130 is positioned downhole. The housing 130 may include a flapper 135, upper portion 140, and lower portion 150. In other embodiments, the flapper 135 and flapper pin 137 may be replaced by a disc, object, or any geometrical object configured to sit across housing 130.

Flapper 135 may be a rotatable disc formed of brass, composite, aluminum, cast iron, or any other material that can dissolve over time due well fluid and temperature. However, in other embodiments, flapper 135 may be a disc, ball, object, etc. that does not rotate. Flapper 135 may be configured to rotate from a position blocking an inner diameter of the tool 100 to a position allowing fluid to flow around flapper 135. In embodiments, downhole fluid flow may be configured to position flapper 135 across housing 130, and reverse fluid flow may move flapper 135 away from flapper seat 158. When flapper 135 extends across an annulus within d, flapper 135 may be configured to be positioned on a flapper seat 158 within the lower portion 150 of housing 130. When flapper 135 is positioned on flapper seat 158, whether upper portion 140 and lower portion 150 are coupled or decoupled from each other, a first area on the first side of flapper 135 may be isolated from a second area on the second side of flapper 135. However, if flapper 135 is rotated to not extend across the annulus within tool 100, then the first area and second area may not be isolated from each other. Flapper 135 may be a free-floating component that is mounted inside the housing 130 via a flapper pin 137 and insert 120, wherein flapper 135 may move along a limited linear axis based on the length of pin slots 128. Flapper 135 may be configured to translate forces applied to flapper 135 against stress points 146 within housing 130 to separate upper portion 140 and lower portion 150 of housing 130.

Flapper pin 137 may be free-floating, which enables flapper 135 to move along a limited linear axis confined by pion slots 128. Flapper pin 137 may extend across an entirety of the diameter of housing 130 and have ends that are configured to be inserted into pin slots 128. When flapper pin 137 is inserted into the pin slots 128, flapper 135 may be couple housing 130 and insert 120. In embodiments, flapper pin 137 may be an integral portion of flapper 135 or may be removably coupled to flapper 135, such that flapper pin 137 may slide out of flapper 135. Further embodiments may utilize multiple pins on different sides of flapper 135 which may limit the rotation of flapper 135.

Upper portion 140 of housing 130 may be configured to be selectively decoupled to lower portion 150 of housing 130 based on a pressure applied across housing 130 and a direction of fluid flowing within tool 100. Upper portion 140 may include projection 142 and stress points 146. In other embodiments, upper portion 140 and lower portion 150 may be two elements connected via stress points 146, which can be a shear screw or any other temporary coupling mechanism.

Projection 142 may be positioned on the proximal end of upper portion 140 and project away from the central axis of housing 130 to increase the outer diameter of upper portion 140. Projection 142 may be configured to slide onto and sit on ledge 122. Responsive to positioning projection 142 on ledge 122, movement of upper portion 140 in the first direction may be limited.

Stress points 146 may be positioned between upper portion 140 and lower portion 150 of housing 130. Stress points 146 may be weak points where upper portion 140 becomes disconnected from lower portion 150. In embodiments, stress points 146 may be configured to receive a force from flapper 135 against flapper seat 158 responsive to moving the flapper 135 downhole. More specifically, when fluid is flowing through the inner diameter of tool 100 in a downhole direction, flapper 135 may receive forces created by the flowing fluid/pressure. This may cause flapper 135 to sit on the lower portion 150 of the housing 130, and apply pressure against the stress points 146. When flapper 135 applies a pressure greater than a stress threshold of stress points 146, stress points 146 may break, activate, etc. causing upper portion 140 and lower portion 150 to become detached and separated. Then, lower portion 150 of housing may move in the first direction towards the distal end of housing 130 along with the flapper 135 and flapper pin 137 while upper portion 140 does not axially move. In other embodiments, the pressure on flapper 135 may be a direct result of applying pressure above flapper 135 without having to flow fluid through the inner diameter of downhole tool 100.

Lower portion 150 of housing 130 may be configured to be selectively decoupled to upper portion 140 of housing 130. Lower portion 150 may include seal 152, locking outcrops 154, and tapered sidewall 156. Seal 152 may be configured to be positioned between an outer diameter of the lower portion 150 and an inner diameter of inset 120. Seal 152 may not allow or restrict communication through a gap between insert 120 and housing 130 when lower portion 150 is still connected to the upper portion 150 of housing 130, and when flapper 135 is positioned on flapper seat 158. Locking outcrops 154 may be positioned on the distal end of lower portion 150 below the distal end 126 of insert 120.

Locking outcrops 154 may increase the outer diameter of the lower portion 150 such that the diameter of locking outcrops 154 is larger than that of distal end 126 of insert 120. Due to locking outcrops 154 being larger than that of the outer diameter of the distal end 126 of insert 120, locking outcrops 154 may restrict the movement of lower portion 150 in a second direction relative to insert 120, wherein the second direction is an opposite position from the first direction. This may assist in the disengaging of lower portion 150 from the upper portion 140, flapper 135, and flapper pin 137 when there is a flow back through tool 100, wherein lower portion 150 may not travel uphole. Further, by restricting lower portion 150 from moving in the second direction using locking outcrops 154 and the first direction using ledge 122, the lower portion 150 can be milled with the downhole tool as an integral piece. Hence facilitating milling operations if needed.

Tapered sidewall 156 may be a slanted outer sidewall of housing 130 1 that is configured to be positioned on slanted sidewall 124 of insert 120 after lower portion 150 is sheared from upper portion 140.

Flapper seat 158 may be positioned between stress points 146 and locking outcrops 154. Flapper seat 158 may be configured to reduce the inner diameter across lower portion 150, such that flapper 135 may be positioned on flapper seat 158. Responsive to flapper 135 receiving pressure above flapper 135 in the first direction, flapper 135 may translate these forces to lower portion 130 through flapper seat 158, which may shear stress points 146.

Figure 2:
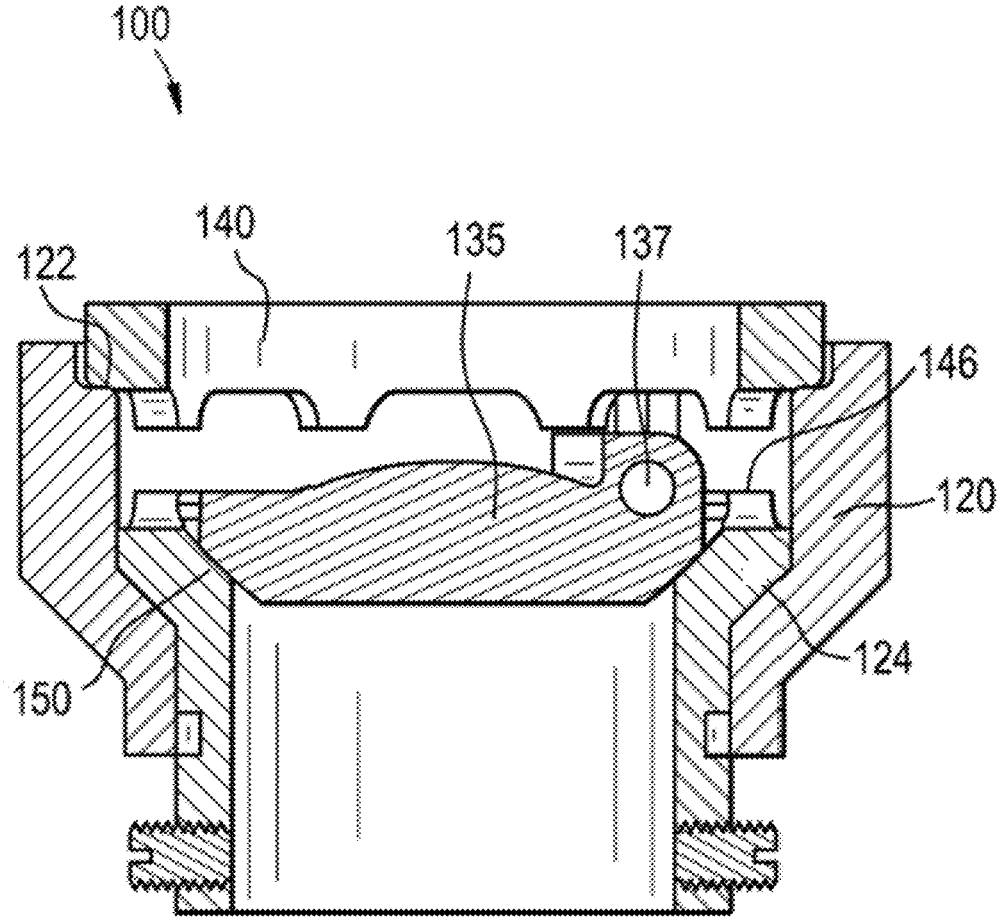
FIG. 2 depicts a downhole tool, according to an embodiment.

FIG. 2 depicts a downhole tool 100, according to an embodiment. Elements depicted in FIG. 2 may be described above, and for the sake of brevity, a further description of these elements is omitted. Once downhole tool 100 is set at a desired depth with flapper 135 being in the closed position, a pressure above flapper 135 may increase past the stress threshold. Responsive to the pressure in the first direction, flapper 135 may apply the pressure against stress points 146 that is greater than a stress threshold. This may activate stress points 146 and cause stress points 146 to break. When stress points 146 are activated, upper portion 140 and lower portion 150 may become decoupled.

When the pressure is applied stress points 146 via flapper 135, to decouple upper portion 140 and lower portion 150, lower portion 150 may slide in the first direction. However, due to the restriction created by ledge 122, upper portion 140 may not be able to move in the first direction.

Furthermore, lower portion 150 may slide downhole creating a gap between upper portion 140 and lower portion 150. Yet, because of sloped sidewall 124, the movement of lower portion 150 in the first direction may be limited. As such, after stress points 146 break, both upper portion 140 and lower portion may be separated from each other but still retained within insert 120. Further, flapper 135 will continue to isolate pressure above from pressure below as it will continue to be seated on flapper seat 158. In other embodiments, insert 120 may be the mandrel 110.

Figure 3:
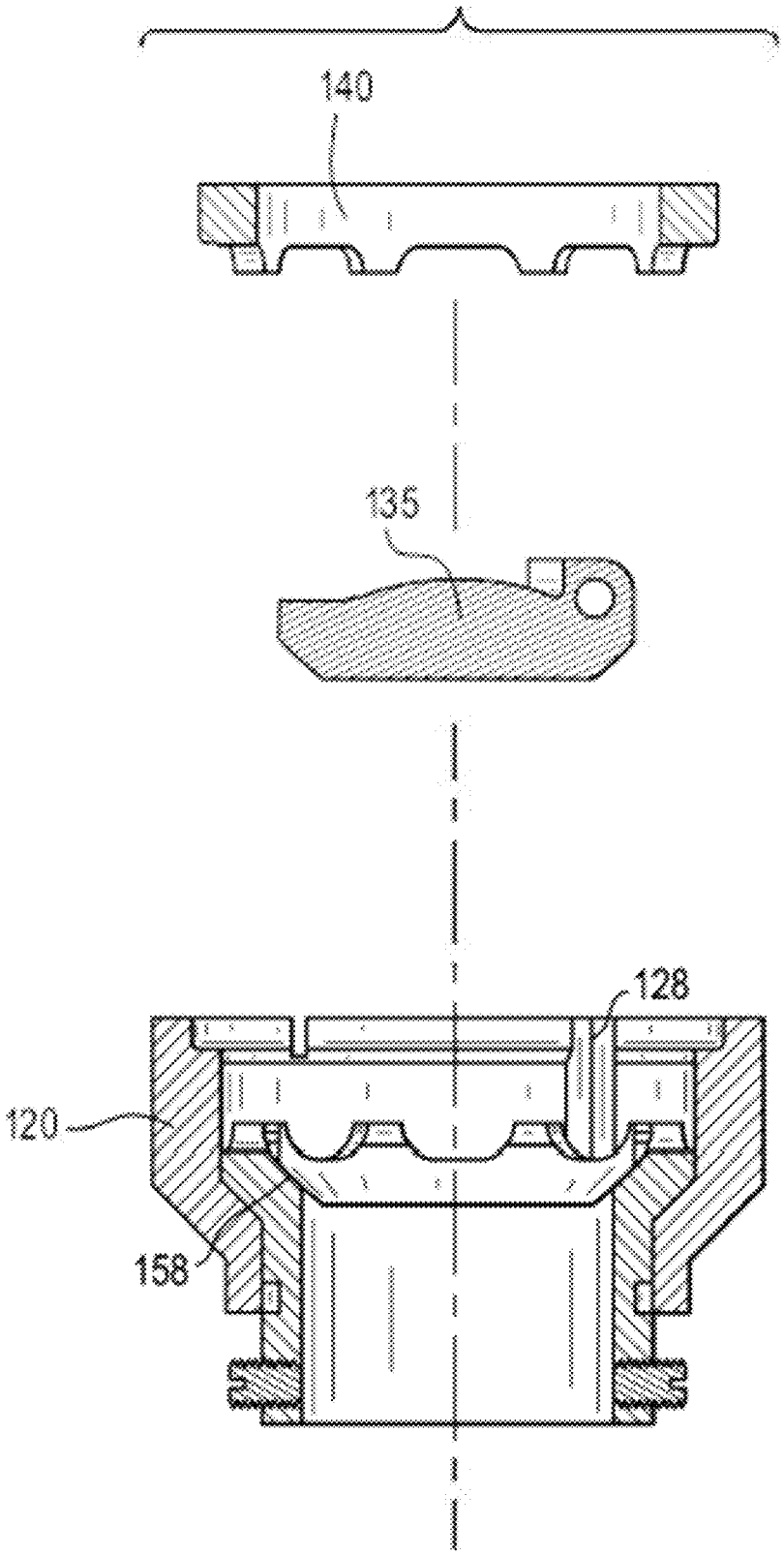
FIG. 3 depicts a downhole tool, according to an embodiment.

FIG. 3 depicts a downhole tool 100, according to an embodiment. Elements depicted in FIG. 3 may be described above, and for the sake of brevity, a further description of these elements is omitted. After upper portion 140 and lower portion 150 are decoupled from each other and there is fluid flowing through downhole tool 100 in the second direction, upper portion 140, flapper 135 and flapper pin 137 may be removed from insert 120.

When flapper 135, flapper pin 137, and upper portion 140 move in the second direction, lower portion 150 may remain within insert 120 and/or the mandrel 110 due to locking outcrops 154.

In embodiments, based on the geometry of flapper 135, flapper pin 137, and upper portion 140 it will be extremely unlikely or not statistically possible for flapper 135 and flapper pin 137 to be reinserted into pin slots 128 and seal on flapper seat 158. Furthermore, because flapper 135 may be formed of a dissolvable material over time it may become impossible for flapper 135 to seal across housing 130 due to its decrease in size.

Figure 4:
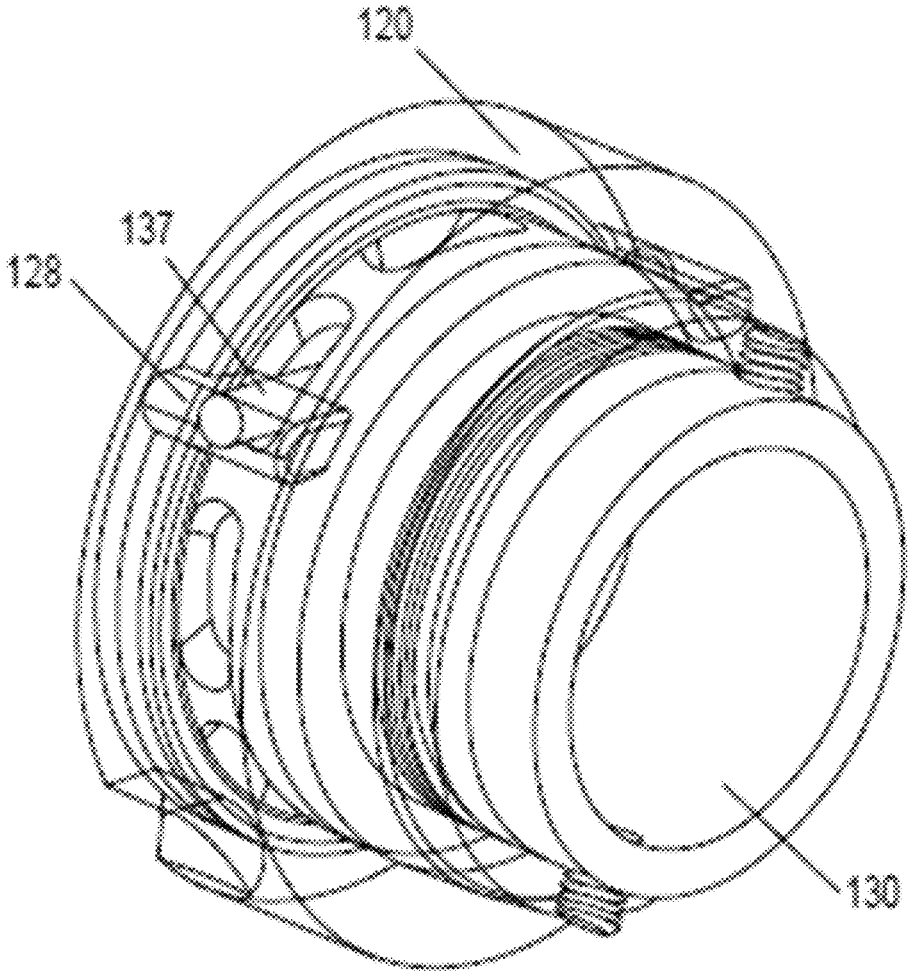
FIGS. 4 and 5 depict a perspective view of an insert and housing, according to an embodiment.
Figure 5:
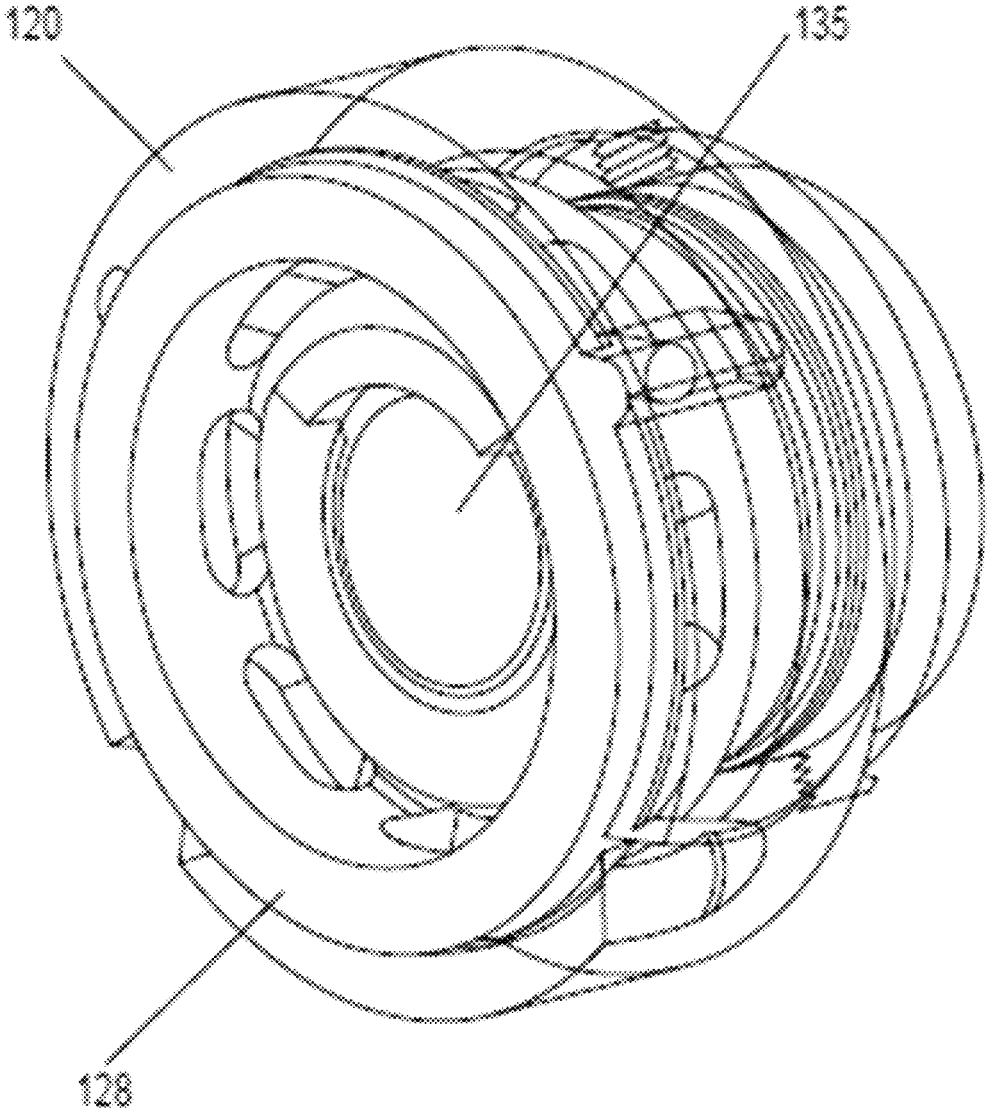

FIGS. 4 and 5 depict a perspective view of insert 120 and housing 130, according to an embodiment. Elements depicted in FIGS. 4 and 5 may be described above, and for the sake of brevity, a further description of these elements is omitted. As depicted in FIGS. 4 and 5 pin slots 128 within insert 120. Pin slots 128 may extend from the upper end of insert 120 towards the lower end of insert 120 to provide limited axial movement of flapper pin 137. When upper portion 140 is coupled with lower portion 150, upper portion 140 may restrict the upward movement of pin 137 of flapper 135, such that flapper 135 may remain within insert until upper portion 140 is decoupled from lower portion 150.

Furthermore, as depicted in FIGS. 4 and 5, housing 130 may include a series of windows/gaps that separate stress points 146 from each other. These gaps may be used to control the width of the stress points 146, which may control the threshold of its shearing/failing. Further, these windows may allow flapper pin 137 to be inserted through housing 130 and into pin slots 128 which is part of insert 120. In other embodiments, slot 128 may be directly engraved into mandrel 100.

Figure 6:
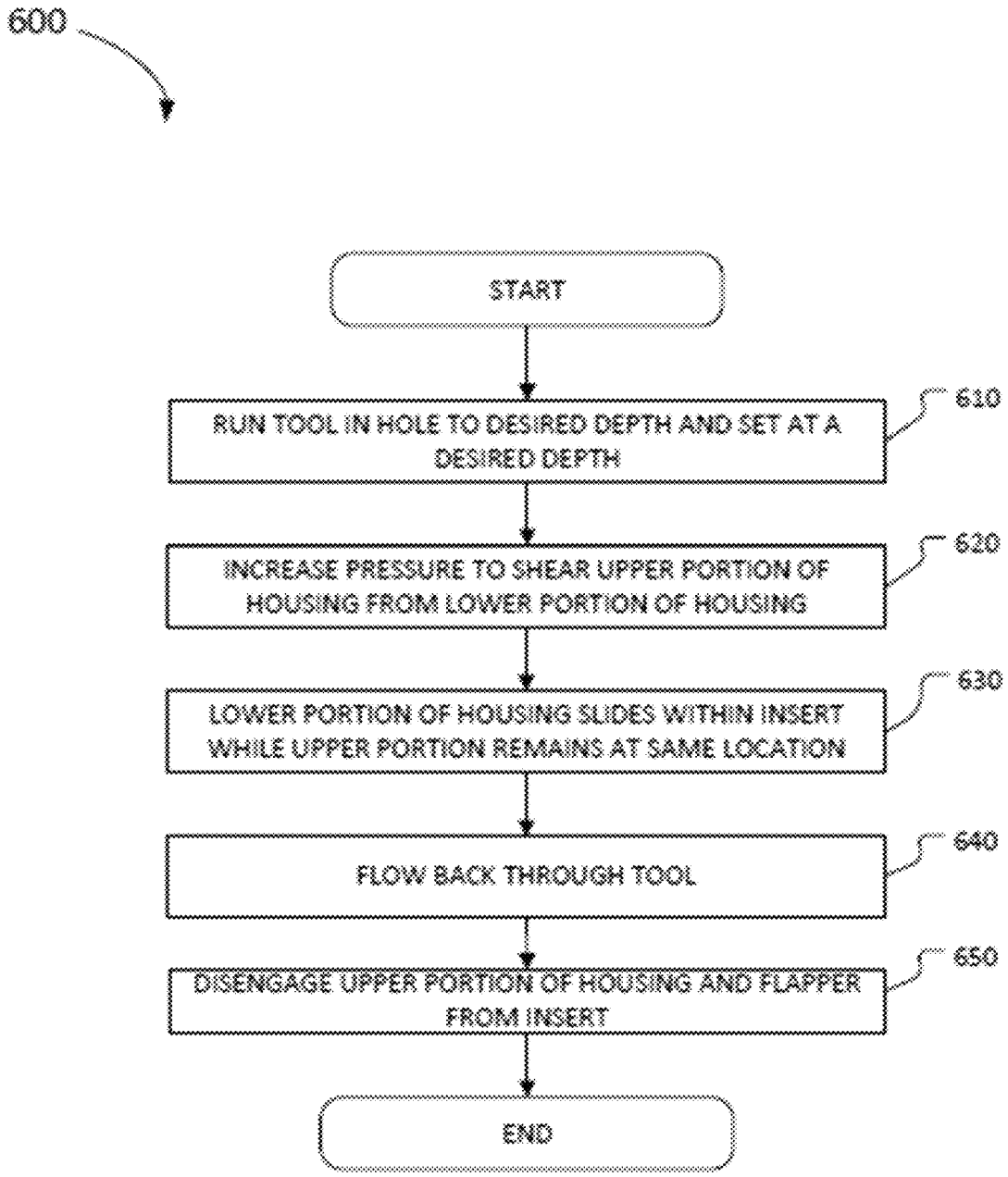
FIG. 6 depicts an operation sequence for shearing a housing with an object, according to an embodiment.

FIG. 6 depicts an operation sequence for shearing a housing with a flapper, according to an embodiment. The operational sequence presented below is intended to be illustrative. In some embodiments, operational sequence may be accomplished with one or more additional operations not described, and/or without one or more of the operations discussed. Additionally, the order in which the operations of the operational sequence are illustrated in FIG. 6 and described below is not intended to be limiting.

At operation 610, a downhole tool may be run in hole and set at the desired depth. The downhole tool may be run in hole with a flapper or solid disk being in a closed position across a housing. The flapper or solid disk may be directly coupled to the housing via a shear pin, set screw, etc.

At operation 620, the pressure above the flapper or solid disk may be increased past a stress threshold by applying pressure in a first direction, wherein the first direction may be downhole. This pressure translates forces to stress points via the flapper or solid disk.

At operation 630, based on the stress threshold and pressure applied to the stress points via the flapper or solid disk, the stress points may become activated. Activating the stress points may decouple an upper portion of the housing from the lower portion of the housing moving the lower portion downhole and the upper portion remains in place. After activating the stress points both the upper portion and the lower portion may remain encompassed by an insert. While both the upper portion and the lower portion are encompassed by the insert, an area above the flapper or solid disk may still be isolated from an area below the flapper, via the flapper or solid disk, even after the upper portion and the lower portion are decoupled from each other and the stress points activated.

At operation 640, fluid may flow or pressure increase in the second direction and interact with the flapper or solid disk positioned within the insert.

At operation 650, based on the fluid flowing in the second direction the flapper or solid disk, the flapper pin and the upper portion of the housing may flow in the second direction and no longer be engaged or interfaced with the insert while the lower portion remains coupled to the insert. This may allow fluid to flow through the insert and the lower portion of the housing to stay engaged with the insert.

Figure 7:
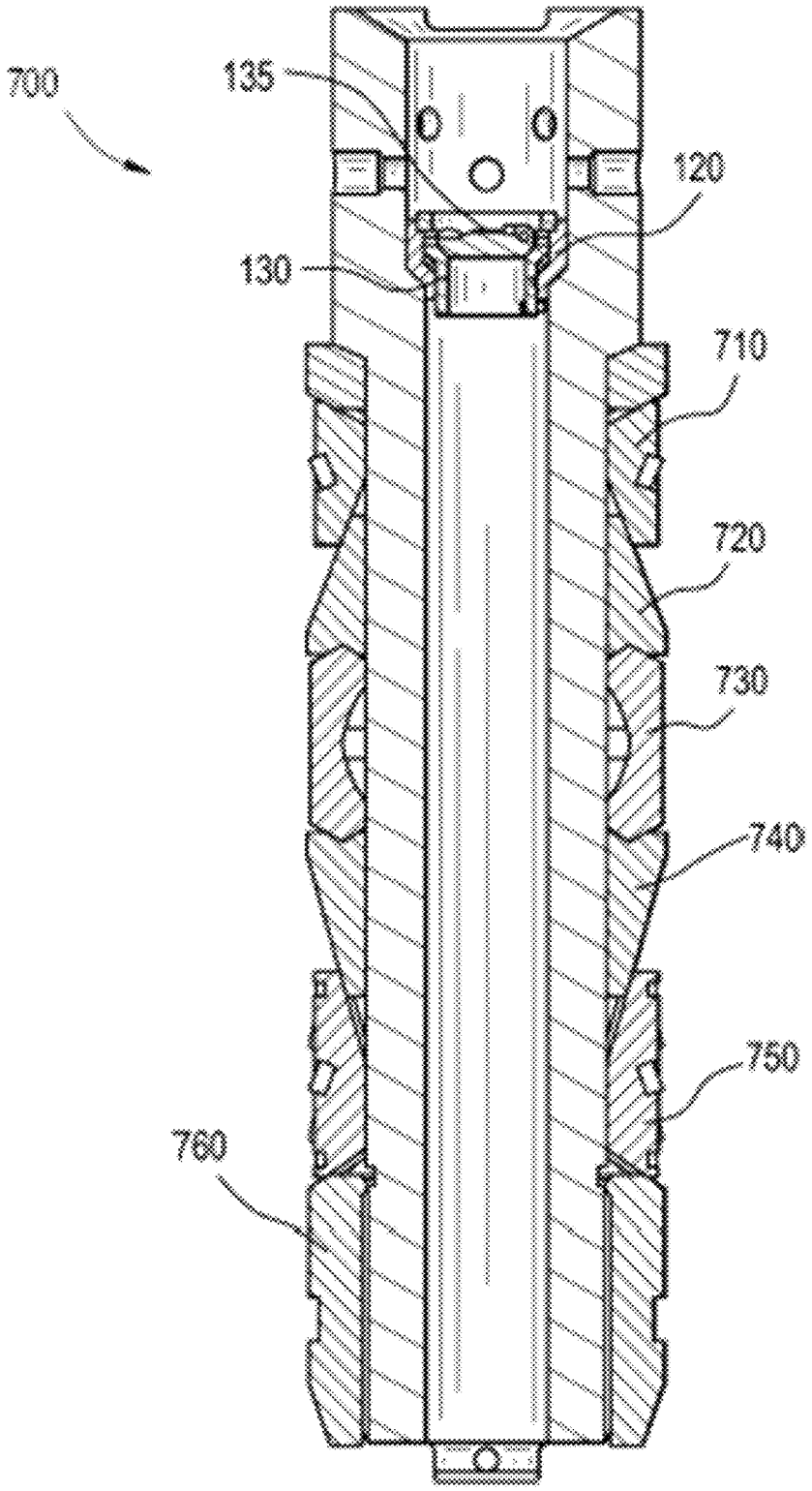
FIG. 7 depicts a downhole tool, according to an embodiment.

FIG. 7 depicts a downhole tool 700, according to an embodiment. Elements depicted in FIG. 7 may be described above, and for the sake of brevity, a further description of these elements is omitted.

As depicted in FIG. 7, downhole tool 700 may be a downhole tool with upper slips 710, upper cone 720, packing element 730, lower cone 740, and lower slips 750. In other embodiments, upper slips 710 may be eliminated.

The upper slips 710 may be configured to radially expand/break based on the movement of the upper cone 720. The upper cone 720 may be positioned between the upper slips 710 and the packing element 730. The upper cone 720 may be configured to engage with the upper slips 710 to radially expand/break the upper slips 710. In embodiments, the upper cone 720 may be coupled to the mandrel via breakable threads or any other breakable coupling mechanism. The threads on the upper cone 720 may be configured to directly couple upper cone 720 with the mandrel of the downhole tool 700 to maintain the upper cone 720 in a non-deployed state even with incidental movement from the packing element 730.

The packing element 730 may be a packer/rubber/elastic material that is configured to compress and radially expand across the wellbore. The packing element 730 may be configured to compress based on a pressure differential/force across the packing element 730 caused by the upper cone 720 and the lower cone 740 trapping these pressures/forces during downhole tool setting and/or while fracing operation above the downhole tool after setting.

The lower cone 740 may be positioned between the packing element 730 and the lower slips 750. The lower cone 740 may be configured to engage with the lower slips 750 to radially expand or break the lower slips 750. In embodiments, the lower cone 740 may be coupled to the mandrel via breakable threads or any other breakable coupling mechanism. The threads on the lower cone 740 may be configured to directly couple the lower cone 740 with the mandrel of the downhole tool 700 to maintain the lower cone 740 in a non-deployed state even with incidental movement from the lower slips 750 or packing element 730.

The lower slips 750 may be positioned adjacent to the lower cone 740 and cap 760. The lower slips 750 may be configured to radially expand or break based on the movement of the lower cone 740. In embodiments, the lower slips 750 may be coupled to the mandrel via breakable threads or any other breakable coupling mechanism. The threads on the lower slips 750 may be configured to directly couple the lower slips 750 with the mandrel of the downhole tool 700 to maintain the lower slips 750 in a non-deployed state even with incidental movement from the lower cone 740.

As further depicted in FIG. 7, insert 120, housing 130, and flapper 135 may be configured to be mounted on a proximal end of downhole tool 700, between the proximal-most end of downhole tool 700 and upper slips 710. This may allow the elements of downhole tool 700 to not be activated until communication is established across housing 130. In other embodiments, insert 120, housing 130, and flapper may be configured to be mounted on a distal end of the downhole tool 100.

Figure 8:
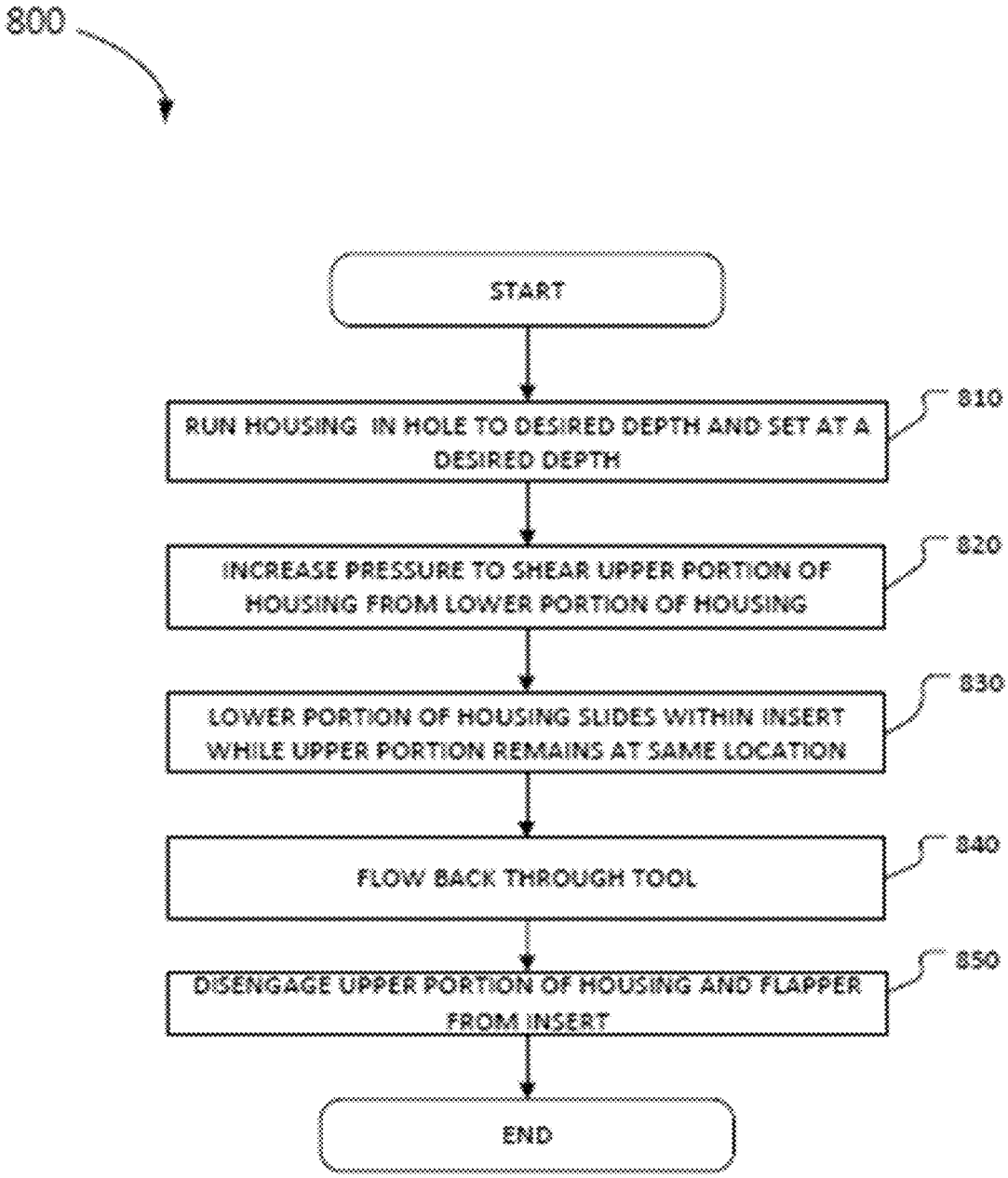
FIG. 8 depicts an operation sequence for shearing a housing with an object, according to an embodiment.

FIG. 8 depicts an operation sequence for shearing a housing with a flapper, according to an embodiment. The operational sequence presented below is intended to be illustrative. In some embodiments, operational sequence may be accomplished with one or more additional operations not described, and/or without one or more of the operations discussed. Additionally, the order in which the operations of the operational sequence are illustrated in FIG. 8 and described below is not intended to be limiting.

At operation 810, a shearable housing may be run in hole to a desired depth within a cartridge. For example, the cartridge may land on a toe sleeve or any other casing with internal diameter restrictions. The cartridge may be run in hole with an object being in a closed position across the housing. The cartridge may be configured to move downhole within a mandrel until the corresponding keys on an outer profile of the cartridge latch with corresponding keys on a profile of the mandrel.

At operation 820, after the cartridge has landed on the mandrel. Pressure above the object may be increased to move a sliding sleeve and open ports to perform a fracturing operation, pressure test casing, etc. When increasing the pressure above the object the pressure may be increased past a stress threshold by applying pressure in a first direction, wherein the first direction may be downhole. This pressure translates forces to stress points via the object.

At operation 830, based on the stress threshold and pressure applied to the stress points via the object, the stress points may activate and break. The activation of the stress points may cause an upper portion of the housing to be decoupled from the lower portion of the housing while both the upper portion and the lower portion are encompassed by the cartridge. While both the upper portion and the lower portion are encompassed by the cartridge, an area above the object may still be isolated from an area below the object even after the upper portion and the lower portion are decoupled from each other. In embodiments, the upper portion of the housing may be sheared before, after, or during the fracturing operation, as the seal is maintained within the cartridge. In embodiments, after activation of the stress points the lower portion of the housing may move downhole while the upper portion of the housing remains fixed in place.

At operation 840, fluid may flow or pressure increase in the second direction and interface with the object positioned within the cartridge.

At operation 850, based on the fluid flowing in the second direction the object and the upper portion of the housing may flow in the second direction and no longer be engaged or interfaced with the insert while the second portion of the housing remains downhole. This may allow bidirectional fluid flow through the insert while the lower portion of the housing stays engaged with the cartridge.

Figure 9:
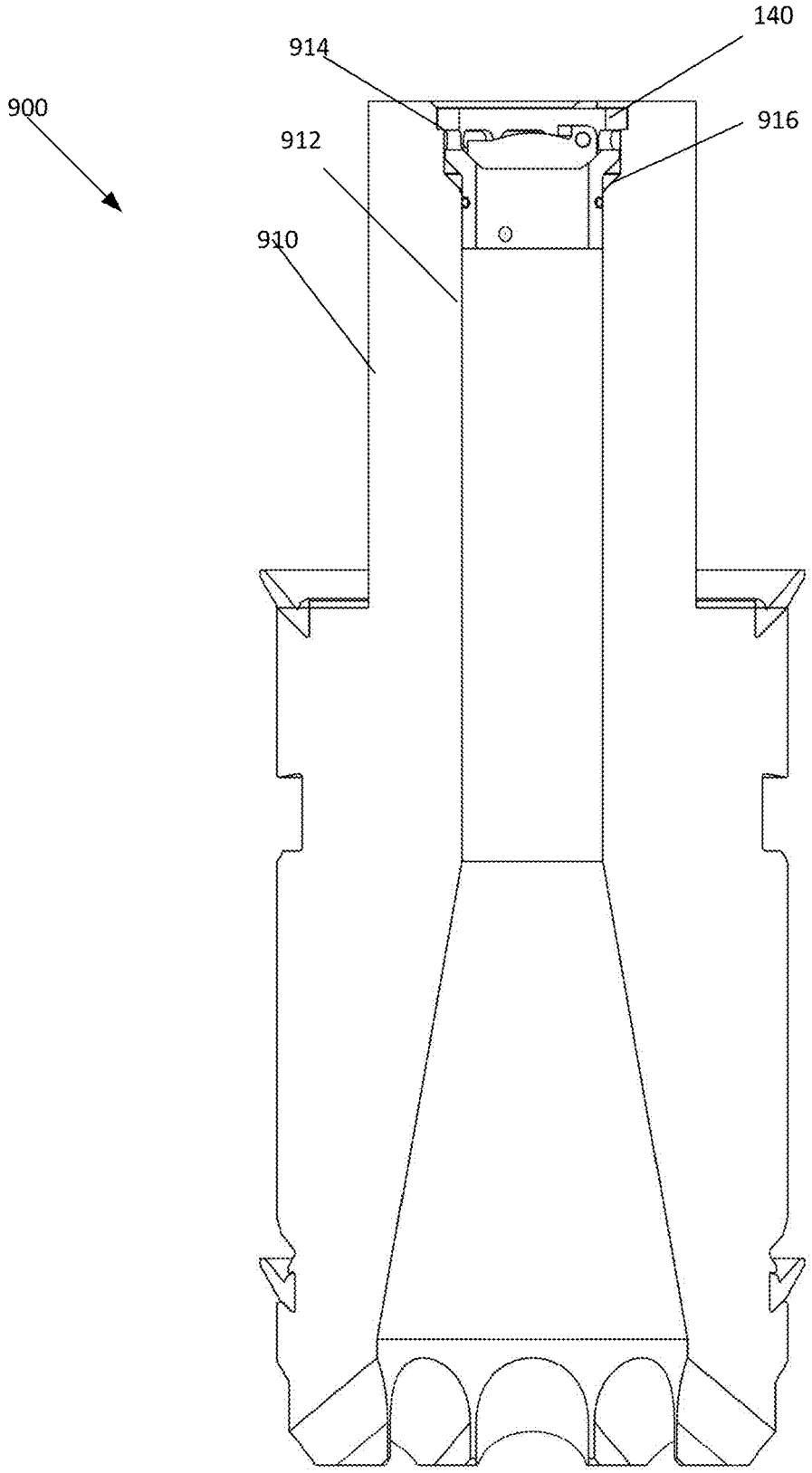
FIGS. 9 and 10 depict a downhole tool, according to an embodiment.
Figure 10:
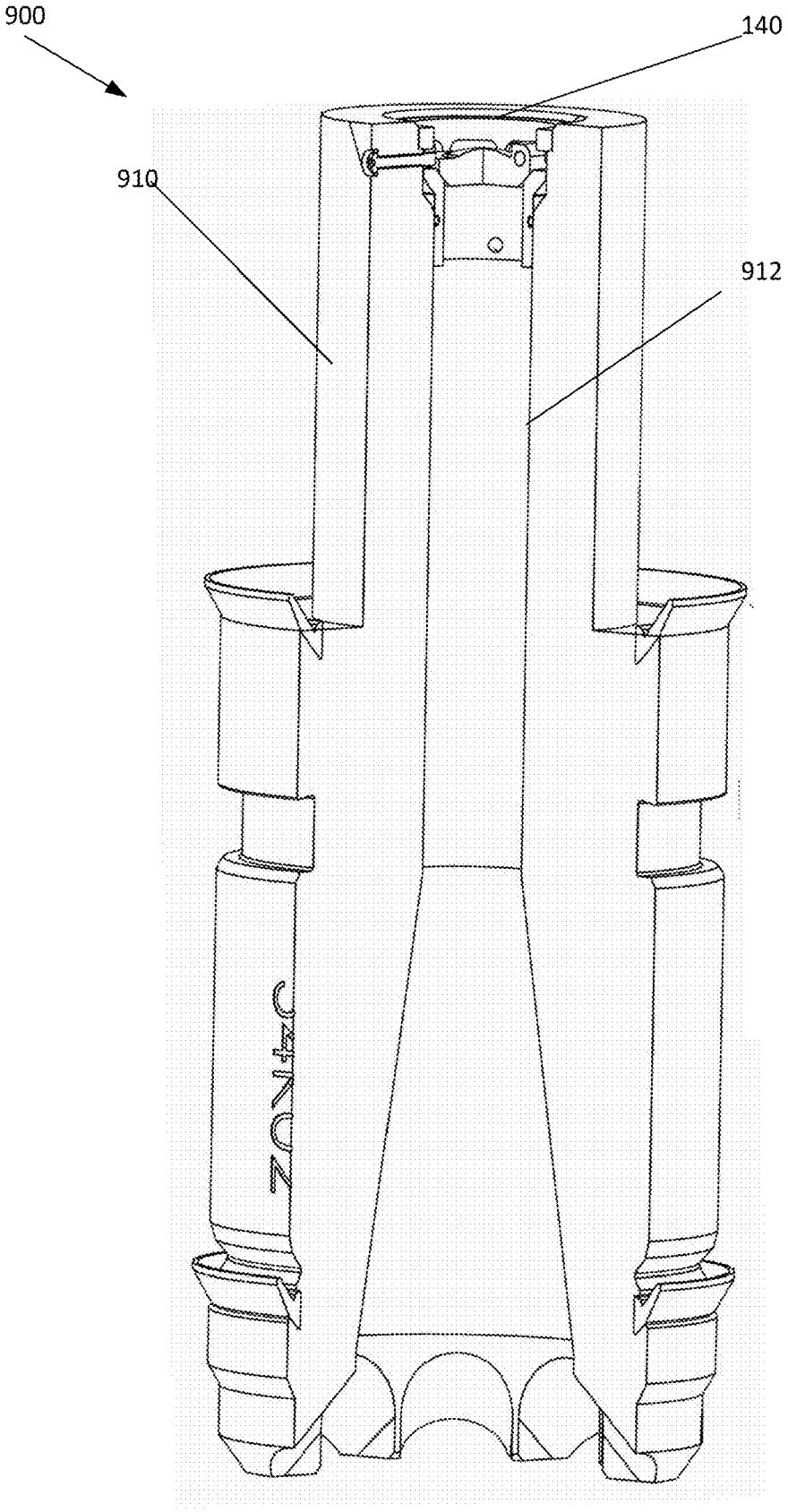

FIGS. 9 and 10 depict a downhole tool 900, according to an embodiment. Elements depicted in FIGS. 9 and 10 may be described above, and for the sake of brevity, a further description of these elements may be omitted.

Downhole tool 900 may be a cartridge, pump down plug, frac plug or any other tool that is configured may be formed of any material including dissolvable material, and may be configured to be positioned downhole. The cartridge may be configured to land on a seat, protrusion, keys, or any other profile within a casing that reduces the inner diameter of the casing, wherein the profile of the inner diameter of the casing may limit the downhole movement of downhole tool 900. In further embodiments, the cartridge may include packers, slips, or other elements that radially expand to limit the downhole movement of downhole tool 900 within the casing. After positioning downhole tool 900 at a desirable location within the well, pressure above the cartridge may increase. The pressure above the cartridge may be able to increase due to object 135 being in the closed position and isolating areas above the cartridge from areas below the cartridge. The increase in pressure may enable testing of the casing to a maximum operating pressure, which may shear housing 130 but still maintain pressure integrity due to object 135 remaining in the closed position even after the shearing of housing 130. In other embodiments, the stem/body may have a hole that throttles flow, hence creating differential pressure that allows the lower portion of the housing 130 to break from the upper portion and slide in the first direction to isolate the hole(s)

After the pressure testing of the casing, fluid may flow in a reverse direction below object 135, or pressure may be bled off above the flapper, which may allow object 135 and the upper portion of housing 130 to be removed from the cartridge. After object 135 is removed from the lower portion of housing 130, pumping may be established through downhole tool 900. In cases when the downhole tool 900 is made out of dissolvable material, the pumping of fluid may accelerate the dissolution due to contaminating fresh fluid.

Similar to insert 120, downhole tool 900 may include ledge 914, sloped sidewall 916, and distal end 912.

Ledge 914 may decrease an inner diameter across downhole tool 900, which may be configured to act as a stopper, no-go, etc. to restrict the movement of an upper portion of housing 130 in a first direction, wherein the first direction may be downhole. Furthermore, ledge 914 may retain upper portion 140 after lower portion 150 is sheared from housing 130.

Sloped sidewall 916 may be configured to gradually decrease the inner diameter of downhole tool 900. Sloped sidewall 916 may be configured to receive lower portion 150 of housing 130 to restrict the movement of lower portion 150 in the first direction after decoupling upper portion 140 and lower portion 150. This may enable object 135 to retain a seal across the cartridge even after shearing lower portion 150 from upper portion 140.

Distal end 912 may be a passageway through downhole tool 900, where fluid may be pumped through after removing object 135 from housing 130. In embodiments, distal end 912 may include ports that radially extend through downhole tool 900. The ports may be positioned below lower portion 150 when lower portion 150 is coupled to upper portion 140, and covered by lower portion 150 when lower portion 150 is decoupled from upper portion 140. The ports may be configured to allow circulation between the area above object 135 and the area below object 135 before the shearing of housing 130.

Figure 11:
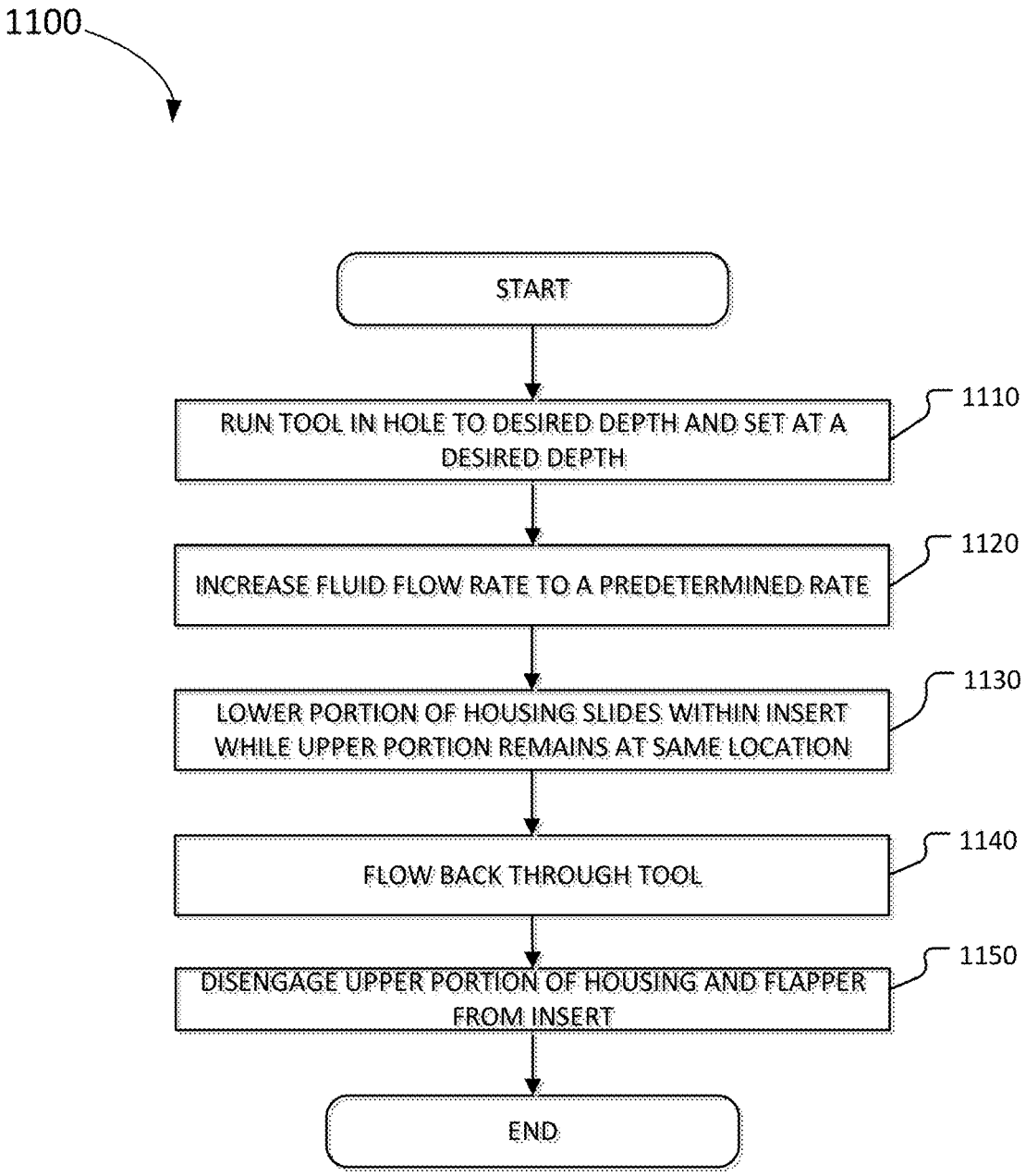
FIG. 11 depicts an operation sequence for shearing a housing with an object, according to an embodiment.

FIG. 11 depicts an operation sequence for shearing a housing with an object, according to an embodiment. The operational sequence presented below is intended to be illustrative. In some embodiments, operational sequence may be accomplished with one or more additional operations not described, and/or without one or more of the operations discussed. Additionally, the order in which the operations of the operational sequence are illustrated in FIG. 11 and described below is not intended to be limiting.

At operation 1110, a downhole tool may be run in hole and set at the desired depth. The downhole tool may be run in hole with a flapper being in a closed position across a shearing housing.

At operation 1120, the fluid flow rate through the hole may be increased to a predetermined value, which may create the required pressure to shear the shearing housing.

At operation 1130, responsive to the fluid flow rate increasing the predetermined value, the lower portion of the shearing housing may slide downhole within the insert and form a seal while the upper portion remains at the same location within the hole.

At operation 1140, fluid may flow or pressure increase in the second direction and interface with the flapper positioned within the insert.

At operation 1150, based on the fluid flowing in the second direction the flapper, the flapper pin, and the upper portion of the housing may flow in the second direction and no longer be engaged or interfaced with the insert. This may allow fluid to flow through the insert and the lower portion of the housing to stay engaged with the insert.

Figure 12:
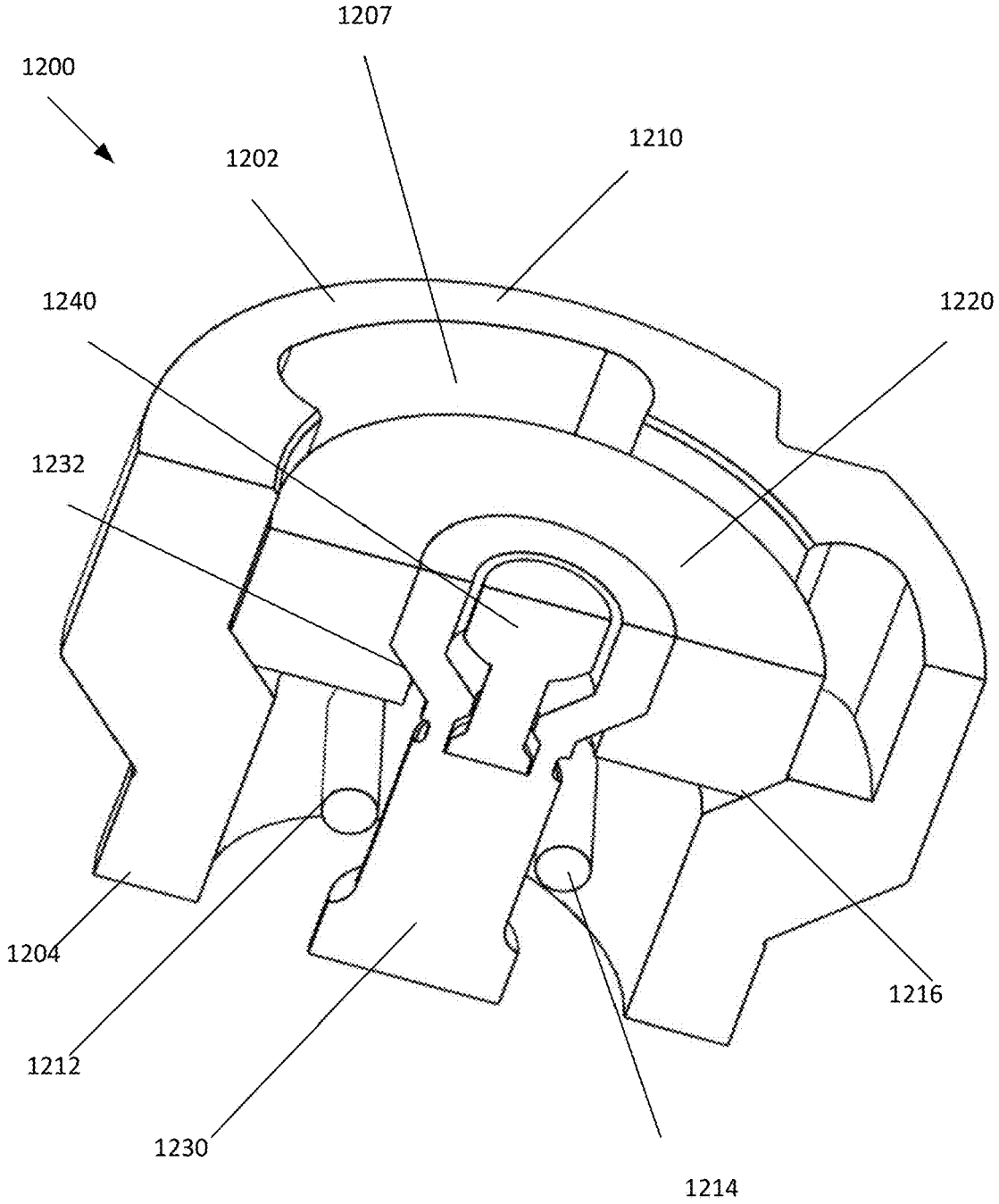
FIG. 12 depicts a downhole tool, according to an embodiment.

FIG. 12 depicts a blocking system 1200 for a downhole tool such as a frac plug, according to an embodiment. Elements depicted in FIG. 12 may be described above, and for the sake of brevity, a further description of these elements may be omitted. Blocking element 1200 may be utilized as a check valve to provide wellbore zonal isolation in multistage stimulation treatments. Blocking element 1200 may be a cartridge that is configured to be run downhole within a mandrel from the surface, be directly attached to the mandrel, or be configured to be pumped downhole after the mandrel is positioned at a desired depth. Blocking element 1200 may include a housing 1210, blocking object 1220, primary plunger 1230, and secondary plunger 1240. In other embodiments, housing 1210 can create a profile that is formed on the inner diameter of a mandrel, downhole tool, or frac plug.

Housing 1210 may be configured to be a cartridge that is run downhole within and along with a mandrel from the surface. Alternatively, housing 1210 may be part of the mandrel, created by a profile within the inner diameter of the mandrel. Housing 1210 may be configured to be positioned on a seat, projection, stopper, etc. within the mandrel, wherein the seat limits the movement of housing 1210 within the mandrel in a first direction. In other embodiments, housing 1210 may be directly coupled to the mandrel via corresponding threads, shear screws, etc. Housing 1210 may include a proximal end 1202, distal end 1204, a pair of stoppers 1212, 1214, and an internal seat 1216.

Proximal end 1202 may be configured to be positioned uphole from distal end 1204. Proximal end 1202 may have a fixed first inner and a fixed first outer circumference. Distal end 1204 may be positioned downhole from proximal end 1202 and have a fixed second inner circumference and a fixed second outer circumference, wherein the fixed second outer circumference may not change in size. In embodiments, the first outer circumference may be larger than the second outer circumference, and the first inner circumference may be larger than the second inner circumference. Proximal end 1202 may include cutouts 1207, indentations, etc. that extend from an uppermost surface proximal end 1202 to seat 1216. Cutouts 1207 may increase the diameter of the first inner circumference, which may enable fluid to flow around blocking object 1220 when blocking object 1220 is not positioned on seat 1216. In other words, when blocking object 1220 is positioned on seat 1216 a downhole end of the cutouts 1207 may be blocked by blocking object 1220. Additionally, when blocking object 1220 is positioned uphole from seat 1216, the downhole end of cutouts 1207 may be positioned below the downhole end of cutouts 1207 and an uphole end of cutouts 1207 may be positioned above the uphole end of cutouts 1207. This may allow fluid to flow around an outer diameter of blocking object 1220.

Seat 1216 may be positioned between proximal end 1202 and distal end 1214. Seat 1216 may be configured to receive blocking object 1220 when forces or pressure are applied to an upper surface of blocking object 1220 in the first direction. Responsive to applying forces against a lower surface of blocking object 1220 in a second direction, blocking object 1220 may be positioned away, and up hole, from seat 1216. When blocking object 1220 is positioned away from seat 1216, a first area above blocking object 1200 may be in communication with a second area below blocking object 1200. Seat 1216 may include a tapered sidewall that is configured to gradually reduce an inner diameter across housing from the first inner circumference to the second inner circumference. This tapering and reduction in diameter may allow blocking object 1220 to flow in a second direction out of housing 1210 out of proximal end 1202 without allowing object 1220 to flow in the first direction through distal end 1204.

Stoppers 1212, 1214 may be projections extending across an inner diameter of housing 1210, and be positioned between seat 1216 and distal end 1204 within housing 1210. Stoppers 1212, 1214 may be configured to interface with primary plunger 1230 to limit the movement of primary plunger 1230, and object 1220, in the second direction. Stoppers 1214, 1214 may be any blocking device, wherein a distance between the two is greater in size than a shaft of plunger 1230 but smaller in size than the distal end plunger 1230. In embodiments, when plunger 1230 moves uphole, stoppers 1214, 1214 may contact or otherwise interface with the second end of plunger 1230 to restrict the uphole movement of plunger 1230. In other embodiments, plunger 1230 and blocking object 1220 may be made of one piece.

Blocking object 1220 may be a device that is configured to selectively block, restrict, etc. the flow of fluid across housing 1210. When blocking object 1220 is positioned on seat 1216, the first area above housing 1210 may be isolated from a second area below housing 1210. Blocking object 1220 may have an outer diameter that is larger than the second inner diameter of distal end 1204, and that is smaller in size than the first inner circumference of proximal end 1202. In embodiments, the outer circumference of blocking object 1220 may be configured to be positioned on seat 1216 when pressure is acting upon a first surface of blocking object 1220 in a first direction is greater than pressure acting upon a second surface of blocking object 1220 in a second direction. Due to blocking object 1220 having a larger diameter than seat 1216, the pressure acting upon blocking object 1220 in the first may not cause blocking object 1220 to move past seat 1216 in the first direction. In embodiments, blocking object 1220 may be a washer within an open internal passageway that creates a through bore. The open internal passageway may be configured to receive and house primary plunger 1230 and secondary plunger 1240.

The through bore or internal passageway may include a plunger seat 1232. Plunger seat 1232 may include a tapered surface that is configured to limit the movement of the plunger 1230 in the first direction. Further, the plunger seat 1232 may have a smaller inner diameter than the outer diameter of the shaft of primary plunger 1230.

Primary plunger 1230 may be configured to be positioned within the open internal passageway of blocking object 1220. Primary plunger 1230 may be restricted from flowing downhole from blocking object 1220 due to the first end of primary plunger 1230 having a larger diameter than the diameter across the through bore in blocking object 1220. Additionally, primary plunger 1230 may be restricted from flowing uphole from blocking object 1220 due to, in part, the second end of primary plunger 1230 having a larger diameter than the diameter across the through bore. In other embodiments, primary plunger 1230 and blocking object 1220 may be a unified object that may be formed of a single element. This may cause primary plunger 1230 and blocking object 1220 to move axially together, whereas primary plunger 1230 and blocking object 1220 may be a unified piece before and after the shaft of primary plunger 1230 is broken or sheared. Primary plunger 1230 may include a first end, cavity, shaft, and second end. A first end of primary plunger 1230 may be directly affixed to blocking object 1220. To this end, when primary plunger 1230 moves in the first direction or the second direction, blocking object 1220 may correspondingly move. In embodiments, primary plunger 1230 may move along with blocking object 1220 until the second end of primary plunger 1230 is decoupled from the first end of primary plunger 1230.

The cavity within primary plunger 1230 may be an opening within the first end of primary plunger 1230 that extends internally within primary plunger 1230 to the shaft. The cavity may have an open upper surface and a closed lower surface. The cavity may be configured to receive secondary plunger 1240. The cavity may be shaped and sized to allow the secondary plunger 1240 to apply forces against the primary plunger 1230 to shear the shaft of primary plunger 1230. Specifically, the cavity may include an upper portion, tapered sidewalls, and lower portions. The tapered surface is configured to reduce the diameter between the upper portion and the lower portion of the cavity, such that the lower portion of the cavity has a smaller diameter than the upper portion of the cavity. This geometry may allow a bulbous portion of the secondary plunger 1240 to be positioned within the upper portion of the cavity, and a foot of the secondary plunger 1240 to be positioned within the lower portion of the cavity while allowing a shaft of secondary plunger 1240 to slide within an opening between the tapered sidewalls.

The shaft of primary plunger 1230 may be configured to extend from the cavity to the second end of primary plunger 1230. The shaft may have a smaller outer diameter than the first end of primary plunger 1230 and the second end of primary plunger 1230. The outer diameter of the shaft may also be narrower than the distance between the pair of stoppers 1212, 1214. However, the lower outer diameter primary plunger 1230 may have a bigger outside diameter to limit the shaft from moving in the second direction. This may allow the shaft to slide between the pair of stoppers 1212, 1214 when the shaft is coupled to the upper portion of primary plunger 1230. Furthermore, when the shaft of primary plunger 1230 is decoupled from the upper portion of the primary plunger 1230, the shaft of primary plunger 1230 may slide in the first direction between the pair of stoppers 1212, 1214 while blocking object 1220 remains on seat 1216.

Along the outer diameter of the shaft may be indentations that reduce the thickness of the shaft. In embodiments, the indentations may be any type of weak points within the shaft that creates a point along the longitudinal axis of the shaft where the shaft is more brittle. The indentations and the lower portion of the cavity may be aligned along a longitudinal axis of housing 1210. This may create a minimal diameter across the shaft at portions of the shaft that are aligned with the indentations and the lower portion of the cavity, wherein the shaft may shear, break, or otherwise be decoupled from the second end of primary plunger 1230 along the weak points or minimal diameter across the shaft.

The second end of the primary plunger 1230 may be located on a distal end of the shaft, wherein the second end of the primary plunger 1230 is positioned downhole from the pair of stoppers 1212, 1214. A diameter across the second end of primary plunger 1230 may be larger/wider than the distance between the pair of stoppers 1214, 1214. This geometry may limit the movement of primary plunger 1230 in the second direction when the shaft of primary plunger 1230 is coupled to the first end of primary plunger 1230. In other embodiments, the second end of primary plunger 1230 may have the same outer diameter as the shaft of primary plunger 1230, and the second end of primary plunger 1230 or the shaft or primary plunger 1230 may be coupled to the pair of stoppers 1212, 1214 via set screws, shear pins, etc.

Secondary plunger 1240 may be a piston that is configured to exert a force against primary plunger 1230 to shear or break the shaft of primary plunger 1230. Additionally, secondary plunger 1240 may be configured to form a seal across the lateral axis of the cavity within primary plunger 1230 before and after the shaft of primary plunger 1230 shears or breaks. This seal may be maintained until fluid flows against the surface of secondary plunger 1240 in an opposite direction as the force against primary plunger 1230 to shear or break the shaft or primary plunger 1230. Secondary plunger 1240 may include a bulbous first end, shaft, and foot.

The bulbous first end and foot of secondary plunger 1240 may have a larger outer diameter than that of the shaft. Due to the bulbous first end being larger than the shaft of secondary plunger 1240, secondary plunger 1240 may be configured to move along a longitudinal axis of housing 1210 relative to first plunger 1230 in a controlled manner. Specifically, secondary plunger 1240 may move in the first direction until the bulbous first end is positioned on the seat within the cavity of primary plunger 1230.

An outer diameter of the shaft may be shorter than the distance between the lower end of the tapered sidewalls of the cavity within primary plunger 1230. This may allow the shaft of secondary plunger 1240 to slide within the cavity of primary plunger 1230 in the first direction or the second direction.

The foot may have a larger diameter than that of a distance across the tapered sidewalls or seat within the cavity within primary plunger 1230 to limit the movement of the secondary plunger 1240 in the second direction. This may also permanently couple the first plunger 1230 and the secondary plunger 1240 while allowing the secondary plunger 1240 to move along a longitudinal axis of the housing 1210 before and after the shaft of the primary plunger 1230 is sheared. The movement of the bulbous portion in the first direction may allow the bulbous first end to create a piston force on the shaft of primary plunger 1230. Specifically, the bulbous first end of secondary plunger 1240 may be configured to move in the first direction until it is seated on the tapered sidewalls or seat within the cavity of primary plunger 1230. This downward movement of the first end of secondary plunger 1240 may cause the foot of secondary plunger 1240 to create a piston force against the shaft of primary plunger 1230 to activate, shear, or break the shaft of primary plunger 1230. In embodiments, the shaft may be sheared or broken in a location longitudinally between the pair of stoppers 1212, 1214 and a lower surface of object 1220. Once the shaft of primary plunger 1230 is broken, the second end of primary plunger 1230 may no longer restrict the uphole movement of primary plunger 1230, secondary plunger 1240, and object 1220.

Figure 15:
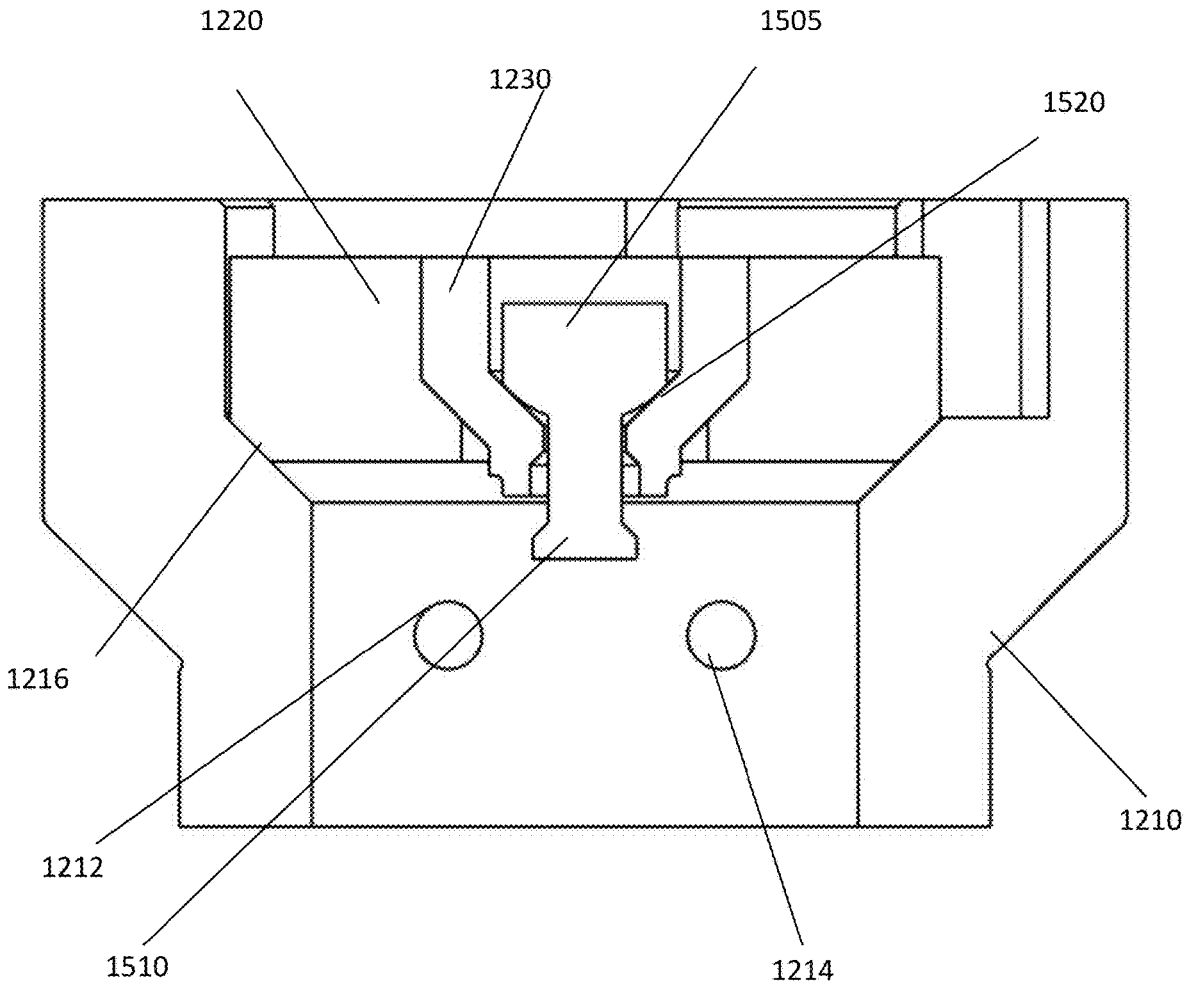
FIG. 15 depicts a downhole tool, according to an embodiment.

In embodiments, the foot of secondary plunger 1240 may not be exposed to an area within a passageway below housing 1210 before the shaft is sheared or broken due to the closed lower surface of the cavity of primary plunger 1230. However, after the shaft is sheared or broken, the foot of secondary plunger 1240 may be exposed to the area within the passageway below housing 1210 due to the now open lower surface of the cavity of primary plunger 1230, as depicted in FIG. 15.

In other embodiments, the foot of secondary plunger 1240 may have the same diameter as that of the shaft, and the foot of secondary plunger 1240 or shaft of secondary plunger 1240 may be directly coupled to primary plunger 1230 via set screws, shear pins, etc. While the shear pins, set screws, etc. are intact, secondary plunger 1240 may not be able to move relative to primary plunger 1240. After the shear pins, set screws, etc. are activated due to forces being applied to an upper surface of secondary plunger 1240 in the first direction. In specific embodiments, the set screws coupling secondary plunger 1240 to primary plunger 1230 may be positioned at a location along the shaft of secondary plunger 1240 that positions the bulbous portion of the secondary plunger 1240 away from the seat within primary plunger 1230. To this end, once the shear pins, set screws, etc. are broken, activated, etc., the secondary plunger 1240 can move in the first direction until the bulbous portion of secondary plunger 1240 is positioned on the seat within the cavity. Furthermore, once the shear pins, set screws, etc. are broken, due to the foot of secondary plunger 1240 being equal in size to that of the shaft, secondary plunger 1240 may freely slide out of the cavity in the second direction.

Figure 13:
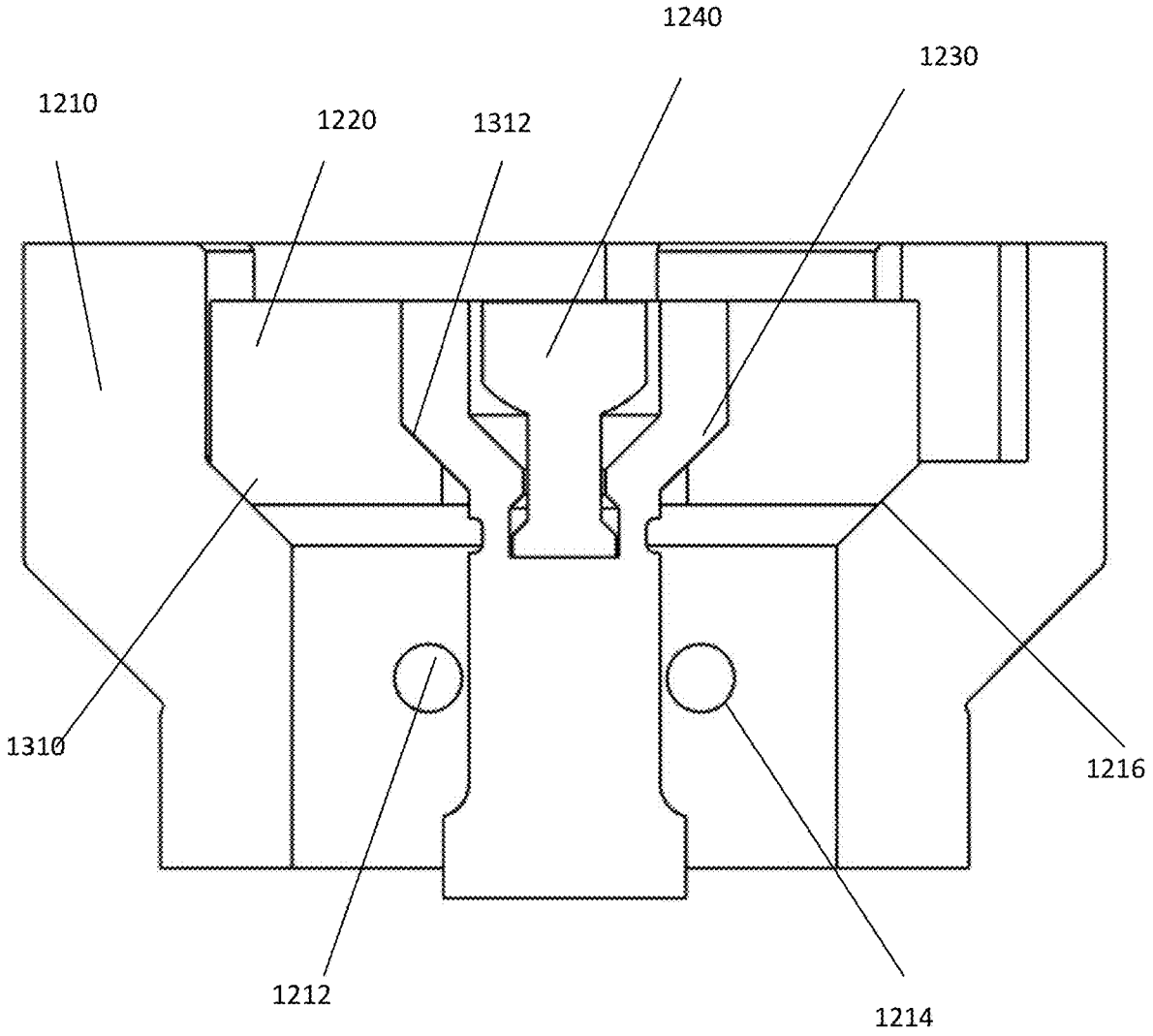
FIG. 13 depicts a downhole tool, according to an embodiment.

FIG. 13 depicts a cross-section view of blocking system 1200 for a downhole tool, according to an embodiment. Elements depicted in FIG. 13 may be described above, and for the sake of brevity, a further description of these elements may be omitted.

As depicted in FIG. 13, when housing 1210 is run in a hole blocking object 1220 may be positioned on seat 1216 of housing 1210. When blocking object 1220 is positioned on seat 1216, fluid flowing in a first direction, a downhole direction, may not be communicated between an area above blocking object 1220 to an area below blocking object 1220. Specifically, an outer diameter 1310 of blocking object 1220 may be positioned against or on the inner diameter of housing 1210, and an outer diameter of primary plunger 1230 may be positioned against or on plunger seat 1312. This may cause a seal or other restriction across a lateral axis of housing 1210. In embodiments, this seal or restriction may be formed by blocking object 1220 and primary plunger 1230.

Figure 14:
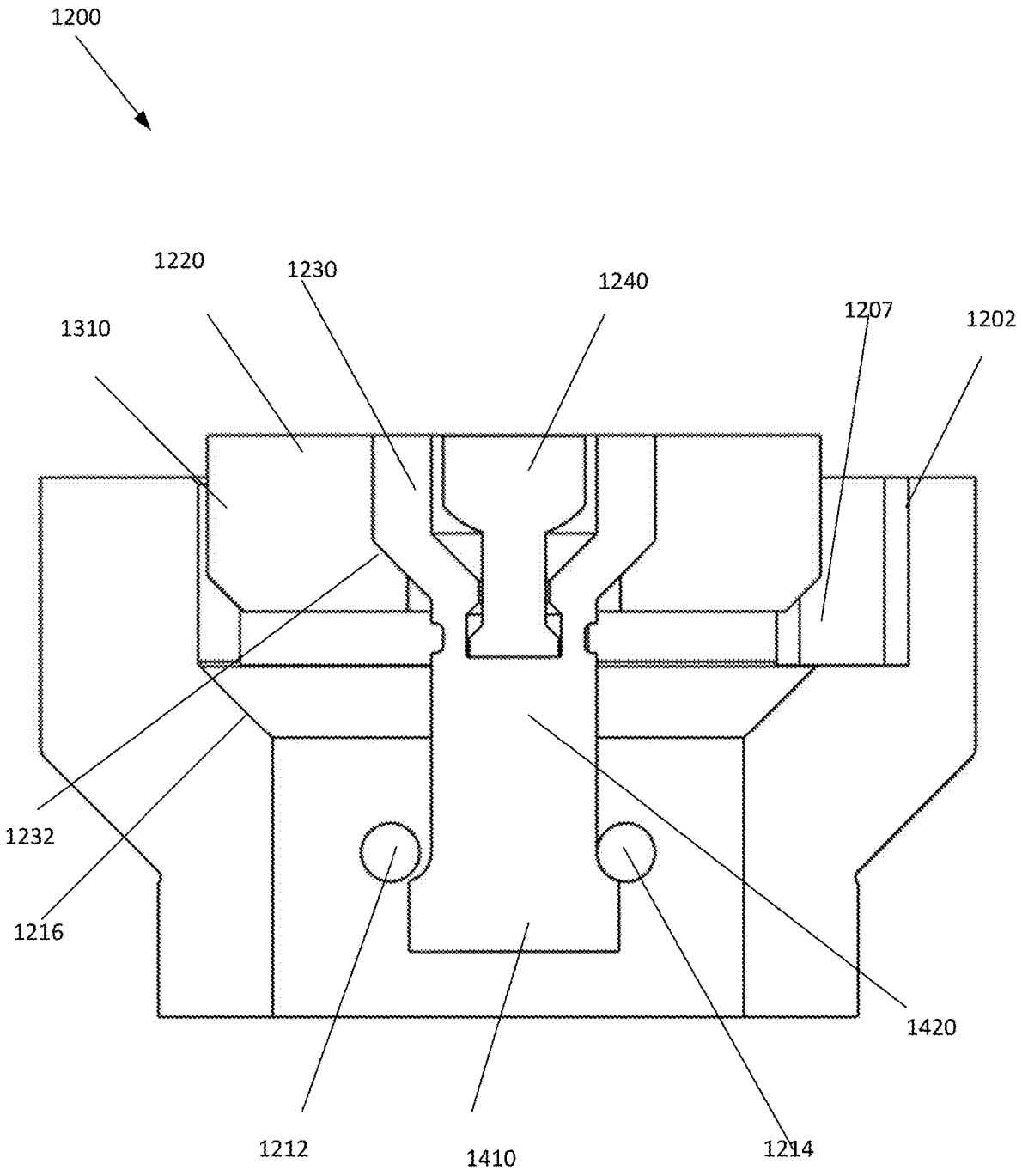
FIG. 14 depicts a downhole tool, according to an embodiment.

FIG. 14 depicts a cross-section view of blocking system 1200 for a downhole tool, according to an embodiment. Elements depicted in FIG. 14 may be described above, and for the sake of brevity, a further description of these elements may be omitted.

When fluid is flowed against a lower surface of blocking element 1220 or primary plunger 1230 in a second direction, blocking object 1220 and primary plunger 1230 may move together in a controlled manner in the second direction while remaining coupled with housing 1210. This may create an annulus between the inner diameter of proximal end 1202 of housing 1210 and the outer circumference 1310 of blocking object 1220.

Furthermore, when primary plunger 1230 is intact and there is a flow of fluid against the lower surface of blocking object 1220, blocking object 1220 may move in the second direction until an upper surface of second end 1410 of primary plunger 1230 contacts the pair of stoppers 1212, 1214. This may allow blocking element 1220, primary plunger 1230, and secondary plunger 1240 to move uphole together, while all are coupled together, while still limiting the relative movement when of blocking element 1220, primary plunger 1230, and secondary plunger 1240 when they are coupled, allowing communication across housing 1210 through cutouts 1207. This may allow blocking object 1220, primary plunger 1230, and secondary plunger 1240 to form a resettable plug, where the plug can be reset by flowing fluid uphole to allow reverse fluid communication, flowing fluid downhole to move blocking object 1220, primary plunger 1230, and secondary plunger 1240, and once again flowing fluid uphole. This process may be repeated until secondary plunger 1240 applies a piston force against primary plunger 1230 to break primary plunger 1230.

FIG. 15 depicts a cross-sectional view of blocking system 1200 for a downhole tool, according to an embodiment. Elements depicted in FIG. 15 may be described above, and for the sake of brevity, a further description of these elements may be omitted.

In FIG. 15, when a force is created against an upper surface of blocking object 1220 in the first direction, blocking object 1220 may slide in the first direction to be seated on tapered sidewall 1216. The force in the first direction may also cause primary plunger 1230 and secondary plunger 1240 to move in the first direction. When blocking object 1220 is positioned on seat 1216, bulbous portion 1505 of secondary plunger 1240 may act as a piston and translate the forces in the first direction to foot 1510. Foot 1510 may create sufficient force to shear the shaft of the primary plunger 1230.

After shaft 1410 of primary plunger 1230 is sheared or broken, the cavity within primary plunger 1230 may have an open upper surface and an open bottom surface. Additionally, after shaft 1410 or primary plunger 1230 is sheared or broken, blocking object 1220, primary plunger 1230, and secondary plunger 1240 may form a seal across the lateral axis of housing 1210. This seal may not allow fluid to flow in a first direction across blocking object 1220, primary plunger 1230, and secondary plunger 1240. Specifically, secondary plunger 1240 may form a seal across the lateral axis of the cavity within primary plunger 1230, primary plunger 1230 may form a seal across the lateral axis of the through bore of blocking object 1220, and blocking object 1220 may form a seal across the lateral axis of the housing 1210 from the through bore to the inner diameter of housing 1210.

After shearing shaft 1420 and second end 1410, flowing fluid in a second direction may cause blocking object 1220, primary plunger 1230, and secondary plunger 1240 to move in the second direction. This movement may not be restricted, allowing the removal of the seal across the lateral axis of housing by moving blocking object 1220, primary plunger 1230, and secondary plunger 1240 in the second direction to no longer be positioned within housing 1210. This may be due to second end 1410 of primary plunger 1230 no longer being present to contact the pair of stoppers 1212, 1214, which previously restricted the movement of blocking object 1220, primary plunger 1230, and secondary plunger 1240 in the second direction.

Accordingly, the reverse flow of fluid through housing 1210 may permanently release the seal caused by blocking object 1220, primary plunger 1230, and secondary plunger 1240 across housing 1210. Furthermore, the flow of fluid in the second direction may cause blocking object 1220, primary plunger 1230, and secondary plunger 1240 to flow uphole while housing 1210 remains fixed in place. This movement and decoupling of object 1220, primary plunger 1230, and secondary plunger 1240 may remove the ability of these elements to later form a seal across housing 1210 even if there is subsequent flow of fluid in the first direction.

Alternative embodiments may not include a secondary plunger 1230. In these embodiments, shaft 1420 may be configured to be decoupled from primary plunger 1230 via fluid forces impacting the cavity within the primary plunger 1230. Responsive to flowing fluid in a first direction within the cavity, shaft 1420 may be decoupled from upper portion of primary plunger 1230 and flow downhole in the first direction. This may create a permanent opening through the blocking object 1220, allowing a bi-directional flow of fluid through blocking object 1220.

Figure 16:
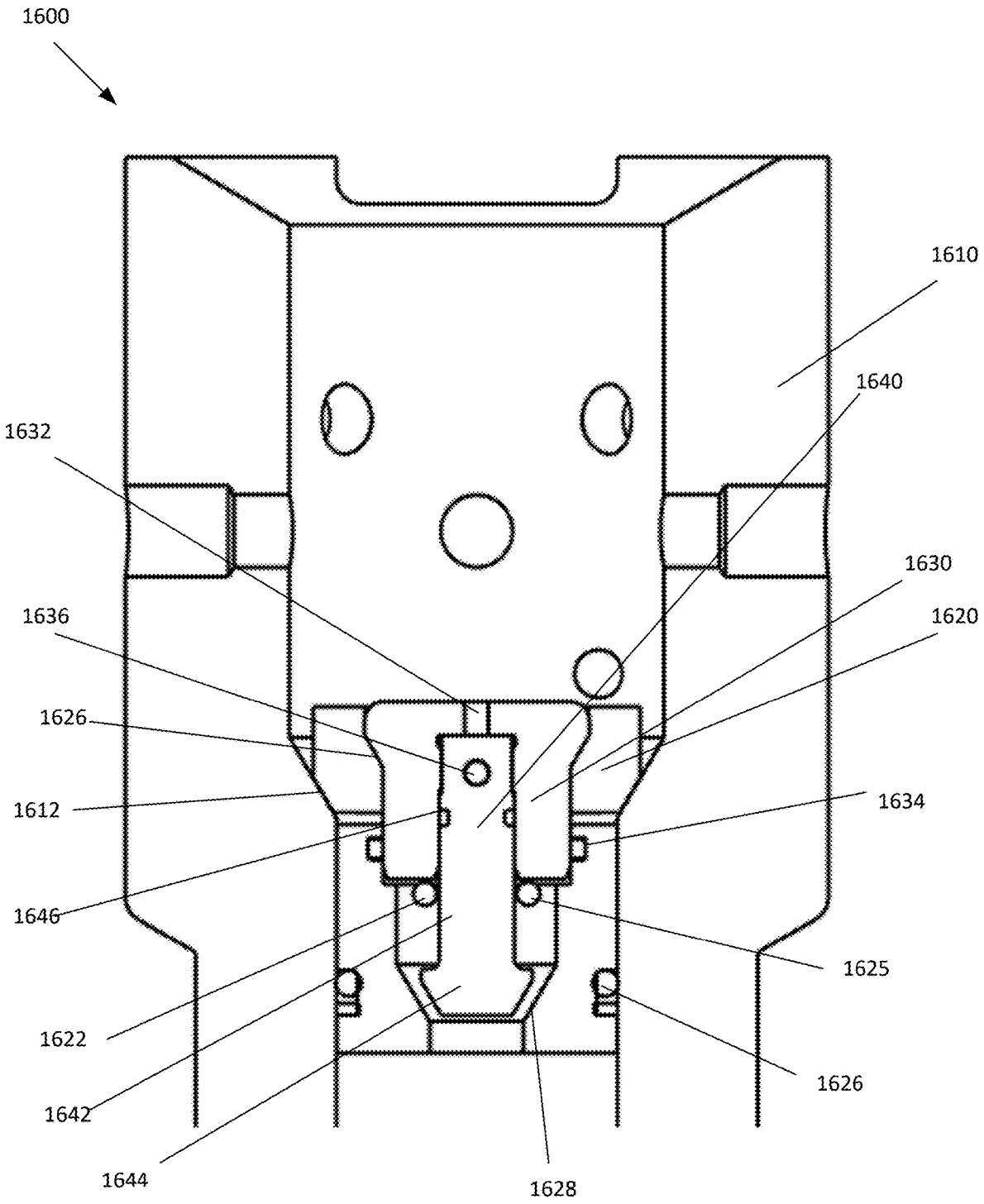
FIG. 16 depicts a downhole tool, according to an embodiment.

FIG. 16 depicts a cross-section view of a blocking system for a downhole tool 1600, according to an embodiment. Elements depicted in FIG. 16 may be described above, and for the sake of brevity, a further description of these elements may be omitted. The blocking system may be utilized to form a resettable plug in a first mode of operation, wherein reverse fluid flow reestablished communication across the blocking system. However, in a second mode of operation, the blocking system may no longer be able to form a seal. In other words, in the first mode of operation, the blocking system utilizing plug 1630 may be a resettable check valve. However, in the second mode of operation, the blocking system utilizing plug 1630 may not be resettable. The blocking system may include a mandrel 1610, housing 1620, plug 1630, and plunger 1640.

Mandrel 1610 may be a hollow shaft, cylindrical rod, cartridge, etc. that is configured to form a body or the whole tool of a downhole tool 1600, such as a frac plug, sliding sleeve, or cartridge. Mandrel 1610 may include a profile 1612 that reduces the inner diameter of mandrel 1610 and limits the movement of housing 1620 in the first direction. Profile 1612 may be a ledge that is perpendicular to a central axis of the downhole tool 1600 or may be a tapered sidewall that gradually and incrementally decreases the inner diameter of the mandrel 1610. In other embodiments, profile 1612 may not be a ledge, but may be any device, mechanism, etc. that is configured to axially secure housing 1620 to the inner diameter of mandrel 1610 to limit the axial movement of housing 1620 relative to mandrel 1610. For example, profile 1612 may be threads, glue, shear pins, etc. on the inner diameter of mandrel 1610 that are configured to be coupled with corresponding elements an outer diameter of housing 1620.

Housing 1620 may be a plug, cartridge, casing, container, etc. that is configured to selectively secure the plug 1630 and plunger 1640 within the housing 1620. Housing 1620 may be a separate element from mandrel 1610, and be mounted on, positioned on, coupled with, etc. an inner diameter of the mandrel 1610, such that housing 1620 along with plug 1630 and plunger 1640 are moved in the first direction within mandrel 1610. However, in other embodiments, housing 1620 may be an integral part of mandrel 1610. A seal 1625 may be configured to restrict communication between the outer diameter of housing 1620 and the inner diameter of mandrel 1610. Alternatively, housing 1620 may be configured to be pumped in the first direction along with plug 1630 and plunger 1640 after mandrel 1610 is positioned downhole. When pumped in the first direction, the housing 1620 may be configured to land on the profile 1612 on the inner diameter of the housing 1620. Housing 1620 may include a passageway that extends from an upper surface of housing 1620 to a lower surface of housing 1620, wherein communication across the passageway is configured to be selectively restricted via the plug and the plunger. In embodiments, the housing may include a first seat 1626, second seat 1628, and a pair of stoppers 1622, 1624.

First seat 1626 may be a ledge, shelf, sloped sidewall, etc. positioned on a proximal end of housing 1620 configured to gradually decrease the inner diameter of the housing 1620. The first seat 1626 may be configured to receive a proximal end of plug 1630 to limit the downward movement of plug 1630.

Second seat 1628 may be a ledge, shelf, sloped sidewall, etc. positioned on a distal end of the housing 1620 configured to gradually decrease the inner diameter of the housing 1620. Second seat 1628 may be configured to receive a distal end of the plug 1630 to limit the downward movement of the plunger 1640. In embodiments, the plunger 1640 may be configured to selectively form a seal, restrict communication, etc. across the second seat 1628 after plunger 1640 is disengaged from plug 1630.

The pair of stoppers 1622, 1624 may be located on an inner diameter of a distal end of housing 1620, and project across the inner diameter of the distal end of housing 1620. The pair of stoppers 1622, 1624 may be configured to be aligned with a shaft, body, etc. of the plunger 1640, and positioned above a distal end of the plunger 1640. A distance between the pair of stoppers 1622, 1624 may be longer than the diameter across the shaft, body, etc. of the plunger 1640 and shorter than the diameter across the distal end of the plunger 1640. This may allow the shaft, body, etc. of the plunger 1640 to slide between the pair of stoppers 1622, 1624, while restricting the upward movement of the distal end of the plunger 1640.

Plug 1630 may be an object, disk, etc. that is configured to selectively form a seal or restrict communication across an inner diameter of the housing 1620 via seal 1634, wherein the proximal end of plug 1630 may have a larger outer diameter than a distal end of plug 1630. When housing 1620 is run in a hole, plug 1630 may be configured to be positioned across the first seat 1626 of housing 1620. When plug 1630 is positioned across a first seat 1626, fluid flowing in a first, downhole, direction may not be communicated between a first area above plug 1630 to a second area below plug 1630. Specifically, a proximal end of plug 1630 may be selectively positioned against or on an inner diameter of the housing to restrict communication through the passageway through housing 1620. For example, when fluid is flowing in the first direction, the corresponding forces may move plug 1630 to be positioned across the passageway of housing 1620, wherein the movement of plug 1630 in the first direction may be restricted by the first seat 1626. Responsive to flowing fluid in the second direction, plug 1630 may move in a second, uphole, direction, away from the first seat 126, wherein the uphole movement of plug 1630 may be restricted by plunger 1640. In embodiments, plug 1630 may include a conduit 1632 and slot. The conduit 1632 may be a passageway extending from an upper surface of plug 1630 to the slot, and the conduit 1632 be configured to allow pressure to be applied against a proximal end of the plunger 1640. To this end, conduit 1632 may expose plunger 1640 to forces above plug 1630. The slot may extend from the conduit to a distal end of plug 1630, wherein the slot is configured to receive a proximal end of plunger 1640.

In embodiments, plug 1630 may be selectively coupled to plunger 1640 via a temporary coupling mechanism 1636, such as a shear screw, pin, glue, adhesives, collet, weak points, wires, breakable threads, etc. Temporary coupling mechanism 1636 may have a first end configured to be inserted into a first opening in the inner diameter of the plunger 1640, and a second end configured to be inserted into a second opening in the inner diameter of the housing 1620. When temporary coupling mechanism 1636 is intact, plug 1630 and plunger 1640 may be locked together, such that plunger 1640 and plug 1630 axially move together. This may enable the plug 1630 to be positioned across the first seat 1626, move away from the first seat 1626, and be repositioned on the first seat 1626. Responsive to activating, breaking, etc. temporary coupling mechanism 1636, the axial movement of the plug 1630 may be independent of the axial movement of the plunger 1640. In embodiments, temporary coupling mechanism 1636 may be activated based on applying a pressure differential across temporary coupling mechanism 1636 that is greater than a pressure threshold, which may cause temporary coupling mechanism 1636 to shear, break, etc. to separate the first end of temporary coupling mechanism 1636 from the second end of the temporary coupling mechanism 1636.

Plunger 1640 may be a device that is configured to selectively retain plug 1630 in place before the temporary coupling mechanism 1636 is activated, and plunger 1640 may be configured to allow the relative movement of plug 1630 in the second direction after temporary coupling mechanism 1636 is activated. Plunger 1640 may include a shaft 1642, distal end 1644, and seal 1646.

Shaft 1642 may be configured to be inserted into the slot of the plug 1630, and temporarily coupled to the 1630 via the temporary coupling mechanism 1636. When shaft 1642 and plug 1630 are coupled together, the axial movement of the plug 1630 may be dependent on the axial movement of the plunger 1640. After the activation of the temporary coupling mechanism 1636, plug 1630 may independently move in the second direction, and the plunger 1640 may independently move in the first direction. Shaft 1642 may be configured to extend from the cavity to the distal end 1644 of plunger 1640. Shaft 1642 may have a smaller outer diameter than the outer diameter of the distal end of plunger 1640. In embodiments, a distance across the outer diameter of shaft 1642 may be smaller than the distance between the pair of stoppers 1622, 1624. This may allow the shaft to slide axially between the pair of stoppers 1622, 1624. In other embodiments, shaft 1642 may be replaced by any other coupling mechanism.

The distal end 1644 of the plunger 1640 may be located downhole from the pair of stoppers 1622, 1624, wherein a distance across an outer diameter of the distal end 1644 may be larger than a distance between the pair of stoppers 1622, 1624. This relative geometry may limit the movement of plug 1630 and plunger 1640 in the second direction. Specifically, when there is a reverse flow of fluid, the plunger 1640 and the plug 1630 may move in the second direction until an upper surface of distal end 1644 contacts the pair of stoppers 1622, 1624. This may allow for a repeatable movement of the plug 1630 and the plunger 1640 in the second direction. Distal end 1644 may also be configured to be positioned on the second seat 1628 across housing 1620 to restrict communication through housing 1620 to form a second, resettable check valve after plug 1630 is decoupled from the blocking system. In specific embodiments, distal end 1644 may be positioned across the second seat 1628 only after activating the temporary coupling mechanisms 1636 and flowing fluid in the first direction, which may cause the plunger 1640 to move in the first direction while the plug 1630 remains on the first seat 1626. Furthermore, after activating housing 1620 and having fluid flow in the second direction, the plug 1630 may move in the second direction away from the outside of housing 1620 to no longer be able to sit across housing 1620 while the plunger 1640 remains within housing 1620 due to distal end 1644 being larger than the distance between the pair of stoppers 1622, 1624. This allows fluid flow in a first direction to repeatedly position distal end 1644 across the second seat 1624 while plug 1630 is permanently disengaged from the housing 1620 and plunger 1640.

Seal 1646 may be configured to restrict fluid communication through the outer diameter of plunger 1640 and an inner diameter of plug 1640 when seal 1646 is radially positioned between the two.

Figure 17:
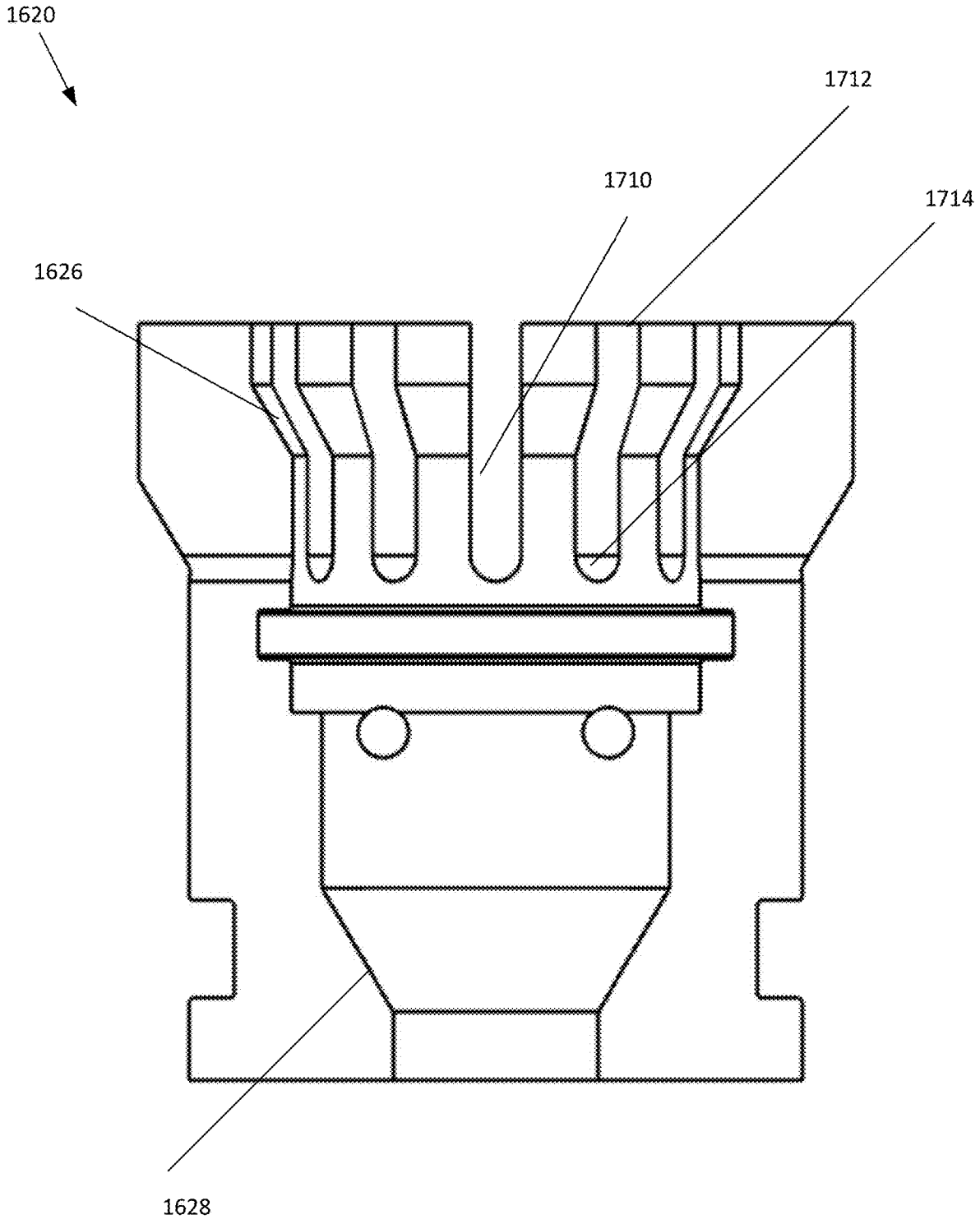
FIG. 17 depicts a downhole tool, according to an embodiment.

FIG. 17 depicts a cross-sectional view of housing 1620, according to an embodiment. Elements depicted in FIG. 17 may be described above, and for the sake of brevity, a further description of these elements may be omitted.

As depicted in FIG. 17, housing 1620 may include a plurality of communication channels 1620. communication channels 1710 may be configured to allow communication around the plug when the distal end of the plug is positioned away from the first seat 1626, and communication channels 1710 may be blocked by an outer diameter of the plug when the plug is positioned downward on the first seat 1626. Specifically, communication channels 1710 may include an upper-end 1712 and a lower-end 1714. When the plug is shifted downward due to fluid flowing in a first direction, which may be a downhole direction, the plug may be positioned on or below the lower ends 1714 of the communication channels 1710, which may block or restrict communication through the lower end 1714 of the communication channels 1710. However, due to flow back below the plug, the plug may be positioned away from or above the lower ends 1714 of communication channels 1710, which may allow the reverse flow of fluid into the lower ends 1714 of communication channels 1710, around the outer diameter of the plug, and up hole out of the upper ends 1712 of the communication channels 1710. Furthermore, in embodiments, an inner diameter associated with the upper ends 1712 of communication channels 1710 may be larger than an inner diameter associated with the lower ends 1714 of communication channels.

Figure 18:
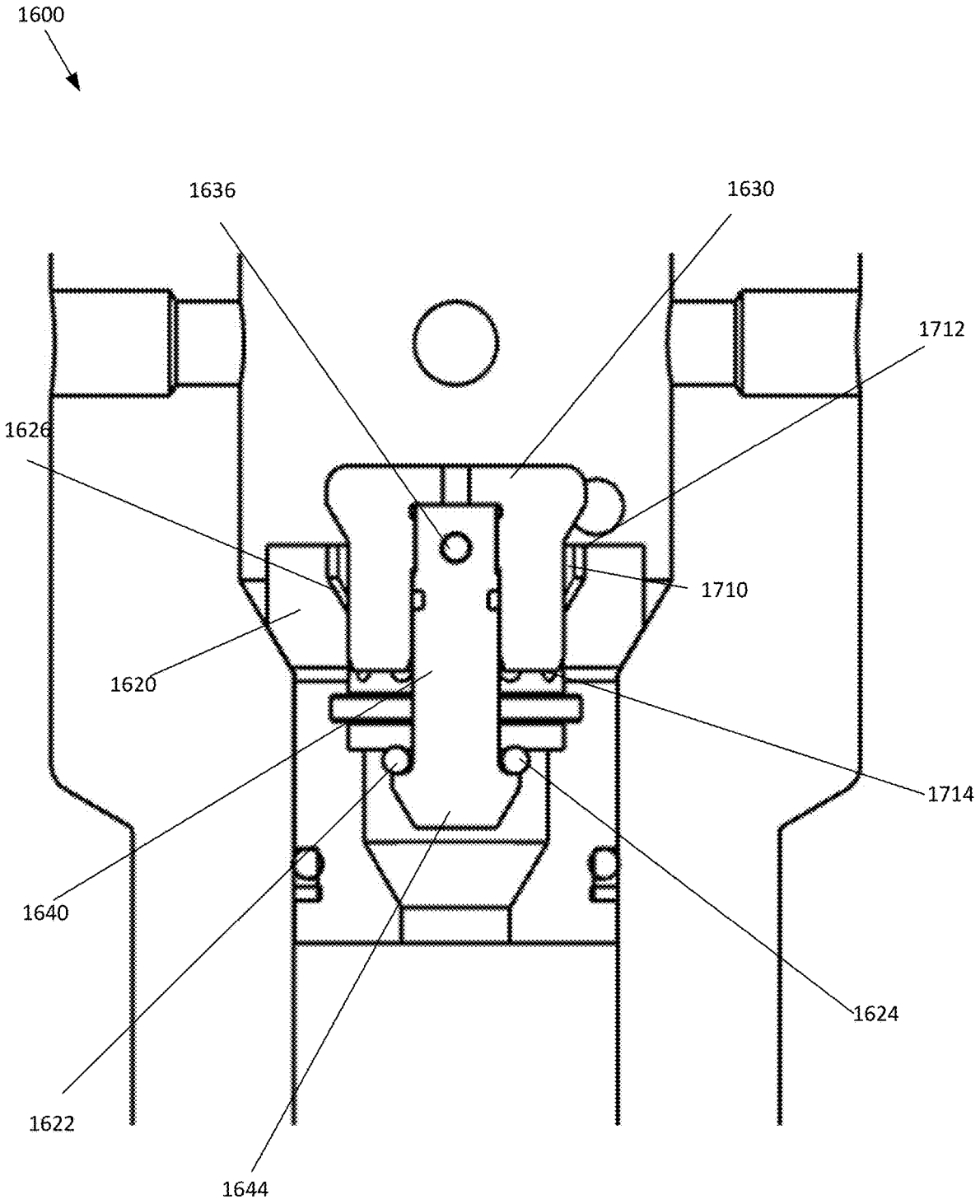
FIG. 18 depicts a downhole tool, according to an embodiment.

FIG. 18 depicts a cross-section view of the blocking system for a downhole tool, according to an embodiment. Elements depicted in FIG. 18 may be described above, and for the sake of brevity, a further description of these elements may be omitted.

As depicted in FIG. 18, due to reverse fluid flow below plunger 1640, plunger 1640 and plug 1630 may move in a second direction. Specifically, fluid flowing in a second direction from an area below plunger 1640 may interact with plunger 1640 and plug 1630 to move plug 1630 and plunger 1640 in the second direction until distal end 1644 of plunger 1640 interacts with pair of stoppers 1622, 1624. The movement of plug 1630 and plunger 1640 in the second direction may cause a lower end of plug 1630 to be positioned above lower ends 1714 of communication channels 1710, allowing fluid to flow around plug 1630 through communication channels 1710 and out of upper ends 1712.

However, this simultaneous movement of plug 1630 and plunger 1640 in the second direction may not cause plug 1630 and plunger 1640 to become disengaged from each other After flowing fluid in a first direction, plug 1630 and plunger 1640 may revert to their original position as depicted in FIG. 16, wherein a seal across housing 1620 is formed once again.

Figure 19:
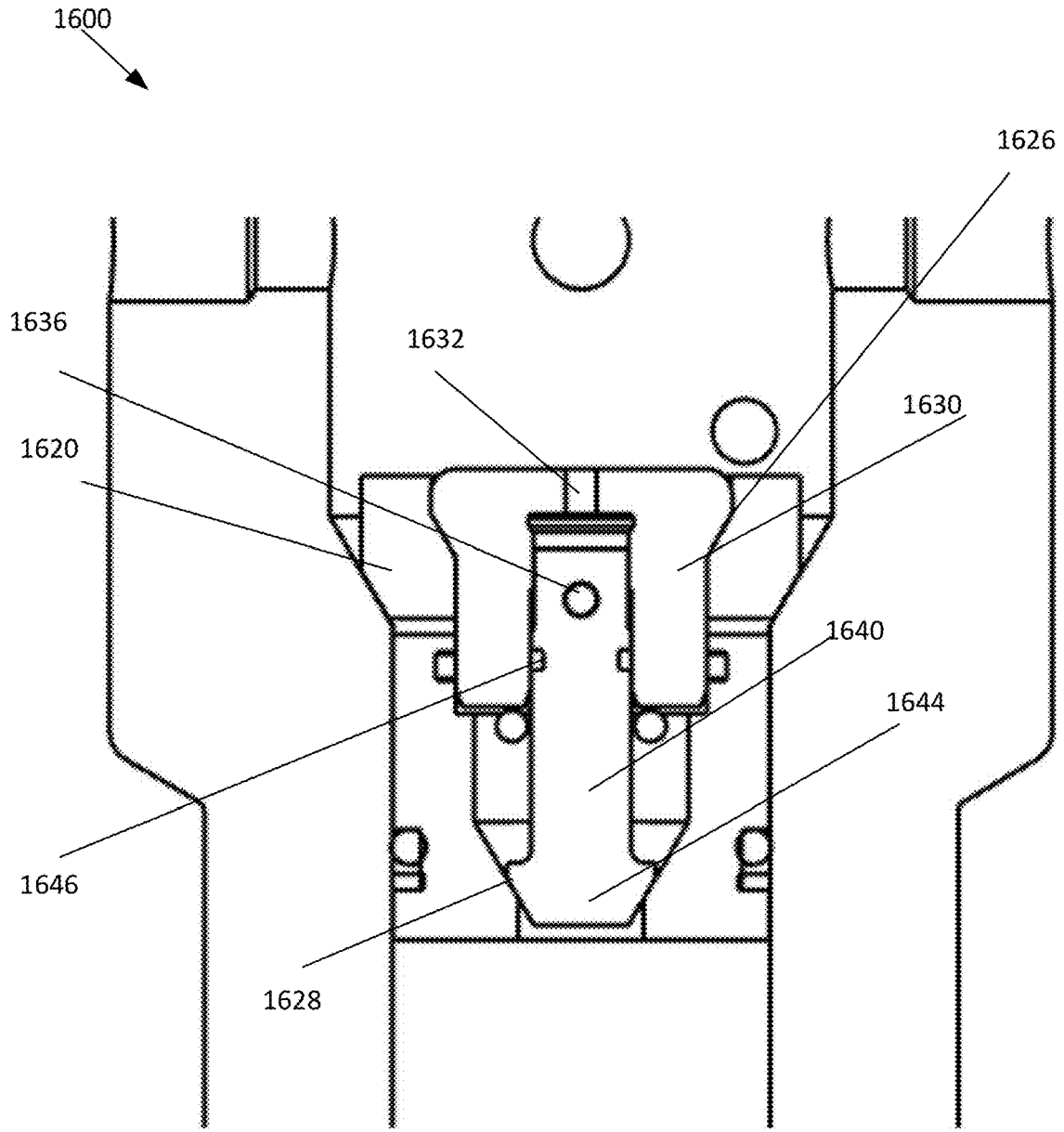
FIG. 19 depicts a downhole tool, according to an embodiment.

FIG. 19 depicts a cross-sectional view of the blocking system for a downhole tool, according to an embodiment. Elements depicted in FIG. 19 may be described above, and for the sake of brevity, a further description of these elements may be omitted.

As depicted in FIG. 19, when plug 1630 is positioned on first seat 1626, pressure above plug 1630 may increase, and may be translated to an upper surface of plunger 1640 through conduit 1632. This pressure may cause a pressure differential across temporary coupling mechanism 1636 to increase past a threshold to activate, break, decouple, etc. temporary coupling mechanism 1636 to allow relative bi-directional movement between plunger 1640 and plug 1630. Specifically, the activating of temporary coupling mechanism 1636 may allow plunger 1640 to move in the first direction until distal end 1644 is positioned across second seat 1628 while plug 1630 remains stationary.

Furthermore, in embodiments, seals 1646 may be located on plunger 1640 at a position axially aligned with an inner diameter of plug 1630. This may maintain the seal within plug 1630 even after the temporary coupling mechanism 1636 is activated.

However, in other embodiments, seals 1646 may be located on plunger 1640 at a positioned below or no longer axially aligned with the inner diameter of plug 1630 after temporary coupling mechanism 1636 is activated and distal end 1644 is positioned on second seat 1628. Specifically, it may not be required for plunger 1640 to form a seal within plug 1630 due to distal end 1644 restricting communication through housing 1620 by being positioned on second seat 1646.

Figure 20:
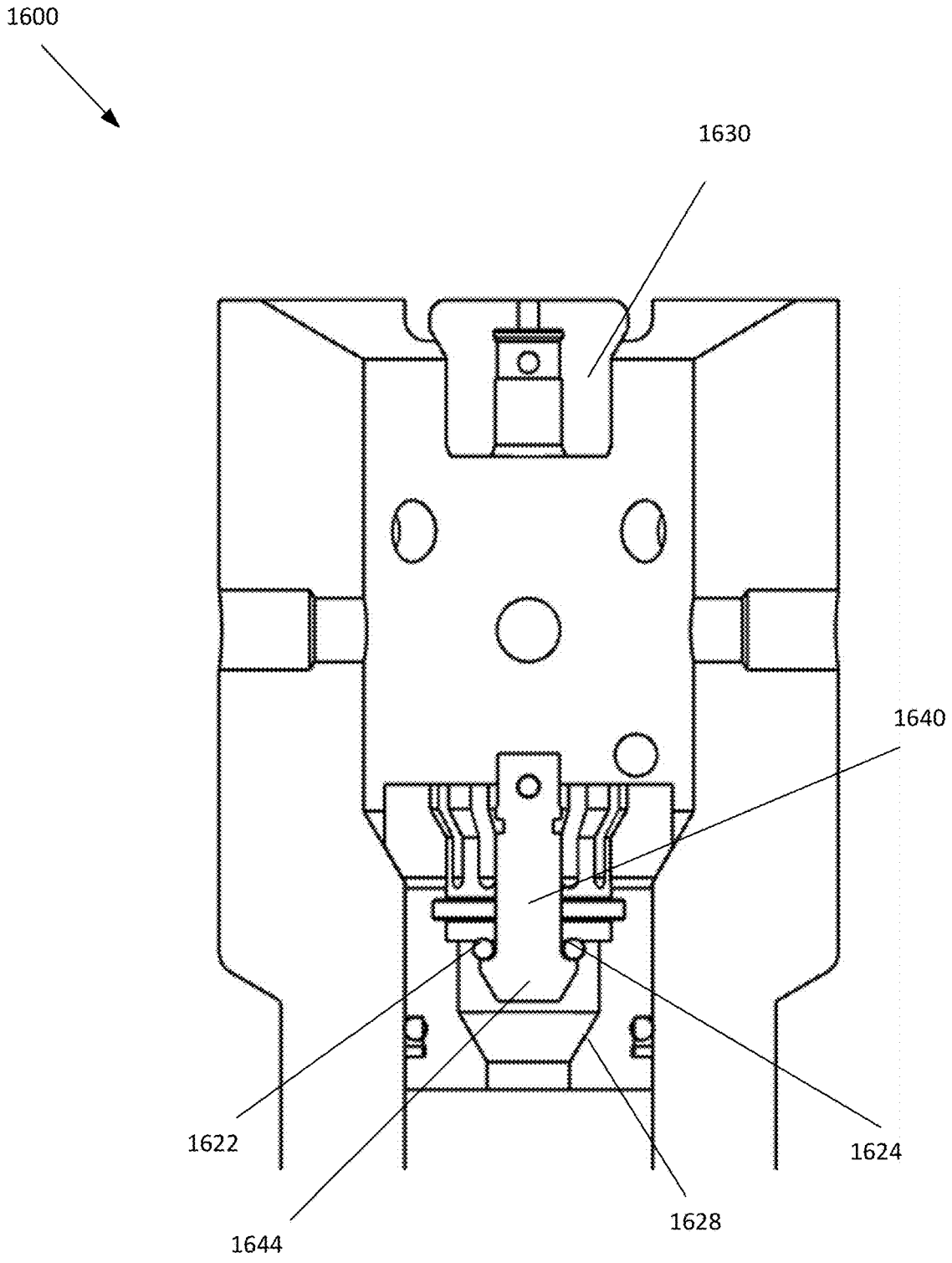
FIG. 20 depicts a downhole tool, according to an embodiment.

FIG. 20 depicts a cross-sectional view of the blocking system for a downhole tool, according to an embodiment. Elements depicted in FIG. 20 may be described above, and for the sake of brevity, a further description of these elements may be omitted.

As depicted in FIG. 20, after temporary coupling mechanism 1636 is activated and there is reverse fluid flow, plug 1630 may flow in the second direction due to plug 1630 no longer being coupled to plunger 1640. However, the up-hole movement of plunger 1640 may be restricted due to distal end 1644 of plunger 1640 being larger than the distance between the pair of stoppers 1622, 1624. More so, due to the relative geometries of the distal end of plunger 1644 and the distance between the pair of stoppers 1622, 1624 and the distance across second seat 1628, the distal end 1644 may remain axially between the pair of stoppers 1622, 1624, and second seat 1628.

Figure 21:
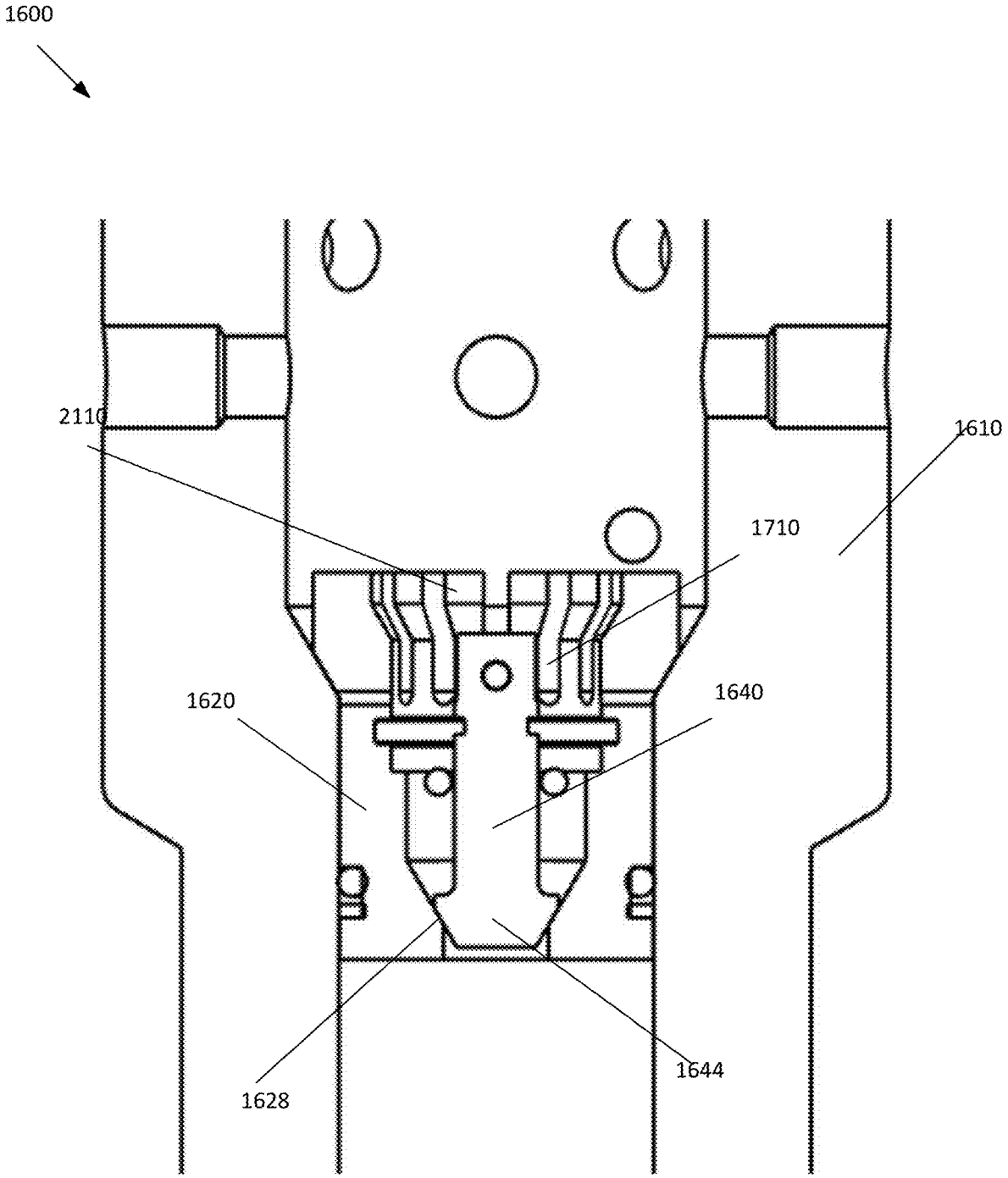
FIG. 21 depicts a downhole tool, according to an embodiment.

FIG. 21 depicts a cross-sectional view of the blocking system for a downhole tool, according to an embodiment. Elements depicted in FIG. 21 may be described above, and for the sake of brevity, a further description of these elements may be omitted.

As depicted in FIG. 21, even after plug 1630 is decoupled from plunger 1640, the flowing fluid in the first direction may once again restrict communication across housing 1620. Specifically, flowing fluid in the first direction may move distal end 1644 of plunger 1640 to be positioned across second seat 1628. In embodiments, while fluid is flowing in the first direction plunger 1640 may retain the secondary seal across second seat 1628 until pressure above the plunger is greater than a shearing value of the fingers 2110 of housing 1620.

Furthermore, due to a reduced thickness across housing 1620 caused by communication channels 1710, housing 1620 may later break due to an increase in pressure across housing 1620. Specifically, after moving plug 1630 in the second direction, and while distal end 1644 of plunger 1640 is positioned on second seat 1628, a pressure differential across housing 1620 may be created. Once the pressure differential is increased past a predetermined value, fingers 2110 adjacent to the communication channel 1710 may break. When the fingers 2110 break, a diameter across housing 1620 may be smaller than a diameter across mandrel 1610, allowing housing 1620 to move in the first direction.

Figure 22:
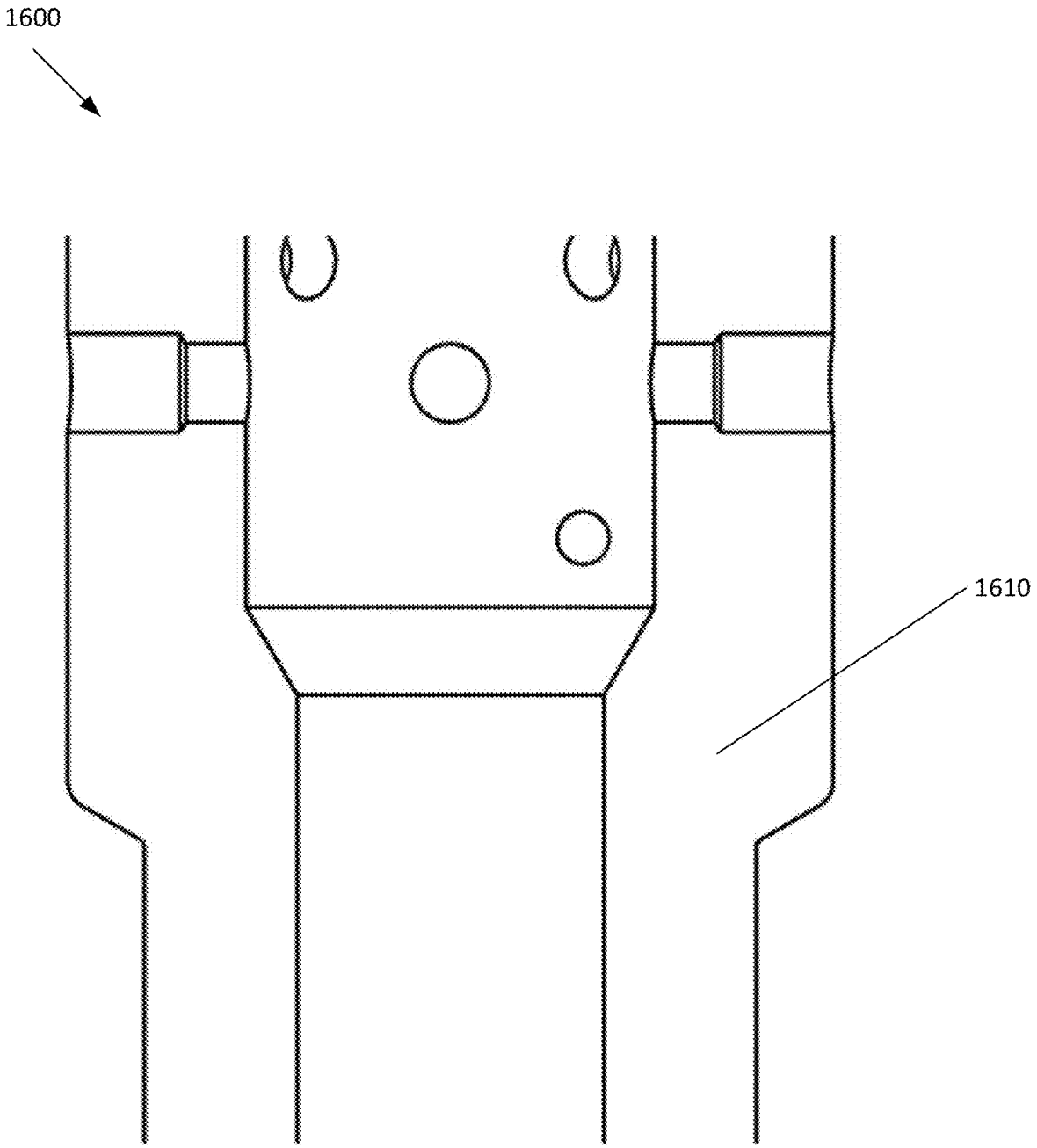
FIG. 22 depicts a downhole tool, according to an embodiment.

FIG. 22 depicts a cross-sectional view of the blocking system for a downhole tool, according to an embodiment. Elements depicted in FIG. 22 may be described above, and for the sake of brevity, a further description of these elements may be omitted.

As depicted in FIG. 22, after communication channels 1710 are fully exposed, an increase in pressure across housing 1620 may cause housing 1620 to break. When housing 1620 breaks, the distance across housing 1620 may be smaller than an inner diameter across mandrel 1610. This may allow the broken parts of housing 1620 to flow downhole or uphole.

Figure 23:
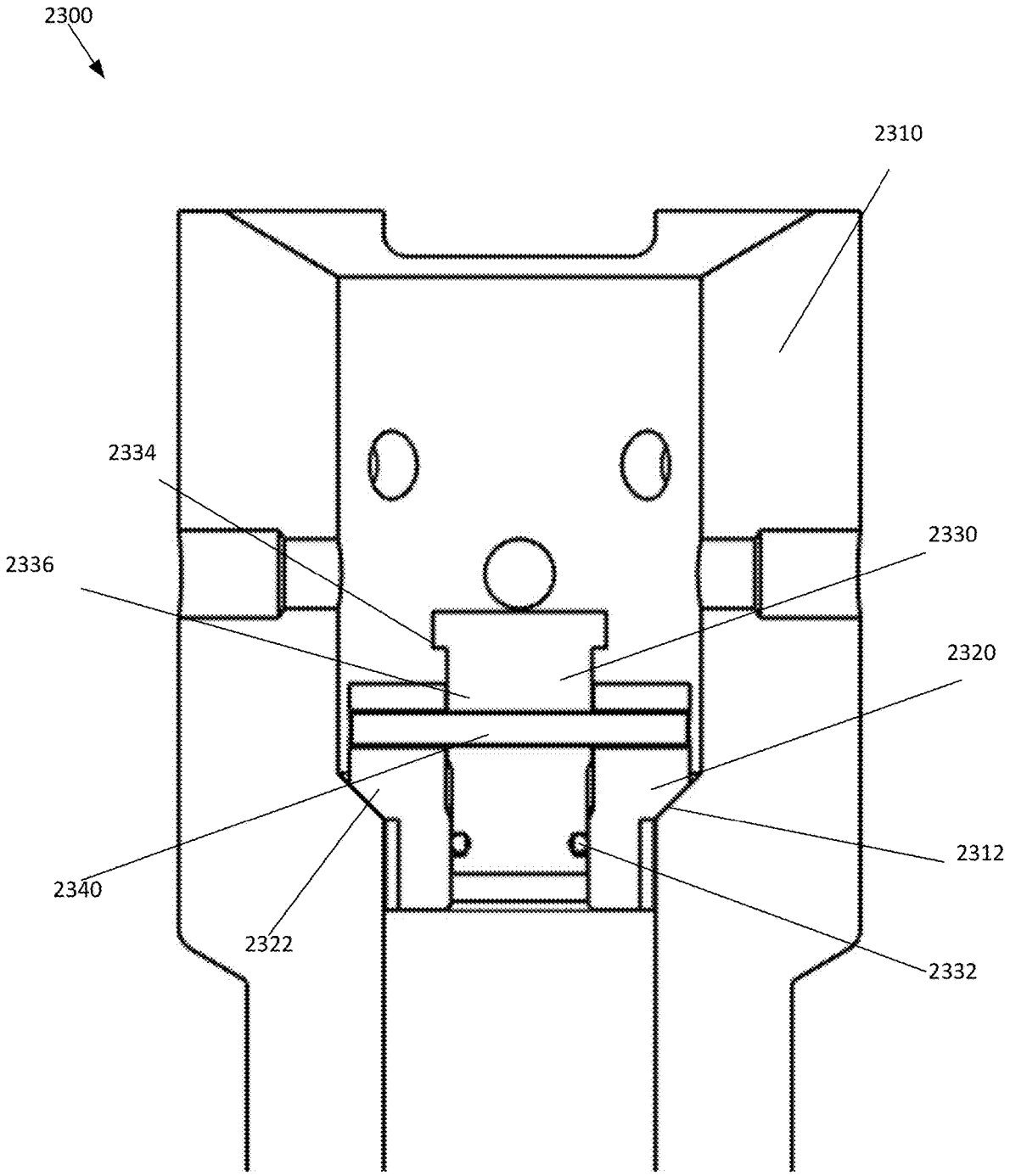
FIG. 23 depicts a downhole tool, according to an embodiment.

FIG. 23 depicts a cross-section view of a blocking system for a downhole tool 2300, according to an embodiment. Elements depicted in FIG. 23 may be described above, and for the sake of brevity, a further description of these elements may be omitted. The blocking system may be utilized to form a resettable plug in a first mode of operation, wherein reverse fluid flow reestablished communication across the blocking system. However, in a second mode of operation, the blocking system may no longer be able to form a seal and may no longer be a resettable plug. The blocking system may include a mandrel 2310, housing 2320, plug 2330, and temporary coupling mechanism 2340.

Mandrel 2310 mandrel may be a hollow shaft, cylindrical rod, cartridge, etc. that is configured to form a body or the whole tool of a downhole tool 2300, such as a frac plug, sliding sleeve, or cartridge. Mandrel 2310 may include a profile 2312 that reduces the inner diameter of mandrel 2310 and limits the movement of housing 2320 in the first direction. Profile 2312 may be a ledge that is perpendicular to a central axis of the downhole tool 2300 or maybe a tapered sidewall that gradually and incrementally decreases the inner diameter of the mandrel 2310. In other embodiments, profile 2312 may not be a ledge, but may be any device, mechanism, etc. that is configured to axially secure housing 1620 to the inner diameter of mandrel 2310 to limit the axial movement of housing 2320 relative to mandrel 2310. For example, profile 2312 may be threads, glue, shear pins, etc. on the inner diameter of mandrel 2310 that are configured to be coupled with corresponding elements an outer diameter of housing 2320.

Figure 25:
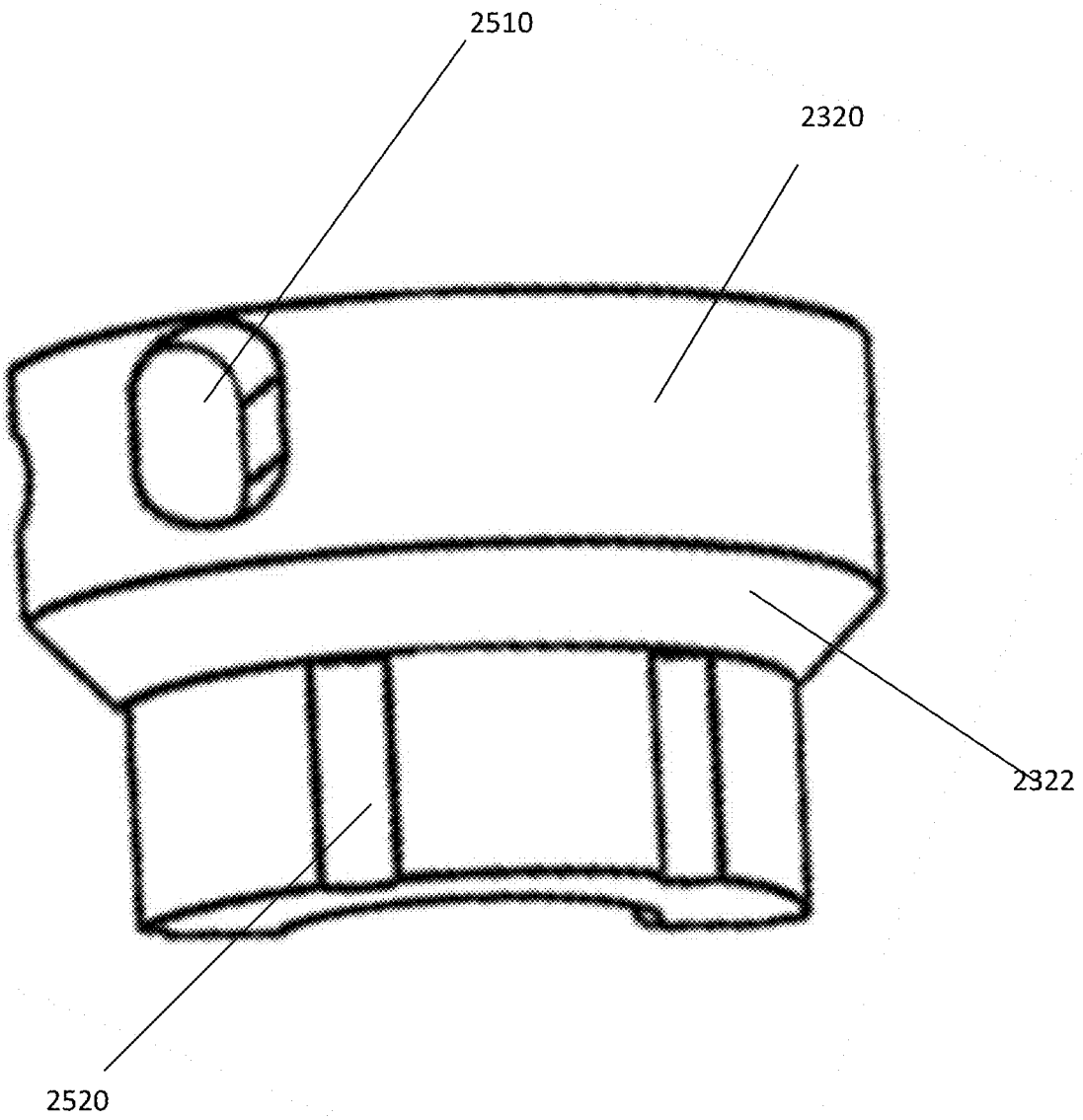
FIG. 25 depicts a downhole tool, according to an embodiment.

Housing 2320 may be a cartridge, casing, container, etc. that is configured to selectively secure the plug 2330 within the housing 2320. Housing 2320 may be a separate element from mandrel 2310, and be mounted on, positioned on, coupled with, etc. an inner diameter of the mandrel 2310, such that housing 2320 along with plug 2330 are moved in the first direction within mandrel 2310. However, in other embodiments, housing 2320 may be an integral part of mandrel 2310. In embodiments, housing 2320 may have an outer diameter 2322 that is configured to be removably positioned on first seat 2312. When housing 2320 is positioned on first seat 2312, one-way communication through the hollow passageway of mandrel 2310 may be restricted. In embodiments, as shown in FIG. 25, an outer diameter of housing 2320 may include a slot 2510, wherein slot 2510 is configured to receive a coupling shaft. Slot 2510 may be longer than a diameter across the coupling shaft, which may allow a stroke length of housing 2320. This may enable housing 2320 to be positioned on first seat 2312, and subsequently away from first seat.

Plug 2330 may be an object, disk, etc. that is configured to selectively form a seal or restrict communication across an inner diameter of the housing 2320 via seal 2332, wherein the proximal end 2334 of plug 2330 may have a larger outer diameter than shaft 2336 of plug 1630. When housing 2320 is run in a hole, proximal end 2334 may be configured to be positioned away from an upper surface of housing 2320. After activating temporary coupling mechanism 2340, proximal end 2334 may move in the first direction and be positioned on the upper surface of housing 2320. In embodiments, shaft 2336 may be configured to be positioned across an inner diameter of housing 2320 before and after activating temporary coupling mechanism 2440.

Seal 2332 may be configured to restrict communication between an outer diameter plug 2330 and an inner diameter of housing 2320 when seal 2332 is radially positioned between the two.

In embodiments, plug 2330 may be selectively coupled to housing 2320 via a temporary coupling mechanism 2340, such as a shear screw, pin, glue, adhesives, collet, weak points, wires, breakable threads, etc. Temporary coupling mechanism 2340 may have a first end that is positioned on the first side of housing 2320, a second end that is positioned on the second side of housing 2320, and a body that extends through plug 2330. When temporary coupling mechanism 2340 is intact, plug 2330 and housing 2320 may be locked together, such that housing 2320 and plug 1630 axially move together. Responsive to activating, breaking, etc. temporary coupling mechanism 2340, the axial movement of the plug 2330 may be independent from the axial movement of the housing 2320. In embodiments, temporary coupling mechanism 2340 may be activated based on applying a pressure differential across temporary coupling mechanism 2340 that is greater than a pressure threshold, which may cause temporary coupling mechanism 2340 to shear, break, etc. to separate the first end of temporary coupling mechanism 2340 from the second end of the temporary coupling mechanism 2340.

Figure 24:
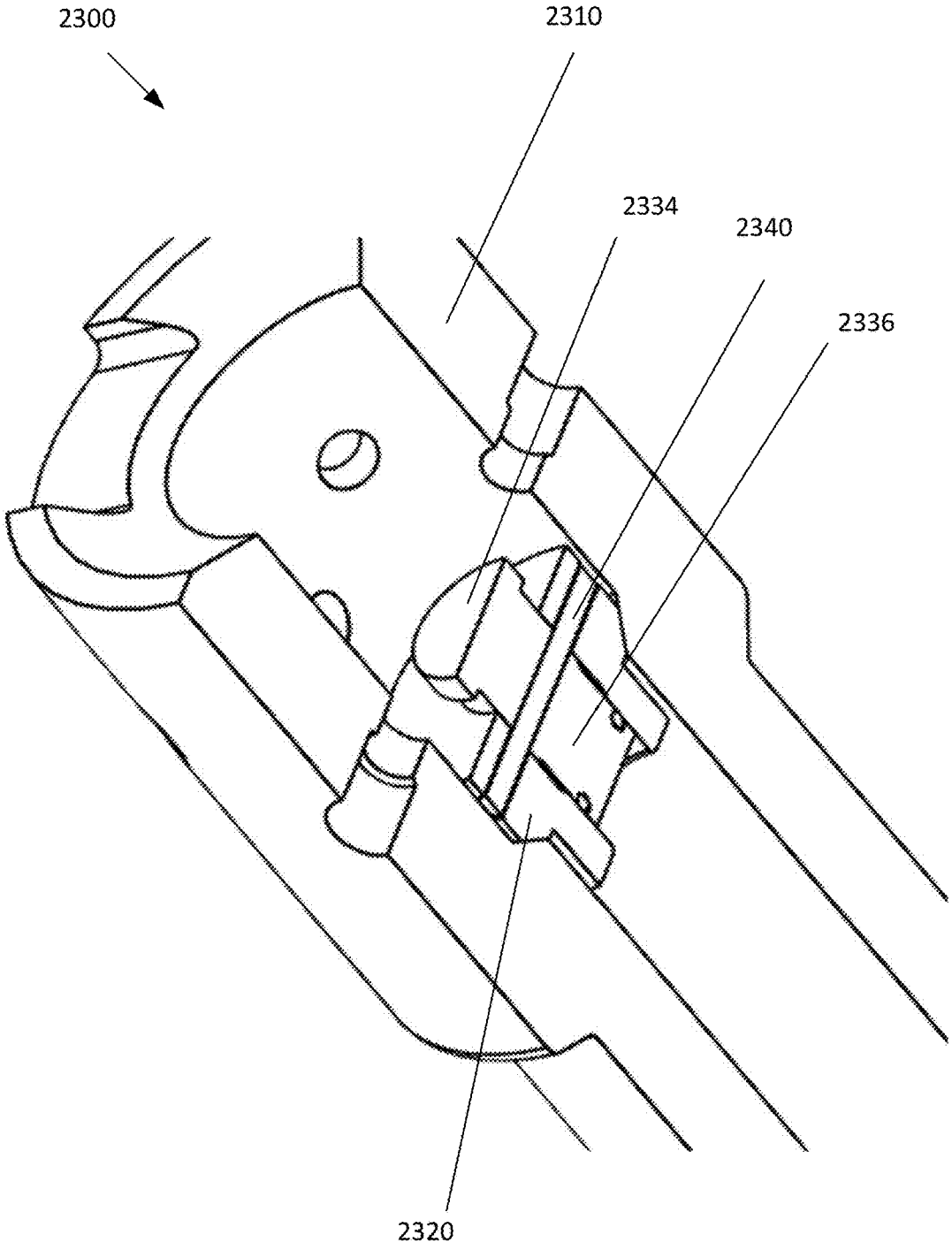
FIG. 24 depicts a downhole tool, according to an embodiment.

FIG. 24 depicts a cross-section and perspective view of a blocking system for a downhole tool 2300, according to an embodiment. Elements depicted in FIG. 24 may be described above, and for the sake of brevity, a further description of these elements may be omitted.

As depicted in FIG. 24, when run in hole, and before activating temporary coupling mechanism 2340, proximal end 2334 of plug 2330 may be positioned away from an upper surface of housing 2320. This may allow plug 2340 to be driven downward due to a pressure differential across plug 2330. Furthermore, proximal end 2334 of plug 2330 may have a larger diameter than a distal end of plug 2330, which may assist in creating the pressure differential to drive plug 2340 in the first direction.

FIG. 25 depicts an outer view of housing 2320, according to an embodiment. Elements depicted in FIG. 25 may be described above, and for the sake of brevity, a further description of these elements may be omitted.

As depicted in FIG. 25, the outer surface of housing 2320 may include a slot 2510 that is configured to receive a shaft, wherein the shaft is coupled to mandrel 2310. A height of slot 2510 relative to a diameter across the shaft may provide a stroke length for housing 2320, which may allow housing 2320 to be positioned away from and repositioned on profile 2312. In embodiments, slot 2510 may be positioned above a portion of outer diameter 2322 that is configured to sit on profile 2312.

An outer diameter of housing 2320 may also include communication channels 2520 that reduce a size of the outer diameter of housing 2320, wherein communication channels 2520 may be positioned below the portion of outer diameter 2322 that is configured to sit on profile 2312. When housing 2320 is positioned away from profile 2312, communication channels 2520 may allow communication between an area above housing 2320 and an area below housing 2320.

Figure 26:
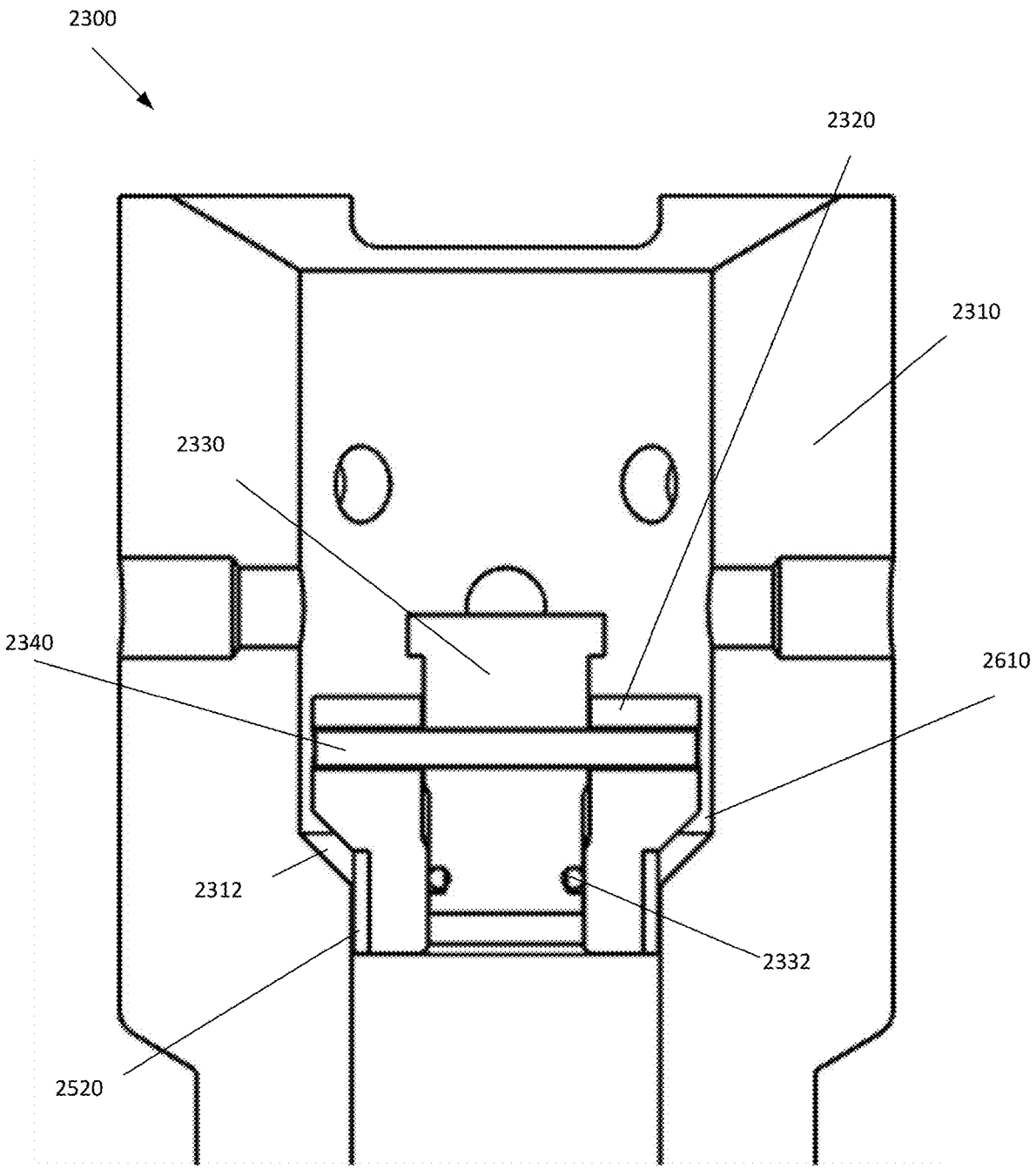
FIG. 26 depicts a downhole tool, according to an embodiment.

FIG. 26 depicts a cross-section view of a blocking system for a downhole tool 2300, according to an embodiment. Elements depicted in FIG. 26 may be described above, and for the sake of brevity, a further description of these elements may be omitted.

As depicted in FIG. 26, due to flowing fluid in an in the second direction, downhole tool 2300 may act as a resettable check valve by moving plug 2330 and housing 2320 in the second direction together. When housing 2320 moves uphole, seals 2332 may restrict the flow of fluid through the inner diameter of housing 2320, while fluid may flow in an annular space between an outer diameter of housing 2320 and an inner diameter of mandrel 2310.

Furthermore, when housing 2320 moves in the second direction a proximal end of communication channels 2520 may be aligned with profile 2312, and a distal end of communication channels 2520 may be positioned directly downhole from profile 2312. To this end, portions of an outer diameter of housing 2320 may remain directly adjacent to the inner diameter of mandrel 2310 while allowing communications between the area above housing 2320 and an area below housing 2320.

Figure 27:
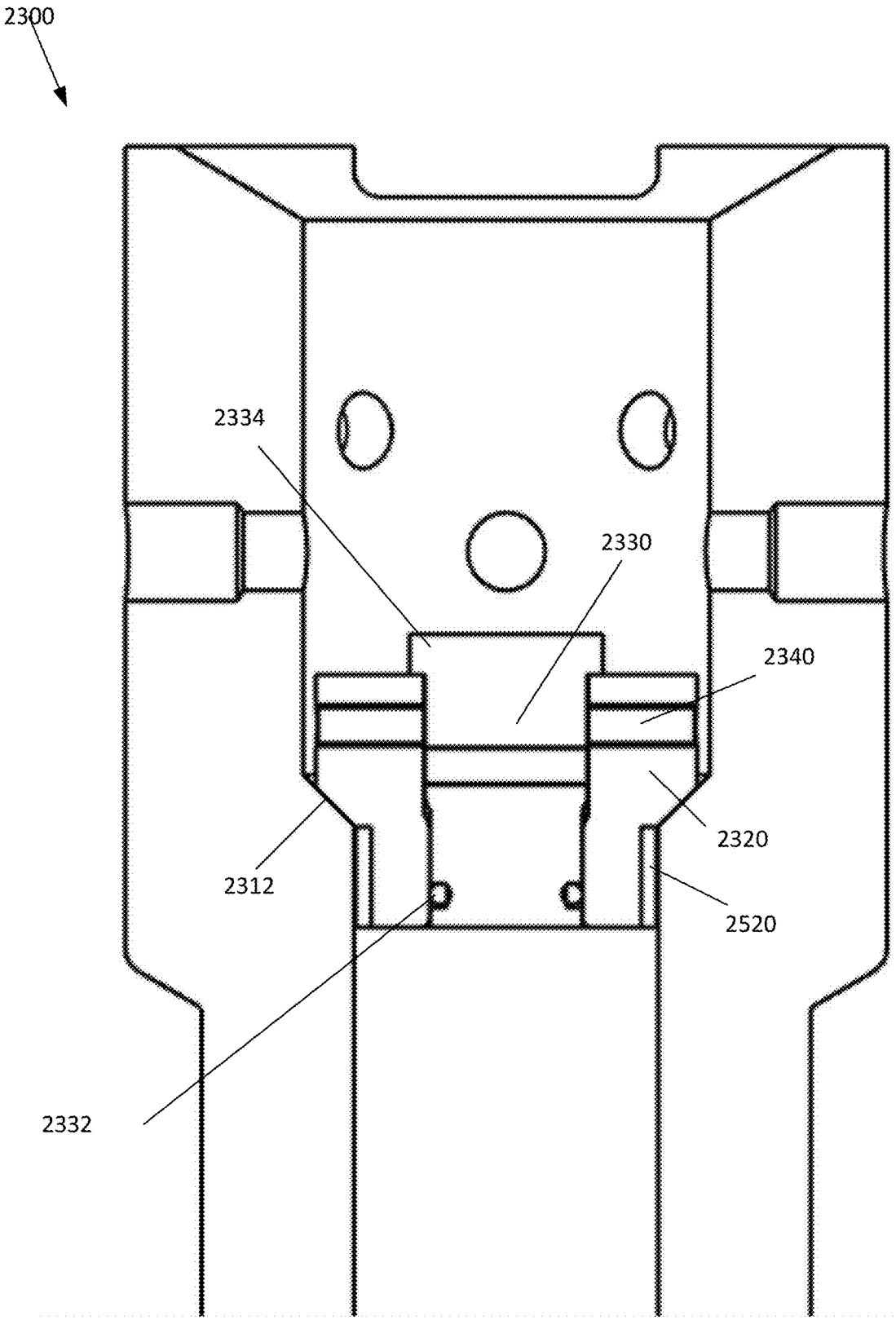
FIG. 27 depicts a downhole tool, according to an embodiment.

FIG. 27 depicts a cross-section view of a blocking system for a downhole tool 2300, according to an embodiment. Elements depicted in FIG. 27 may be described above, and for the sake of brevity, a further description of these elements may be omitted.

As depicted in FIG. 27, after housing 2320 is reset and repositioned on profile 2312, a pressure differential across temporary coupling mechanism 2340 may be greater than a threshold, activating temporary coupling mechanism 2340. When temporary coupling mechanism 2340 is activated, temporary coupling mechanism 2340 may break, allowing relative bi-axial movement of plug 2330 relative to housing 2320. Specifically, directly activating temporary coupling mechanism 2340, proximal end 2334 of plug 2330 may move in the first direction, and be impeded by the upper surface of housing 2320.

Furthermore, when plug 2330 is driven downward a seal across the inner passageway of housing 2320 may be maintained via seals 2332 being radially aligned with the inner passageway.

Figure 28:
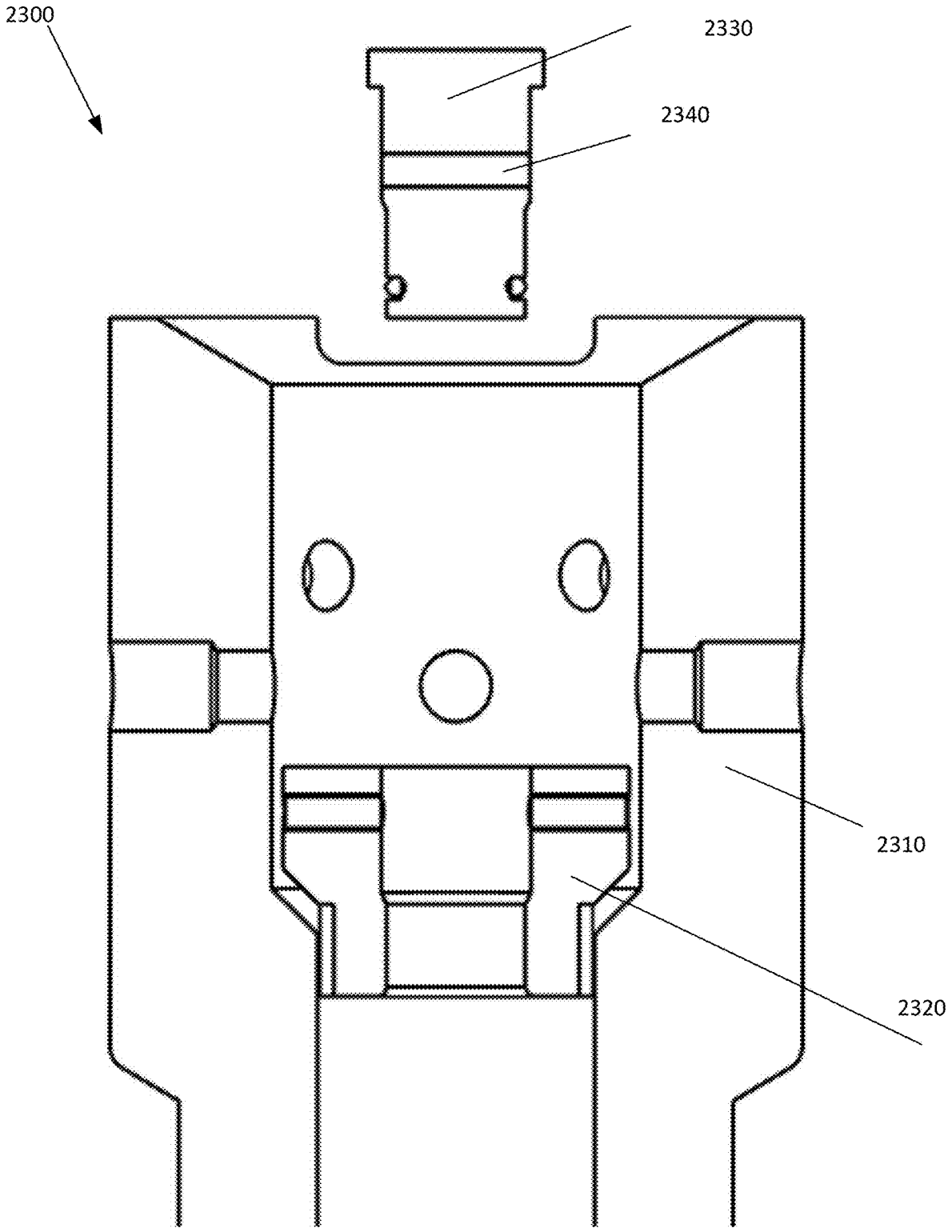
FIG. 28 depicts a downhole tool, according to an embodiment.

FIG. 28 depicts a cross-section view of a blocking system for a downhole tool 2300, according to an embodiment. Elements depicted in FIG. 28 may be described above, and for the sake of brevity, a further description of these elements may be omitted.

As depicted in FIG. 28, after temporary coupling mechanism 2340 is activated, plug 2330 may axially move relative to housing 2320, which may still be coupled to mandrel 2310. Specifically, after temporary coupling mechanism 2340 is activated, and fluid flows in in the second direction, the flowing fluid may dislodge plug 2330 from the inner passageway of housing 2320 permanently decoupling housing 2320 and plug 2320. This may permanently disable the check valve functionality of housing 2320 and plug 2330.

Figure 29:
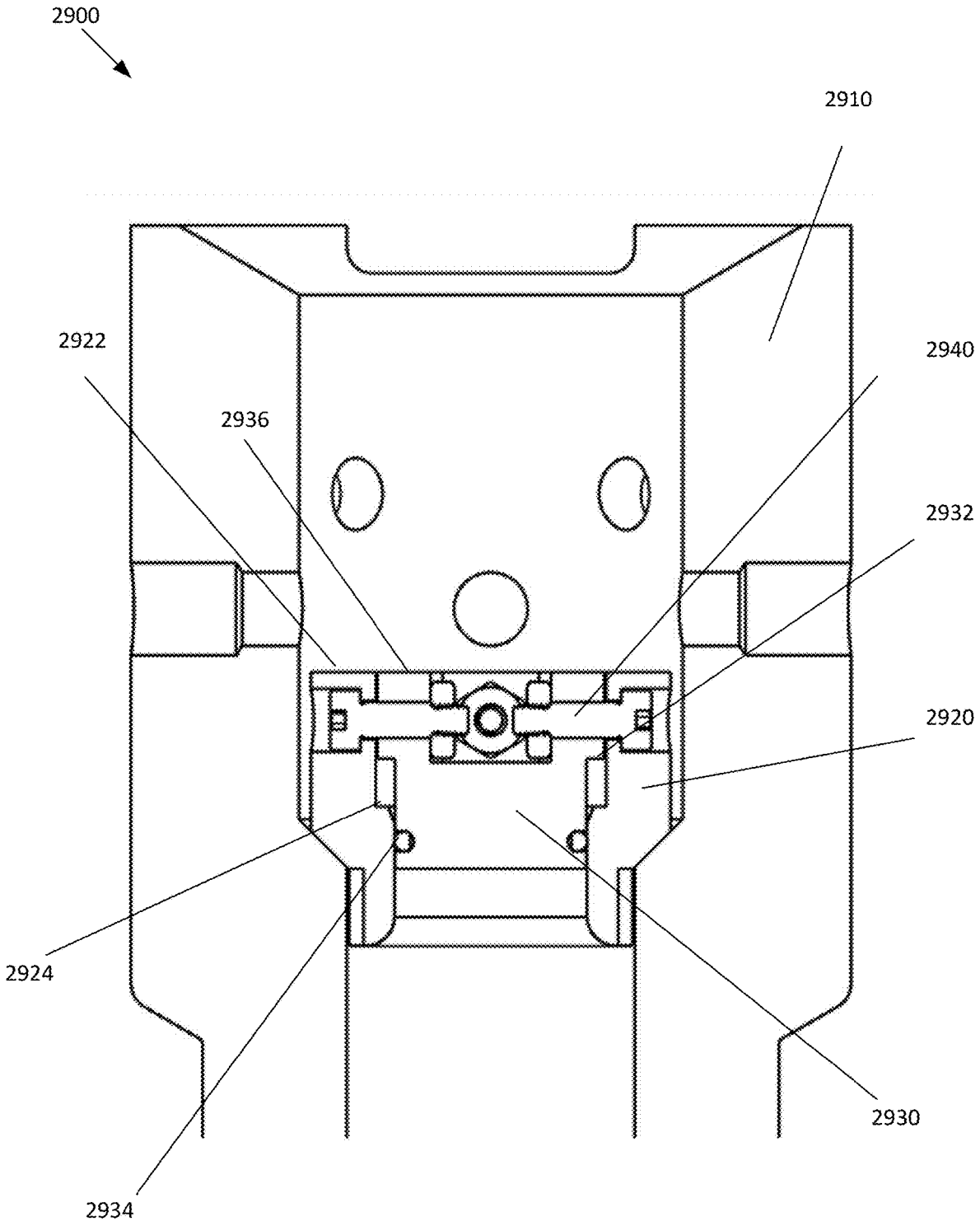
FIG. 29 depicts a downhole tool, according to an embodiment.

FIG. 29 depicts a cross-section view of a blocking system for a downhole tool 2900, according to an embodiment. Elements depicted in FIG. 29 may be described above, and for the sake of brevity, a further description of these elements may be omitted. The blocking system may be utilized to form a resettable check valve in a first mode of operation, wherein reverse fluid flow reestablished communication across the blocking system. However, in a second mode of operation, the blocking system may no longer be able to form a seal and may no longer be a resettable check valve. The blocking system may include a mandrel 2910, housing 2920, plug 2930, and a plurality of temporary coupling mechanisms 2940.

Mandrel 2910 mandrel may be a hollow shaft, cylindrical rod, cartridge, etc. that is configured to form a body or the whole tool of a downhole tool 2900, such as a frac plug, sliding sleeve, or cartridge. Mandrel 2910 may include a profile that reduces the inner diameter of mandrel 2910 and limits the movement of housing 2320 in the first direction.

Housing 2920 may be a cartridge, casing, container, etc. that is configured to selectively secure the plug 2930 within the housing 2920. Housing 2920 may be coupled to mandrel 2910 in a way that allows housing 2920 to move a stroke length in an in the second direction and in the first direction. In embodiments, housing 2320 may have an outer diameter that is configured to be removably positioned on the profile of the inner diameter of the mandrel 2910. When housing 2920 is positioned on the profile on the inner diameter of mandrel 2910, one-way communication through the hollow passageway of mandrel 2310 may be restricted. When housing 2920 is positioned on the profile on the inner diameter of mandrel 2910, downhole communication across housing 2920 may be blocked. Housing may include an upper surface 2922 and an internal profile 2924.

Before activating temporary coupling mechanisms 2940, upper surface 2922 may be co-planar with an upper surface 2936 of plug 2930. However, after activating temporary coupling mechanisms 2940, upper surface 2936 of plug 2930 may initially be positioned below upper surface 2922 of housing 2920 and then positioned above upper surface 2922 of housing 2920.

Internal profile 2924 of housing 2920 may be a jut, ledge, etc. that reduces the size of the inner diameter across an internal passageway of housing 2920. Internal profile 2924 may be configured to restrict, limit, etc. a downward movement of plug 2930 after activating temporary coupling mechanisms 2940. Before activating temporary coupling mechanisms 2940, outcrop 2932 on plug 2930 may be positioned away from internal profile 2924. After activating temporary coupling mechanisms 2940 and shifting plug 2930 in the first direction, outcrop 2932 may sit on internal profile 2924.

Plug 2930 may be an object, disk, etc. that is configured to selectively form a seal or restrict communication across an inner diameter of the housing 2920 via seal 2934. Seal 2934 may be configured to restrict communication between an outer diameter plug 2930 and an inner diameter of housing 2920 when seal 2934 is radially positioned between the two. In embodiments, seal 2934 may be positioned below internal profile 2924 of housing 2920 before and after activating temporary coupling mechanisms 2940.

In embodiments, plug 2930 may be selectively coupled to housing 2920 via temporary coupling mechanisms 2940, such as a shear screw, pin, glue, adhesives, collet, weak points, wires, breakable threads, etc. Responsive to activating, breaking, etc. temporary coupling mechanisms 2940, the axial movement of the plug 2930 may be independent from the axial movement of the housing 2920. In embodiments, temporary coupling mechanisms 2340 may be activated based on applying a pressure differential across temporary coupling mechanisms 2340 that is greater than a pressure threshold, which may cause temporary coupling mechanisms 2340 to shear, break, etc. to allow relative movement of plug 2930 and housing 2920.

Figure 30:
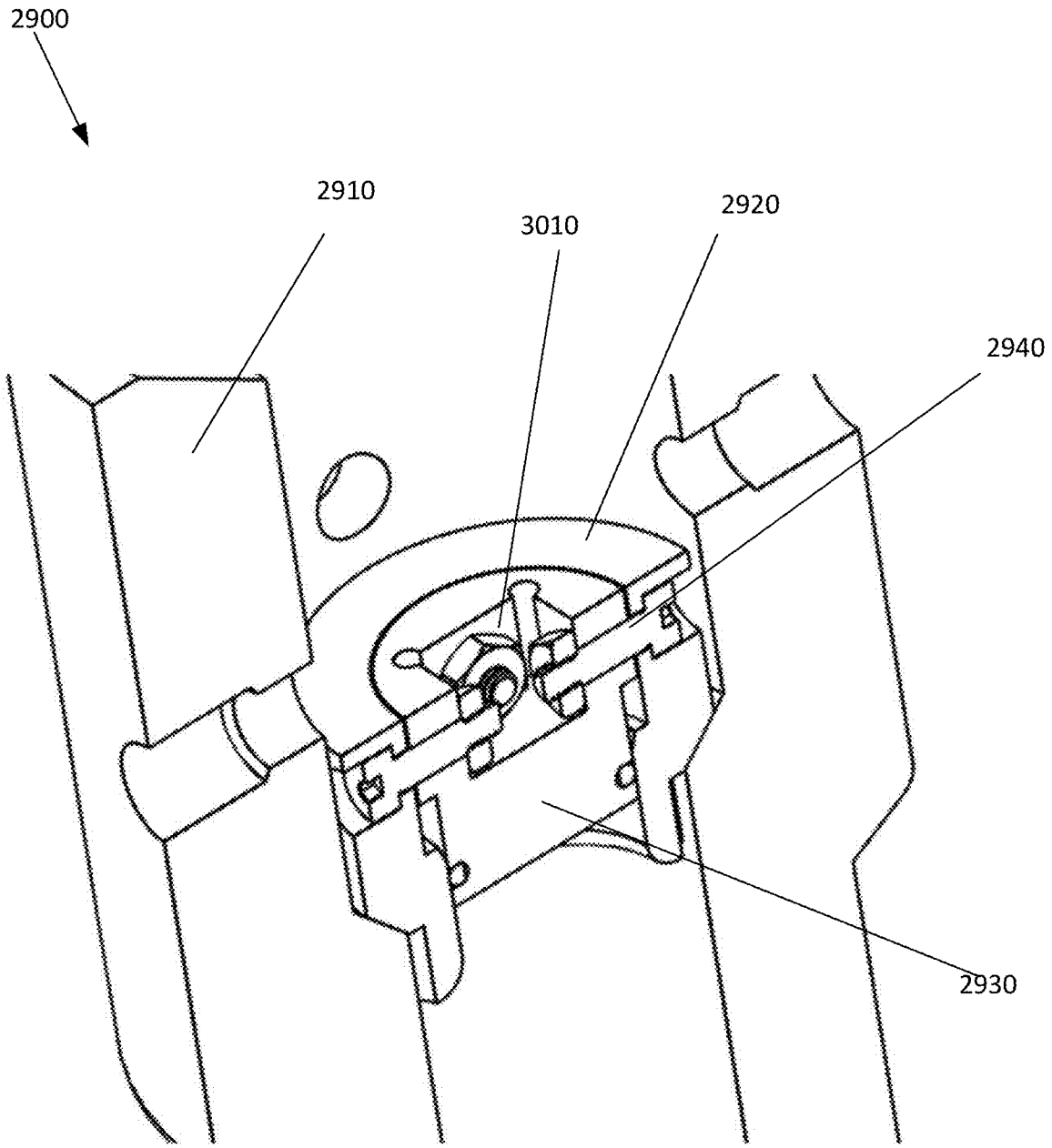
FIG. 30 depicts a downhole tool, according to an embodiment.

FIG. 30 depicts a cross-section and perspective view of a blocking system for a downhole tool 2900, according to an embodiment. Elements depicted in FIG. 30 may be described above, and for the sake of brevity, a further description of these elements may be omitted.

As depicted in FIG. 30, when temporary coupling mechanisms 2940 are intact, the upper surfaces of plug 2930 and housing 2920 may be coplanar. Furthermore, plug 3010 may have a notch 3010, cavity, etc. extending from the upper surface of plug 2930 toward the lower surface of plug 2930. The notch may enable the inner surfaces of the temporary coupling mechanisms 2940 to be secured in place.

Figure 31:
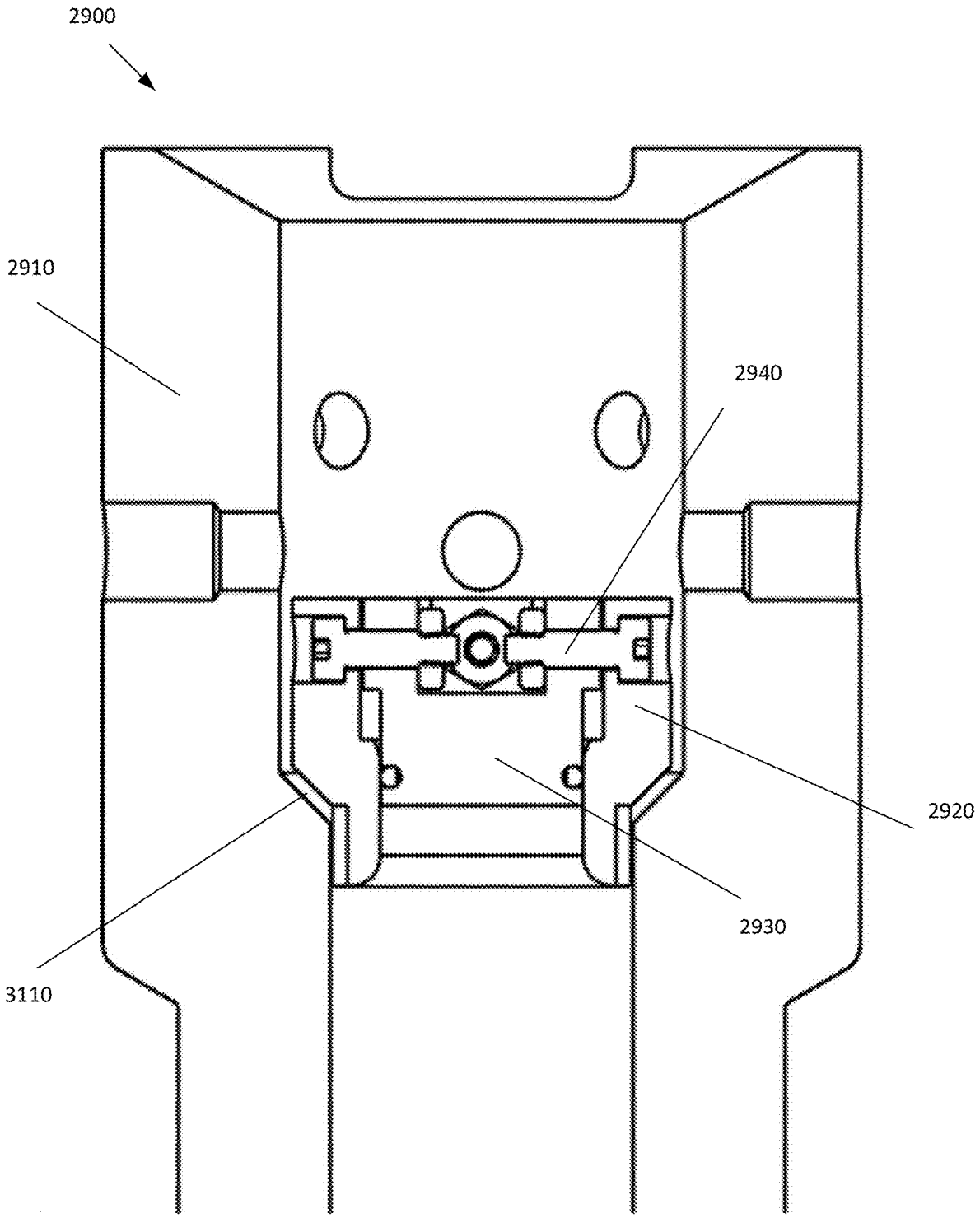
FIG. 31 depicts a downhole tool, according to an embodiment.

FIG. 31 depicts a cross-section and perspective view of a blocking system for a downhole tool 2900, according to an embodiment. Elements depicted in FIG. 31 may be described above, and for the sake of brevity, a further description of these elements may be omitted.

As depicted in FIG. 31, due to flowing fluid in an in the second direction, downhole tool 2900 may act as a resettable check valve by moving plug 2930 and housing 2920 in the second direction together. When housing 2920 moves uphole, fluid may flow in an annular space 3110 between an outer diameter of housing 2920 and an inner diameter of mandrel 2910.

Figure 32:
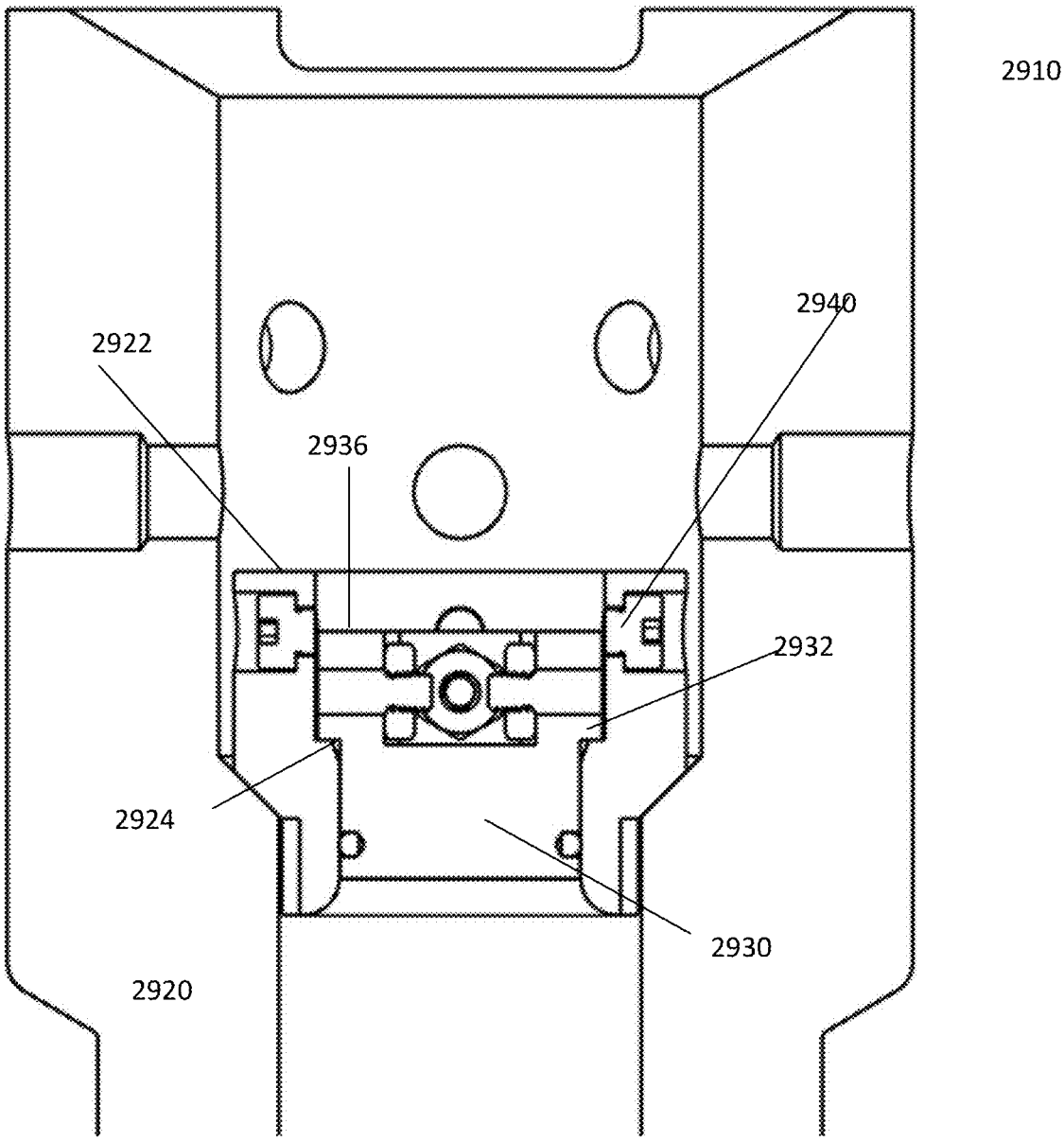
FIG. 32 depicts a downhole tool, according to an embodiment.

FIG. 32 depicts a cross-section and perspective view of a blocking system for a downhole tool 2900, according to an embodiment. Elements depicted in FIG. 32 may be described above, and for the sake of brevity, a further description of these elements may be omitted.

As depicted in FIG. 32, after activating temporary coupling mechanisms 2940 plug 2930 may move relative to a stationary housing 2920, wherein housing 2920 is positioned on a ledge on the circumference of mandrel 2910. Specifically, plug 2930 may move in the first direction until outcrop 2932 is positioned on internal profile 2924 while retaining the seal within housing 2920. This may enable housing 2920 and plug 2930 to retain the seal across mandrel 2910 after activating temporary coupling mechanisms 2940 and the relative movement of plug 2930. Furthermore, this relative movement of plug 2930 may cause upper surface 2936 to be radially encompassed within housing 2920, below the upper surface 2922 of housing 2920.

Figure 33:
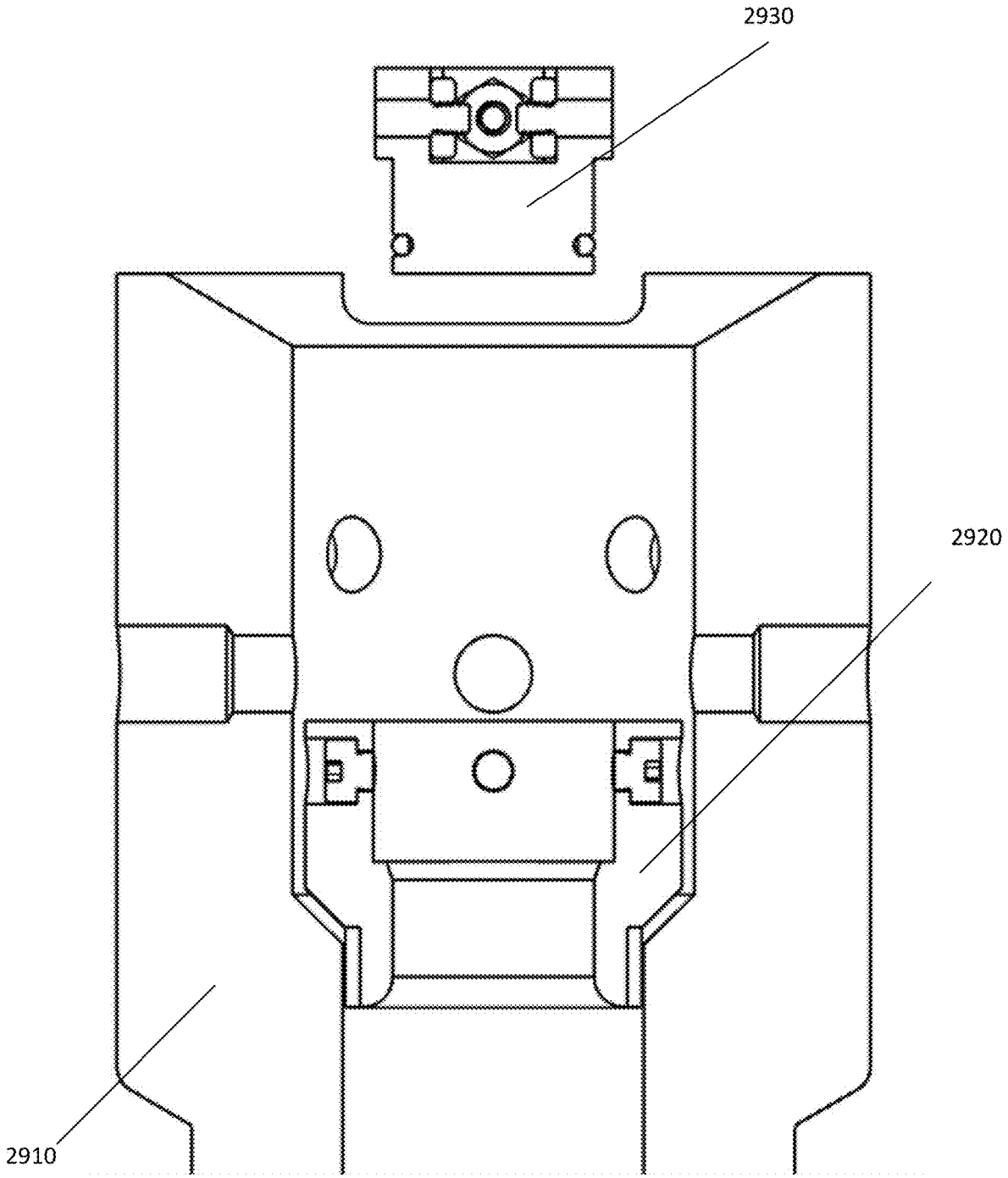
FIG. 33 depicts a downhole tool, according to an embodiment.

FIG. 33 depicts a cross-section and perspective view of a blocking system for a downhole tool 2900, according to an embodiment. Elements depicted in FIG. 33 may be described above, and for the sake of brevity, a further description of these elements may be omitted.

As depicted in FIG. 33, after temporary coupling mechanisms 2940 are activated, plug 2930 may axially move relative to housing 2920, which may still be coupled to mandrel 2910. Specifically, after temporary coupling mechanisms 2940 are activated, and fluid flows in the second direction, the flowing fluid may dislodge plug 2930 from the inner passageway of housing 2920 permanently decoupling housing 2920 and plug 2920. This may permanently disable the check valve functionality of housing 2920 and plug 2930.

Figure 34:
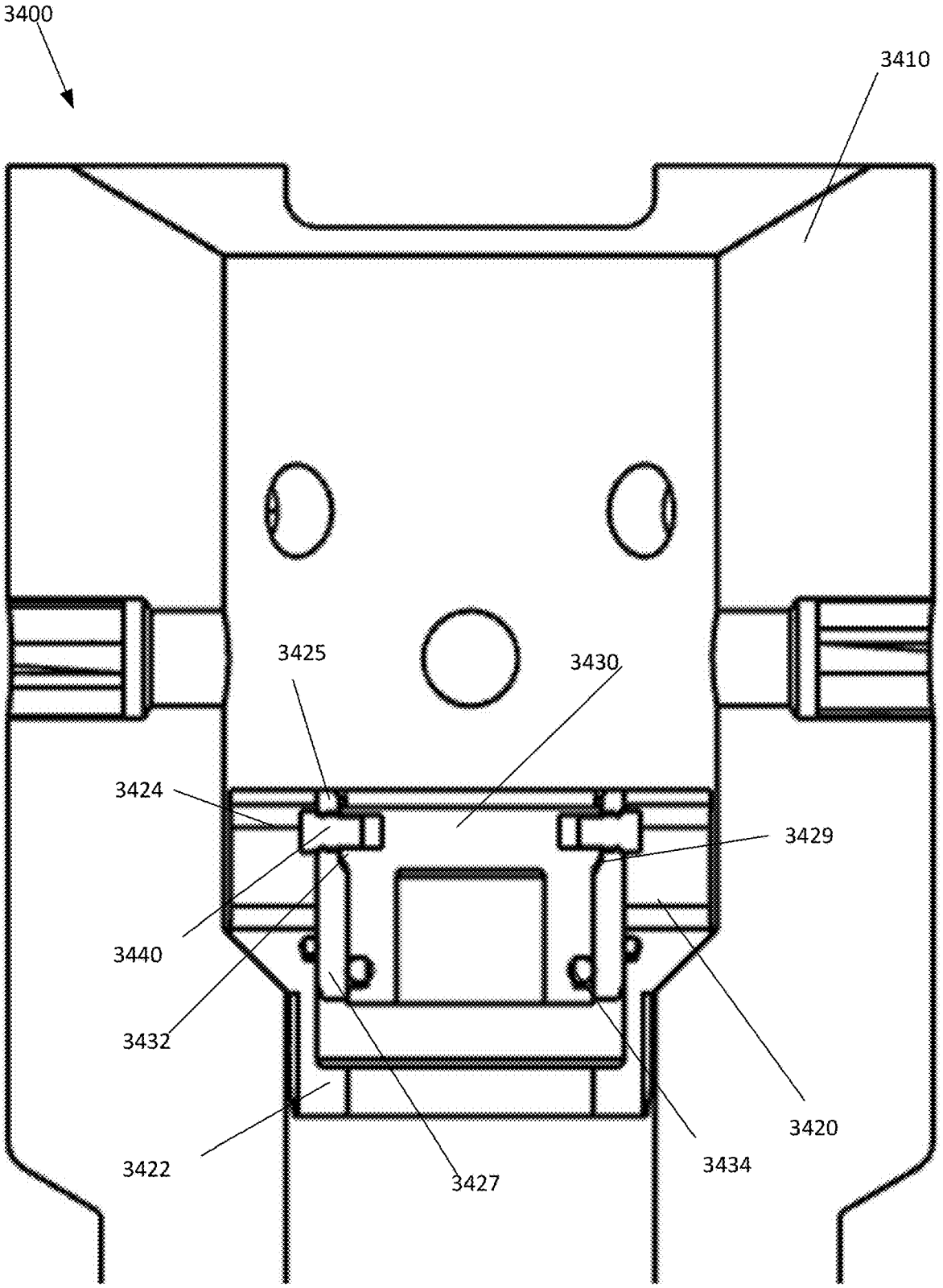
FIG. 34 depicts a downhole tool, according to an embodiment.

FIG. 34 depicts a cross-section view of a blocking system for a downhole tool 3400, according to an embodiment. Elements depicted in FIG. 34 may be described above, and for the sake of brevity, a further description of these elements may be omitted. The blocking system may be utilized to form a resettable check valve in a first mode of operation, wherein reverse fluid flow reestablished communication across the blocking system. However, in a second mode of operation, the blocking system may no longer be able to form a seal and may no longer be a resettable check valve. The blocking system may include a mandrel 3410, housing 3420, annular piston 3425, plug 3430, and temporary coupling mechanism 3440.

Mandrel 3410 mandrel may be a hollow shaft, cylindrical rod, cartridge, etc. that is configured to form a body or the whole tool of a downhole tool 3400, such as a frac plug, sliding sleeve, or cartridge. Mandrel 3410 may include a profile that reduces the inner diameter of mandrel 3410 and limits the movement of housing 3420 in the first direction.

Housing 3420 may be a cartridge, casing, container, etc. that is configured to selectively secure the plug 3430 and annular piston 3425 within the housing 2920. Housing 2920 may be coupled to mandrel 3410 in a way that allows housing 4320 to move a stroke length in an uphole direction and downhole direction. In embodiments, housing 2320 may have an outer diameter that is configured to be removably positioned on the profile of the inner diameter of the mandrel 2910. When housing 3420 is positioned on the profile on the inner diameter of mandrel 3410, one-way communication through the hollow passageway of mandrel 3410 may be restricted. When housing 3420 is positioned on the profile on the inner diameter of the mandrel 3410, downhole communication across housing 3420 may be blocked. Housing 3420 may include an internal profile 3422 and radial rim 2424.

Internal profile 3422 of housing 3420 may be a jut, ledge, etc. that reduces the size of the inner diameter across an internal passageway of housing 3420. Internal profile 3422 may be configured to restrict, limit, etc. a downward movement of annular piston 2425 after activating temporary coupling mechanisms 3440. Before activating temporary coupling mechanisms 3440, a distal end 3427 of annular piston 3425 may be positioned away from internal profile 3422. After activating temporary coupling mechanisms 3440 and shifting annular piston 3425 in the first direction, distal end 3427 may sit on internal profile 3422.

Radial rim 3424 of housing 3420 may be a jut, ledge, etc. that reduces the size of the inner diameter across an internal passageway of housing 3420. Radial rim 3424 may be configured to restrict, limit, etc. a downward movement of plug 3430. By restricting the movement of plug 3430 in the first direction, annular piston 3425 may create a pressure differential across temporary coupling mechanisms 3440. This may allow plug 3430 to sit on radial rim 3424 after annular piston 2425 shifts in the first direction.

Plug 3430 may be an object, disk, etc. that is configured to, along with annular piston 3425, selectively form a seal or restrict communication across an inner diameter of the housing 3420 via seal 3434. Seal 2934 may be configured to restrict communication between an outer diameter plug 2930 and an inner diameter of annular piston 3425 when seal 3434 is radially positioned between the two. A proximal end 3432 of plug 3430 may have a larger outer diameter than that of a distal end of plug 3430, wherein proximal end 3432 may be configured to sit on seat 3429 on an internal diameter of annular piston 3425 before activating temporary coupling mechanism 2440. Furthermore, proximal end 3432 may not be able to move further downhole than seat 3429, which may limit the relative downhole movement of plug 3430 and annular piston 3427, such that plug 3430 cannot move further downhole than annular piston 3427.

In embodiments, temporary coupling mechanisms 3440 may be shear screws, pins, glue, adhesives, collets, weak points, wires, breakable threads, etc. that are configured to temporarily couple housing 3420, annular piston 2425, and/or plug 3430. Responsive to activating, breaking, etc. temporary coupling mechanisms 3440, the axial movement of the annular piston 3425 and/or plug 3430 may be independent of the axial movement of the housing 3420. Furthermore, responsive to activating, breaking, etc. temporary coupling mechanisms 3440, the axial movement of the annular piston 3425 may be independent of the axial movement of the plug 3430. In embodiments, temporary coupling mechanisms 3440 may be activated based on applying a pressure differential across temporary coupling mechanisms 3440 that is greater than a pressure threshold, which may cause temporary coupling mechanisms 3440 to shear, break, etc. to allow relative movement of plug 3430, annular piston 3425, and housing 3420.

Figure 35:
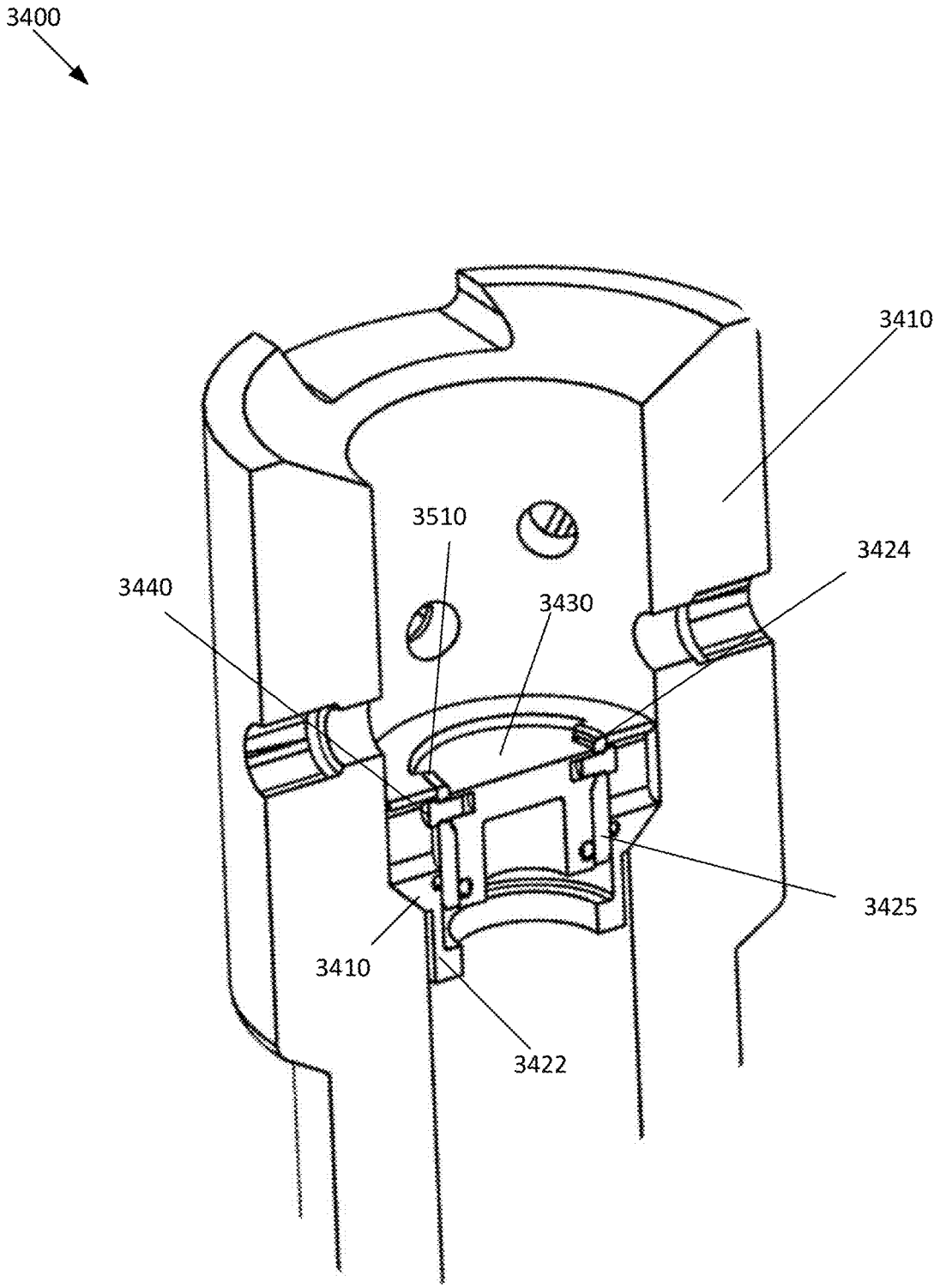
FIG. 35 depicts a downhole tool, according to an embodiment.

FIG. 35 depicts a cross-section view of a blocking system for a downhole tool 3400, according to an embodiment. Elements depicted in FIG. 35 may be described above, and for the sake of brevity, a further description of these elements may be omitted.

As depicted in FIG. 35, when downhole tool 3400 is run in hole, an upper surface 3510 of annular piston 3425 may be exposed to an area above plug 3430. This may enable annular piston 3425 to create a pressure differential across temporary coupling mechanism 3440 to activate temporary coupling mechanism 3440.

Figure 36:
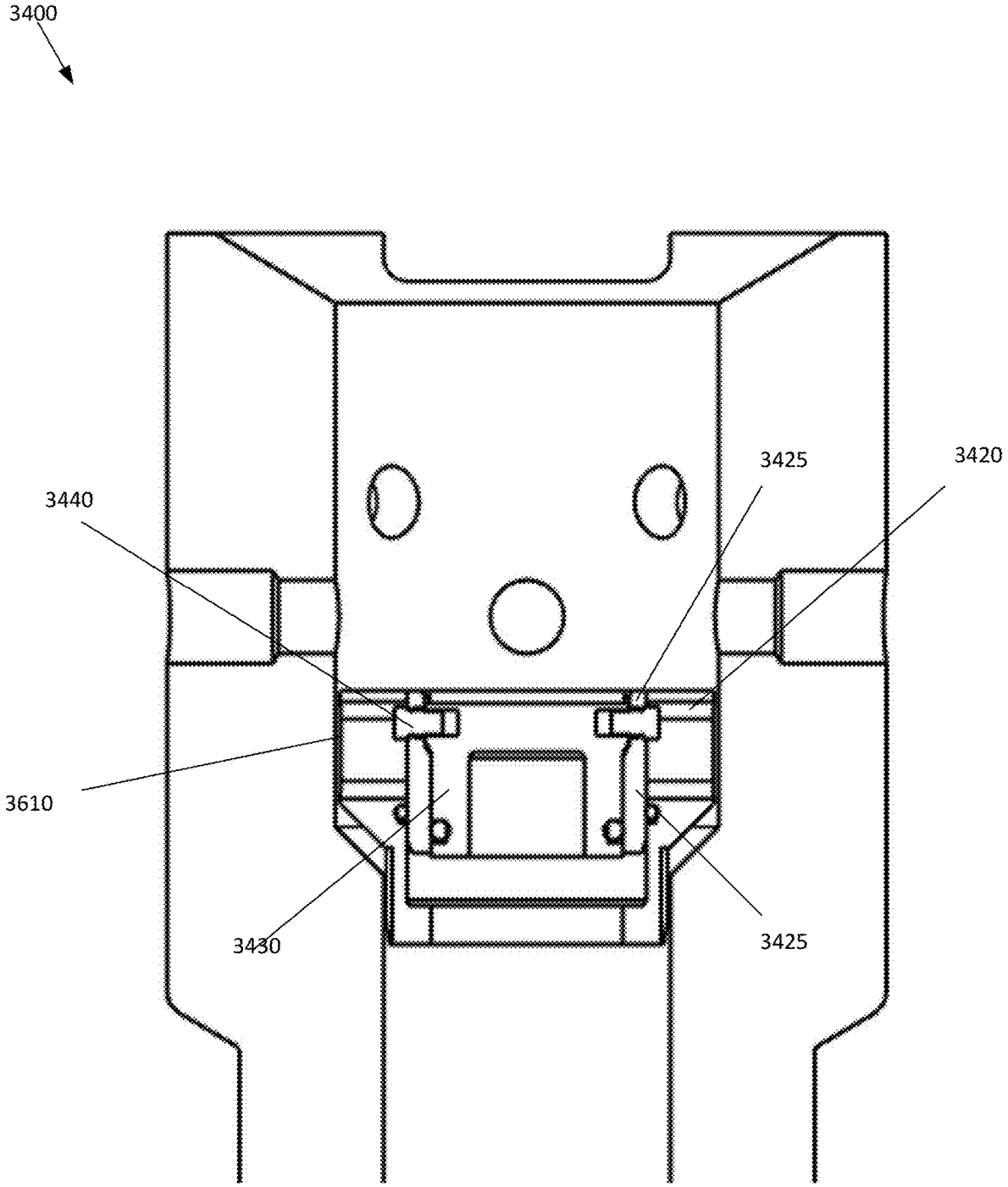
FIG. 36 depicts a downhole tool, according to an embodiment.

FIG. 36 depicts a cross-section view of a blocking system for a downhole tool 3400, according to an embodiment. Elements depicted in FIG. 36 may be described above, and for the sake of brevity, a further description of these elements may be omitted.

As depicted in FIG. 36, due to flowing fluid in in the second direction, downhole tool 3400 may act as a resettable check valve by moving plug 3430, annular piston 3425, and housing 3420 in the second direction. When housing 3420 moves in the second direction, fluid may flow in an annular space 3610 between an outer diameter of housing 3420 and an inner diameter of mandrel 3410.

Figure 37:
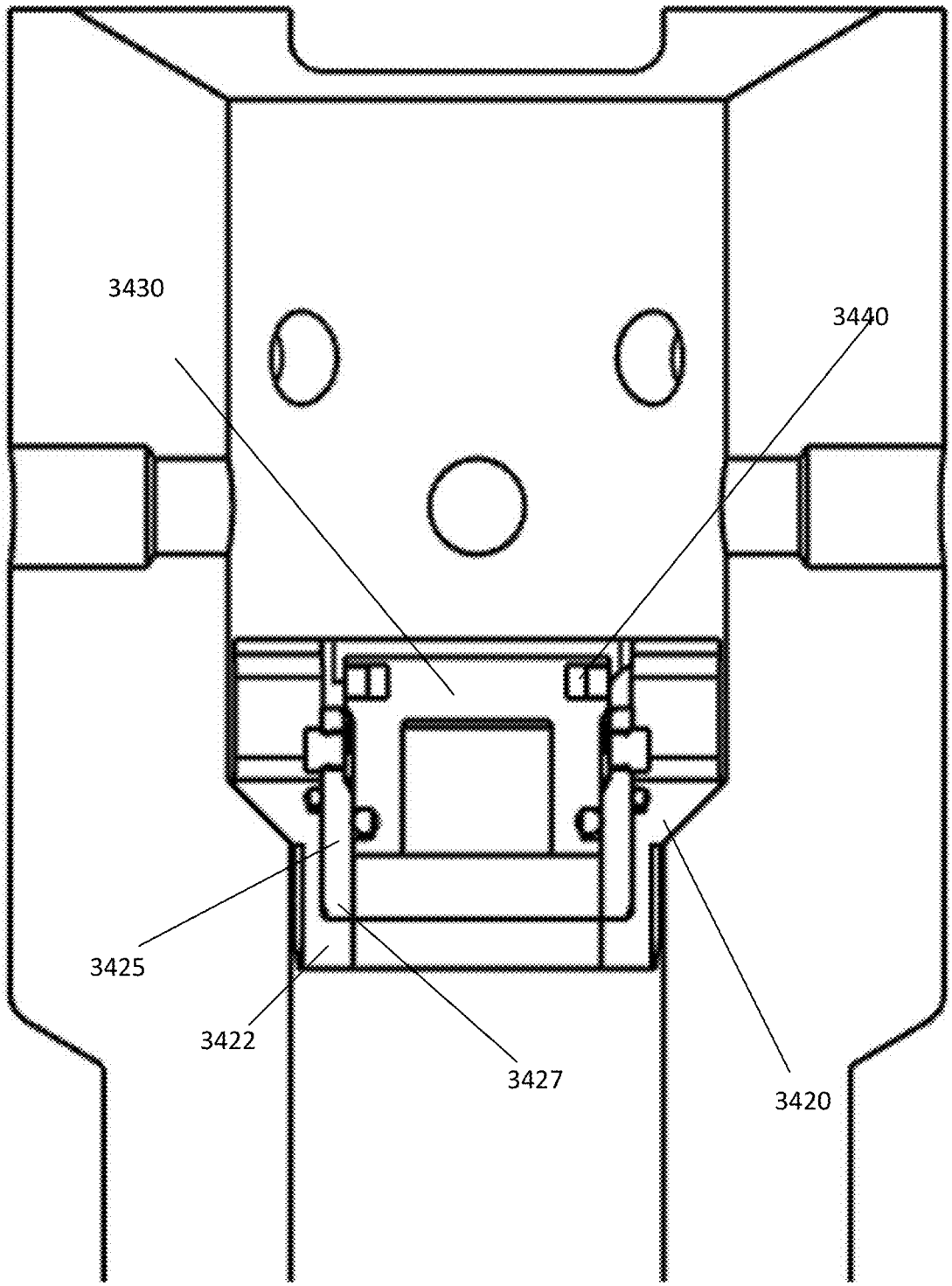
FIG. 37 depicts a downhole tool, according to an embodiment.

FIG. 37 depicts a cross-section view of a blocking system for a downhole tool 3400, according to an embodiment. Elements depicted in FIG. 37 may be described above, and for the sake of brevity, a further description of these elements may be omitted.

As depicted in FIG. 37, after activating temporary coupling mechanisms 3440, annular piston 3425 may move relative to a stationary housing 3420 and stationary plug 3430. Specifically, annular piston 3425 may move in the first direction until distal end 3427 is positioned on internal profile 3422. This may enable housing 2920, annular piston 3425, and plug 2930 to retain a one-way seal across mandrel 3410 after activating temporary coupling mechanisms 3440 and the relative movement of annular piston 3425. Furthermore, the relative positioning of seals on the outer diameter of annular piston 3425 and seals on the inner diameter of annular piston 3425 may assist in retaining the seals.

Figure 38:
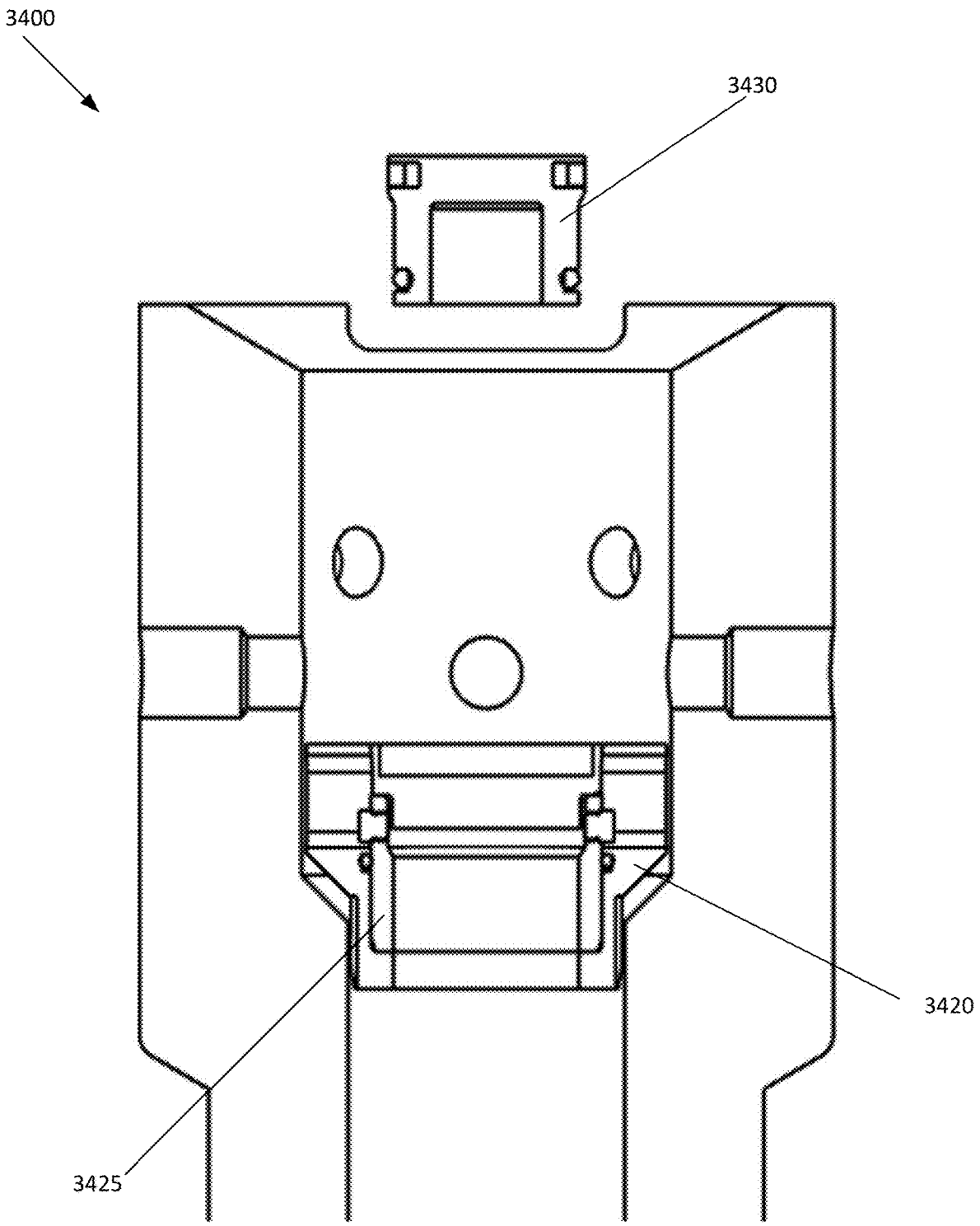
FIG. 38 depicts a downhole tool, according to an embodiment.

FIG. 38 depicts a cross-section and perspective view of a blocking system for a downhole tool 2900, according to an embodiment. Elements depicted in FIG. 33 may be described above, and for the sake of brevity, a further description of these elements may be omitted.

As depicted in FIG. 38, after temporary coupling mechanisms 3440 are activated, plug 3430 may axially move relative to housing 3420, which may still be coupled to mandrel 3410. Specifically, after temporary coupling mechanisms 3440 are activated, and fluid flows in in the second direction, the flowing fluid may dislodge plug 3430 from the inner passageway of housing 3420 permanently decoupling housing 3420 and plug 3420. This may permanently disable the check valve functionality of housing 3420 and plug 3430.

Reference throughout this specification to "one embodiment", "an embodiment", "one example" or "an example" means that a particular feature, structure, or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures, or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The invention claimed is:

1. A downhole tool comprising:

a housing;

a resettable plug coupled to the housing by a coupling mechanism, wherein the resettable plug is configured to:

restrict fluid communication across the downhole tool in a first direction and permit fluid communication in an opposite second direction while the resettable plug is coupled to the housing;

move in the first direction relative to the housing upon activation of the coupling mechanism while the resettable plug maintains a seal across the housing, wherein the activation of the coupling mechanism allows the relative movement of the resettable plug to the housing; and become irreversibly decoupled from the housing in response to fluid flow in the second direction such that, after the decoupling, the resettable plug can no longer restrict fluid communication across the downhole tool.

2. The downhole tool of claim 1, further comprising:

a plunger being coupled to the resettable plug before activating the coupling mechanism.

3. The downhole tool of claim 2, wherein the resettable plug is configured to move in the second direction away from portions of the downhole tool while coupled to the plunger.

4. The downhole tool of claim 3, wherein the resettable plug is configured to move away from the downhole tool after activating the coupling mechanism and fluid flows in the second direction.

5. The downhole tool of claim 4, wherein the plunger is configured to restrict communication across the downhole tool in the first direction and allow communication across the downhole tool in the second direction after activating the downhole movement of the resettable plug.

6. The downhole tool of claim 2, wherein the coupling mechanism is configured to temporarily couple the plunger and the resettable plug together.

7. The downhole tool of claim 2, further comprising:

communication channels positioned with the housing.

8. The downhole tool of claim 7, wherein the plunger is configured to form a secondary seal on the housing.

9. The downhole plug of claim 1, further comprising:

an annular piston radially located between the resettable plug and the housing.

10. The downhole tool of claim 1, wherein the coupling mechanism is a shear pin, and wherein after the activation of the coupling mechanism the resettable plug moves downhole within the housing while the housing remains static.

11. A downhole tool comprising:

a resettable plug configured to control communication across the downhole tool in a first direction while in a first state;

the resettable plug configured to not control communication across the downhole tool and allow fluid flow in a second direction while in a second state;

a plunger temporarily coupled to the resettable plug, the plunger being configured to move in conjunction with the resettable plug while in the first state;

a housing with multiple seats, wherein the seats are configured to accommodate the resettable plug and plunger based on the resettable plug being in the first or second state, wherein an upper surface of the plug includes a conduit, the conduit exposing an upper surface of the plunger to pressure above the plug to allow a pressure differential across the plunger, wherein the pressure differential activates a coupling mechanism to no longer couple the resettable plug and plunger.

12. The downhole tool of claim 11, wherein the resettable plug may be made of a dissolvable, composite, plastic, metal, or ceramic material.

13. A method associated with a downhole tool comprising:

positioning a resettable plug within a housing, the resettable plug controlling communication across the downhole tool;

restricting fluid communication across the downhole tool in a first direction via a resettable plug while permitting fluid communication in an opposite second direction through the downhole tool while the resettable plug is coupled to a housing;

activating a coupling mechanism to allow relative movement between the resettable plug and the housing;

moving the resettable plug in a first direction relative to the housing upon activation of the coupling mechanism, while the resettable plug maintains a seal across the housing;

irreversibly decoupling the resettable plug from the housing in response to fluid flow in the second direction such that, after the decoupling, the resettable plug can no longer restrict fluid communication across the downhole tool.

14. The method of claim 13, further comprising:

temporarily coupling a plunger to the resettable plug before activating the coupling mechanism.

15. The method of claim 13, further comprising:

activating the coupling mechanism based on pressure applied to an annular piston radially located between the resettable plug and the housing;

moving the annular piston relative to the housing and the resettable plug after activating the coupling mechanism.

16. The method of claim 15, wherein the resettable plug is used in a cartridge.

17. The method of claim 16, wherein the cartridge is deployed behind cement or after a cement operation is commenced.

18. The method of claim 15, wherein the resettable plug is used as mitigation to gun misfire issues or screen out issues in frac operations.

19. The method of claim 15, wherein the coupling mechanism is a shear pin, and wherein after the activation of the coupling mechanism the resettable plug moves downhole within the housing while the housing remains static.

* * * * *